US008915384B2

(12) United States Patent
Immerman et al.

(10) Patent No.: US 8,915,384 B2
(45) Date of Patent: Dec. 23, 2014

(54) UTILITY ITEMS MADE WITH RODS OF OVAL CONSTRUCTION

(75) Inventors: Robert A. Immerman, Moreland Hills, OH (US); Russell Benton Snell, Bentleyville, OH (US); Philip C. Dretzka, Mariemont, OH (US); Radu Alexandru Ghiorghie, Copley, OH (US)

(73) Assignee: InterDesign, Inc., Solon, OH (US)

( * ) Notice: Subject to any disclaimer, the term of this patent is extended or adjusted under 35 U.S.C. 154(b) by 510 days.

(21) Appl. No.: 12/006,835

(22) Filed: Jan. 7, 2008

(65) Prior Publication Data

US 2008/0185353 A1 Aug. 7, 2008

Related U.S. Application Data

(60) Provisional application No. 60/878,736, filed on Jan. 5, 2007.

(51) Int. Cl.
*A47F 5/01* (2006.01)
*A41D 27/22* (2006.01)
*A47K 10/04* (2006.01)

(52) U.S. Cl.
CPC ..... *A47K 10/04* (2013.01)
USPC ..... 211/119; 223/88

(58) Field of Classification Search
USPC ..... 211/34, 95, 96, 106, 106.01, 113, 115, 211/116, 118, 119, 119.004, 119.009, 211/181.1, 85.31, 90.03; 223/85, 88, 92, 223/95; 248/303, 304, 316.8, 339, 340; D6/317
See application file for complete search history.

(56) References Cited

U.S. PATENT DOCUMENTS

| | | | | | |
|---|---|---|---|---|---|
| 283,418 | A | * | 8/1883 | Ries | 248/303 |
| 609,743 | A | * | 8/1898 | Heaton | 223/88 |
| 628,784 | A | * | 7/1899 | Fitzgerald | 452/187 |
| D34,224 | S | * | 3/1901 | Blois | D6/317 |
| 834,800 | A | * | 10/1906 | Hawk | 223/95 |
| 843,794 | A | * | 2/1907 | Cazier | 223/95 |
| 1,079,241 | A | * | 11/1913 | Hertsgaard | 211/119 |
| 1,214,926 | A | * | 2/1917 | Kimball | 223/92 |
| 1,555,904 | A | * | 10/1925 | Brunson | 211/35 |
| 1,702,946 | A | * | 2/1929 | Powers et al. | 24/598.1 |
| 1,852,631 | A | * | 4/1932 | Villemure | 211/119 |
| 1,922,161 | A | * | 8/1933 | Hille | 223/95 |

(Continued)

OTHER PUBLICATIONS

2006 InterDesign Catalog, pp. 5-8, 10-18 , 22-24, 28-30, 33-34, 42-45, 48 and 51-55.

*Primary Examiner* — Joshua Rodden
(74) *Attorney, Agent, or Firm* — Calfee, Halter & Griswold LLP

(57) ABSTRACT

An implement for use in a bathroom or a kitchen which is composed of at least one rod which is oval in cross section, the rod being aesthetic in appearance and providing an advantageous force distribution over rods with circular cross sections. The implement can be a hanging device, such as a hanger, a hanger for ties and belts, and many other variations having a hook portion for engaging a cylindrical support, an over-the-door/vertical wall device also including the rods with the oval cross section, the latter devices being, for example, clothes supporting hooks, hooks for articles made from fabric; wire metal baskets having a rim and/or transition device made from a rod with an oval cross section; paper or magazine holders comprising parallel racks separated by upstanding walls; bag dispenser and handles for implements.

6 Claims, 61 Drawing Sheets

(56) References Cited

U.S. PATENT DOCUMENTS

| | | | | | |
|---|---|---|---|---|---|
| 1,970,009 | A | * | 8/1934 | Linnemann | 223/88 |
| 2,102,812 | A | | 12/1937 | Southgate et al. | |
| D125,109 | S | * | 2/1941 | Lamar | D6/317 |
| 2,593,356 | A | * | 4/1952 | Smith | 211/119 |
| 2,634,031 | A | * | 4/1953 | Klein | 223/88 |
| 2,649,208 | A | * | 8/1953 | Wilson | 211/119 |
| 2,690,844 | A | * | 10/1954 | Torrance | 211/119 |
| 2,760,648 | A | * | 8/1956 | Van Dusen | 211/118 |
| 2,778,385 | A | | 1/1957 | Gier | |
| 2,797,030 | A | * | 6/1957 | Millhuff | 223/85 |
| 2,829,810 | A | * | 4/1958 | Wilson | 223/88 |
| 2,842,329 | A | * | 7/1958 | Friedman et al. | 248/308 |
| 2,929,509 | A | * | 3/1960 | Van Dusen | 211/59.1 |
| 3,043,547 | A | * | 7/1962 | Reich | 248/317 |
| 3,138,259 | A | * | 6/1964 | Sitt | 211/85.2 |
| D201,112 | S | * | 5/1965 | Stein | D6/315 |
| D206,638 | S | * | 1/1967 | Dusen | D6/315 |
| D207,076 | S | * | 2/1967 | Bertram | D6/315 |
| 3,342,345 | A | * | 9/1967 | Van Dusen | 211/119 |
| 3,370,715 | A | * | 2/1968 | Kolozsvari | 211/116 |
| 3,488,025 | A | * | 1/1970 | Rowland | 248/339 |
| 3,570,729 | A | * | 3/1971 | Zuckerman | 223/96 |
| D231,965 | S | * | 7/1974 | Gutestam | D6/317 |
| 3,887,079 | A | * | 6/1975 | Crew | 211/118 |
| 3,923,279 | A | * | 12/1975 | Gresley et al. | 248/318 |
| D242,414 | S | * | 11/1976 | Salladay | D6/315 |
| 3,999,821 | A | * | 12/1976 | Moody et al. | 312/236 |
| 4,026,446 | A | | 5/1977 | Kessler | |
| 4,029,212 | A | * | 6/1977 | Uadiski | 211/113 |
| 4,129,218 | A | * | 12/1978 | Koellner | 211/116 |
| 4,136,784 | A | * | 1/1979 | Knobel et al. | 211/119 |
| 4,193,504 | A | * | 3/1980 | Berkowitz | 211/119 |
| 4,278,177 | A | * | 7/1981 | Fahmi | 211/116 |
| D260,463 | S | * | 9/1981 | Imus | D6/514 |
| 4,366,909 | A | * | 1/1983 | Fahmi | 211/116 |
| 4,428,486 | A | * | 1/1984 | Collins | 211/119 |
| 4,429,797 | A | * | 2/1984 | Collins | 211/119 |
| D281,931 | S | * | 12/1985 | Arnold et al. | D6/317 |
| 4,742,979 | A | * | 5/1988 | Syversten et al. | 248/65 |
| D296,845 | S | | 7/1988 | Kawalek | |
| 4,776,195 | A | | 10/1988 | Fukuhara et al. | |
| 5,022,569 | A | | 6/1991 | Beaulieu | |
| D320,118 | S | * | 9/1991 | Testa | D6/317 |
| 5,092,501 | A | | 3/1992 | Potucek | |
| D334,292 | S | * | 3/1993 | Klein et al. | D6/317 |
| 5,224,607 | A | * | 7/1993 | Koresko | 211/34 |
| 5,480,075 | A | * | 1/1996 | Robinson | 223/88 |
| 5,613,628 | A | * | 3/1997 | Burkhalter | 223/85 |
| 6,010,044 | A | * | 1/2000 | Hsiao | 223/85 |
| 6,070,773 | A | * | 6/2000 | Pogoda | 223/88 |
| D428,711 | S | * | 8/2000 | Rowley | D6/317 |
| 6,260,746 | B1 | | 7/2001 | Abdi | |
| 6,443,337 | B1 | | 9/2002 | Muehlhauser | |
| D486,309 | S | * | 2/2004 | Abdi et al. | D6/315 |
| 6,749,093 | B2 | * | 6/2004 | Harris | 223/85 |
| D499,255 | S | * | 12/2004 | Goodman et al. | D6/317 |
| 7,445,544 | B2 | * | 11/2008 | Niemiec | 452/193 |
| D589,070 | S | * | 3/2009 | Beld et al. | D15/199 |
| 7,611,034 | B1 | * | 11/2009 | Peterson | 223/88 |
| 2004/0069819 | A1 | | 4/2004 | Strouts | |
| 2006/0042714 | A1 | | 3/2006 | Scheffer | |

* cited by examiner

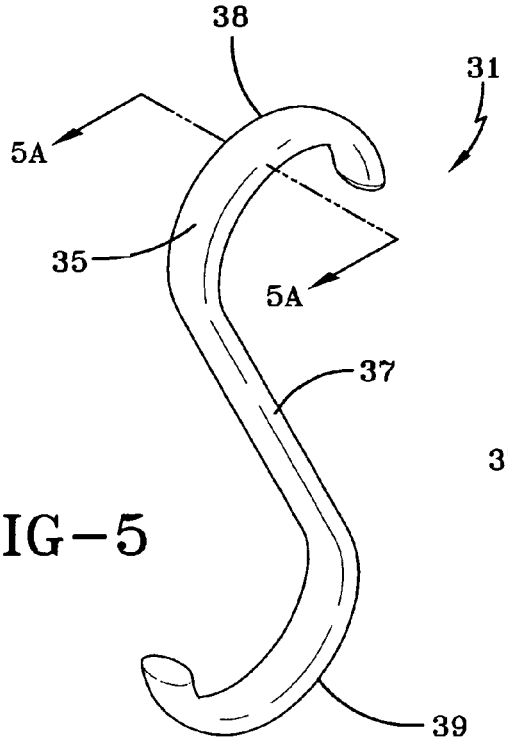
FIG-5
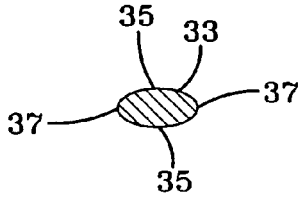
FIG-5A
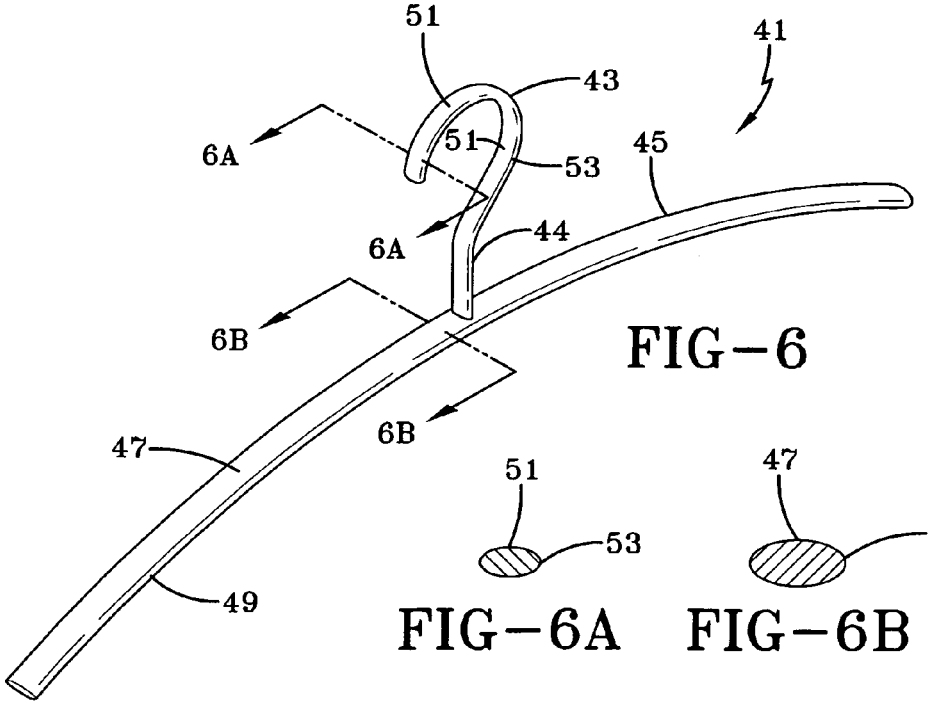
FIG-6
FIG-6A
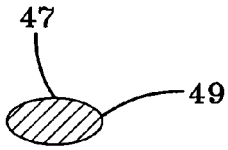
FIG-6B 531
533
549
537
553
551
539
555
535
541
557
543
559
560
545

562
561
563
564
565
21C

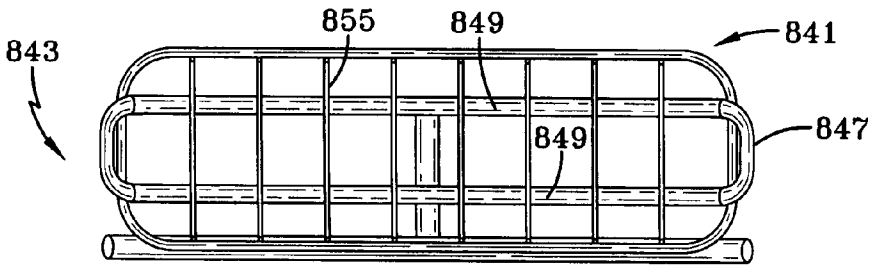
FIG-30A
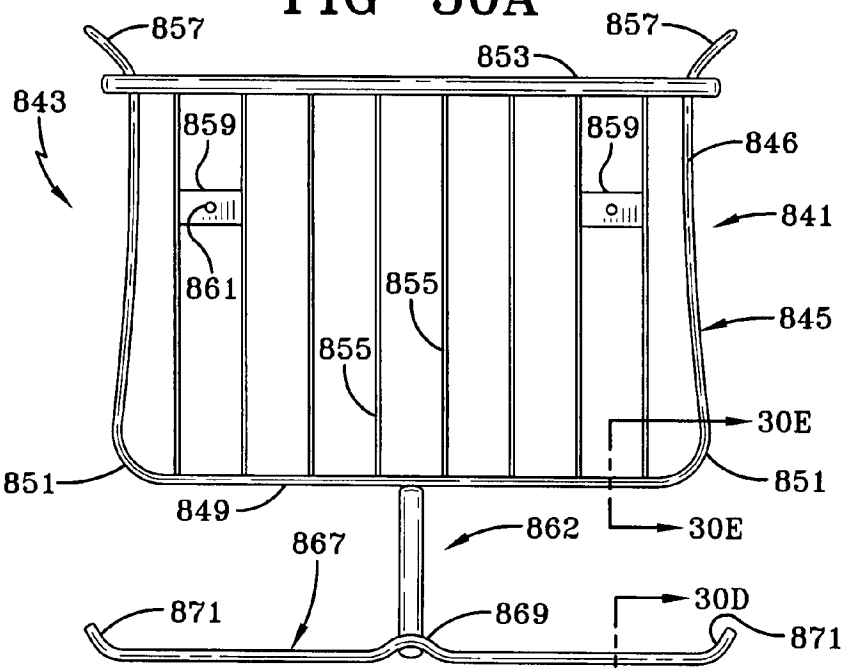
FIG-30B
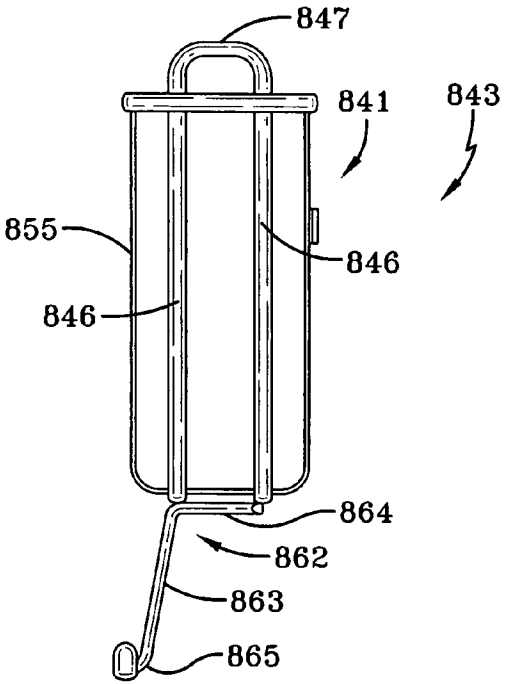
FIG-30C
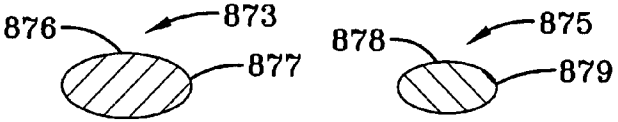
FIG-30D
FIG-30E

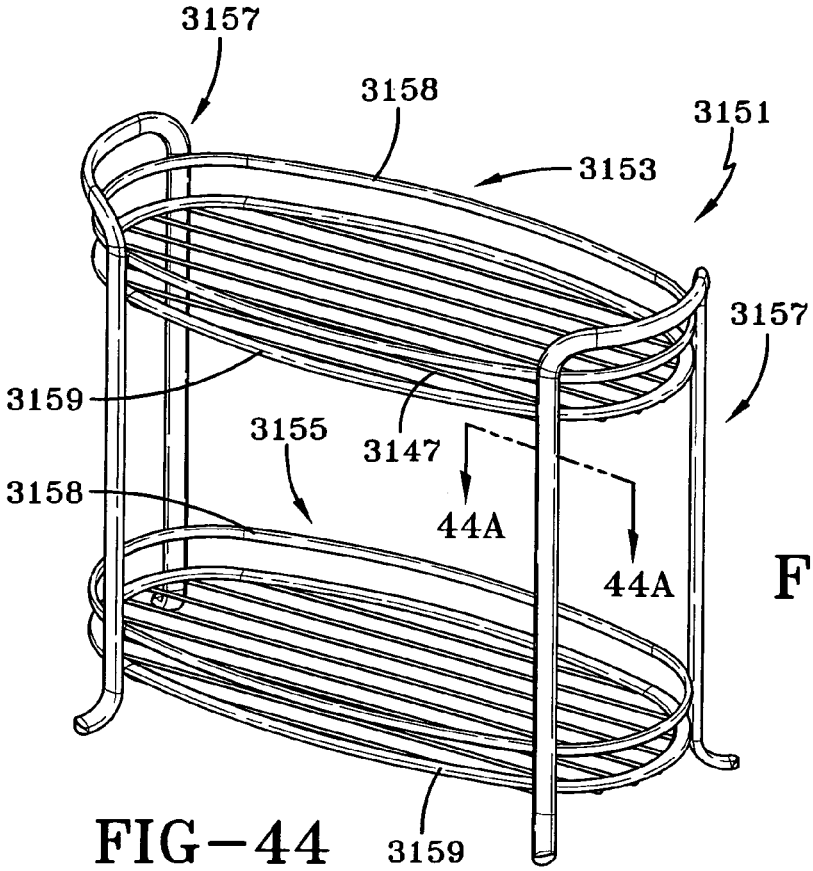
FIG-44
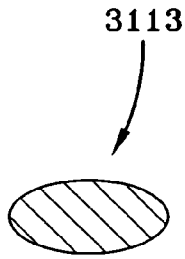
FIG-44A
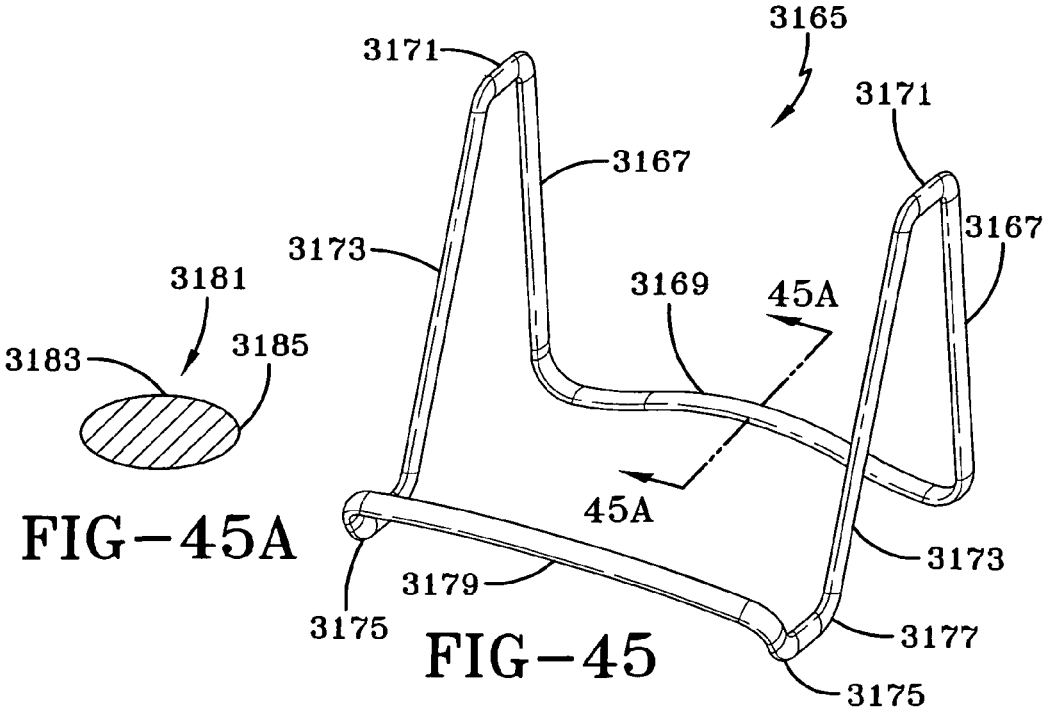
FIG-45A
FIG-45

UTILITY ITEMS MADE WITH RODS OF OVAL CONSTRUCTION

CROSS-REFERENCE TO RELATED APPLICATION

This application claims priority of U.S. Provisional Application No. 60/878,736 filed Jan. 5, 2007, under Title 35, United States Code, Section 119(e).

BACKGROUND OF THE INVENTION

1. Field of the Invention

This invention relates to utility devices made from rods having and oval cross section, the utility devices including general household items such as hanging devices having hooks for engaging horizontal supports, like various hook devices, hangers for clothing and other articles, and tie, scarf and belt holders; over-the-door, over-the-tank and over-the-cabinet devices such as hooks, baskets, magazine holders, toilet tissue holders and reserves, towel holders, mail centers, bag holders and container holders; handles for tools and other implements; over-the-shower holders; wall mounted devices such as towel bars and CD/DVD holder; suction mounted kitchen items such as sponge and dish holders; and free standing items such as paper towel stands, napkin holders, toilet tissue reserves and holders, magazine stands and toilet tissue holders, trivets, wine racks, coaster holders, tier shelving units, utensil holders, bowls, mug holders, towel holders, book holders, spoon rest and many other items.

2. Description of the Prior Art

Household items such as metal hangers, functional devices held on over-the-door hooks, devices for storing textile products such as clothing, materials and other items on cabinets, household storage containers and implement handles, kitchen items and bathroom items—all made from metal wire or rods are well known in the art. Various types of metal wire are used in the formation of these products. These functional consumer goods use cylindrical rods or wire, round in cross section, which can be bent, welded and finished. There are various drawbacks to this type of construction. One problem relates to fastening components together, such as by welding—especially spot welding. With cylindrical wires or rods, there is limited contact area between cylindrical parts, which involves either line contact or point contact. This small area makes welding difficult, particularly for welding many parts on a commercial basis. Another drawback is that cylindrical wire makes line contact with articles suspended therefrom or by which the product is supported, which puts unwanted creases in the textile products. Additionally, the line contact concentrates the force transmitted thereby, to render the products suspended thereon unstable, possibly damaging to surfaces the wire product contacts and sometimes renders the wire product difficult or uncomfortable to hold. Furthermore, cylindrical wires and rods having reflective surfaces are difficult to polish because they lack orientation, that is, they do not have a top and a bottom. Additionally, light is reflected from them in a disorganized and often unattractive manner. An additional drawback is that many products made from cylindrical wires or rods are not attractive, particularly with respect to products which are visible in a home, such as items used in bathrooms or kitchens.

Other types of cross-sectional wires are known in the art. For example, D296,845 discloses a "peanut-shaped" cross-sectional wire for a garment hanger. U.S. Pat. No. 5,092,501 discloses a "star-shaped" and T-shaped cross-sectional wire for coat hangers. U.S. Pat. No. 6,260,746 discloses a "pear-shaped" cross-sectional wire for coat hangers. U.S. Pat. No. 6,443,337 discloses a "lemon-shaped" cross-sectional wire for hangers. U.S. Patent Publication No. 2004/0069819 discloses a rounded wire with planar sides for a hanger.

Other types of hangers include features to hold a garment in place. U.S. Pat. No. 4,026,446 discloses a round wire clothes hanger with an encircling serrated sleeve to grip garments draped thereover. U.S. Pat. No. 5,022,569 discloses a widened cross-sectional wire in the "shoulder area" of a hanger which allows for greater support of garments.

Oval-shape cross-sectional rods or wire are also known in very specialized areas unrelated to kitchen goods, bathroom goods and general household goods. U.S. Pat. No. 2,102,812 discloses a method and apparatus for making welding rods where the cross section of the wire is an oval. However, U.S. Pat. No. 2,102,812 is directed to the welding ability of the wire and not to its appearance or shape. Further, welding rods are not strength-supporting rods and only provide welding material.

Accordingly, there is a need for cross-sectional rod or wire that not only adds to the stability and strength of these various products, but also adds to the aesthetics of the products. The present inventor has found that a wire rod having these features is one where the cross section is oval-shaped. The present inventor has determined that such a wire maintains a strong, structurally sound product and also possesses aesthetic value, giving a sleek, modem and strong appearance. The inventor has also noted that chrome-plated steel wire provides a very good and unexpected reflection which is better than similar metal wires which are round in cross section or have flat sides.

The result of using a wire or rod oval in cross section as a construction material is to yield a variety of products which perform their functions well, which are particularly sturdy, and have a sleek, modern appearance. Many of the products function better to make use of the wide surface or the narrow surface of the oval wire or rod. Products made from rods with oval cross sections are often ergonomic, and the broad surface of the rods can be gripped firmly, more easily than the narrow surfaces or rods with cylindrical cross sections. The products are often sturdier than corresponding products made from rods or wires with cylindrical cross sections because of the wide surfaces in contact where welding occurs. The oval cross section yields a variety of products which are sleek and modern, and very functional.

SUMMARY OF THE INVENTION

It is an object of the present invention to provide a utility item made from wires or rods which function better than similar items made from cylindrical wires or rods which are circular in cross section.

Another object of the present invention is to provide a utility item having a load carrying wire or rod which has higher tensile strength than a cylindrical wire or rod, or any wire or rod having a circular cross section.

A further object is the provision of a utility item having a better surface than a cylindrical wire or rod having a circular cross section, for use in welding such rods or wires together with other pieces.

A still further object of the invention is the provision of a utility item made of wires or rods having better support surface than do cylindrical wires or rods having circular cross sections, for many hard object and fabric pieces.

Yet another object is to provide an improved ergonomic surface for a handheld part of a utility item made from wires or rods than utility items made from cylindrical wires or rods which are circular in cross section.

It is still another object to provide metal household utility items, including bathroom and kitchen items, which are easier to polish than present metal household utility items made from cylindrical wire.

A still additional object of the present invention is to provide a utility item made from one or more wires or rods having improved top and bottom surfaces for cleaning and polishing.

Another object is to provide a metal wire or rod which can be plated with a highly reflective metal which yields a more interesting and aesthetic reflection of light than plated wires or rods with round cross sections.

It is yet an added object to provide a utility item made from wires or rods having wide surfaces and narrow surfaces for selectively engaging other surfaces with desired results, such as having wide surfaces for engaging textiles to avoid or reduce the formation of lines in the textile that would occur if a narrow surface were to engage the textile.

An additional object of the present invention to provide objection having narrow surfaces for engaging objects in some situation, such to avoid the collection of excessive liquids, as on dish drainers, which function better if narrow surfaces were to engage dishes and the like.

It is another object to provide a household device having increased sliding ability for use on hooks and the like which should be capable of being slid on a support member.

A further object is to provide utility items made from wires or rods for providing utility items having a sleek, modern look, an improvement over the same objects made from cylindrical wires or rods having circular cross sections.

Another object is to make a hook-like device having a wide surface and a narrow surface for hanging articles on the wide surface to prevent slippage of the articles on the hook-like device.

A further object is to provide a hook-like device having wide and narrow surfaces, where the wide surface is in greater engagement than the narrow surface on articles hung from the hook-like device.

It is a further object to provide an improved hanger having relatively wide surfaces to engage clothing hung thereon, to prevent putting unwanted creases in the clothing and to prevent narrow surfaces from inadvertently damaging the clothing.

Yet another object is the provision of a tie and/or belt holder having relatively wide surfaces engaging the tie or belt hung thereon, to add stability to the holder and to protect the tie, scarf or belt from damage which could occur if narrow surfaces made such engagement.

A still other object is to provide a hook-like device for engaging a horizontal rod having relatively wide surfaces contacting the rod, with one or more hook-like structures attached to the hook-like device with wide surfaces for engaging products hung therefrom.

It is an additional object to provide a one-piece device with a hook having a relatively wide surface for engaging a wire or rod to hang an article therefrom.

Another object of the invention is to provide an over-the-door or over-the-cabinet or over-the-tank device having hooks for suspending clothes, baskets, rolls of tissue or other items thereon, the devices incorporating wires or rods being aesthetic in appearance and rugged in use.

It is another object to provide an over-the-door device having a pair of hooks made from a single piece of material with a relatively wide surface for engaging the items to be hung thereon.

Yet a further object is to provide a metal basket composed at least in part by a metal wire or rod, oval in cross section, with wide surfaces facing items to be held in the basket.

Yet still another object is to provide a metal basket composed at least in part of a wire or rod, oval-shaped in cross section, held by an over-the-door or over-the-cabinet or over-the-tank bracket.

It is an object of the present invention to provide a paper or magazine rack assembly, which could include a toilet tissue reserve or holder, the rack having two or more frames composed at least in part of wires or rods oval in cross section.

A further object is to provide a bag holder composed at least in part of a rod or wire, oval in cross section, having relatively wide surfaces and relatively narrow spaces, forming rims through which bags may be inserted into the bag holder or removed therefrom.

Another object is to provide CD/DVD/video racks and/or organizers which are made from wires or rods which are oval in cross section.

A further object is the provision of improved wine bottle holders or wine racks composed of wires or rods oval in cross section.

An additional object of the invention is the provision of napkin holders made of wire or rods, oval in cross section.

It is another object of the invention to provide coaster holders made from wires or rods, oval in cross section, and coasters to be held in such holders.

Another object is to provide various bathroom items made from wires or rods, oval in cross section, such items including over-the-door hooks, over-the-cabinet hooks, over-the-tank tissue holders and/or magazine holders, wall-mounted hooks, stands, over-shower-door adapters, toilet tissue holders, over-the-tank storage units, toilet tissue roll holders, bases and/or rims for containers of all sorts, over-the-door and over-the-cabinet wall bar with wall-mounted towel bar units, toilet brushes, shower curtain hooks, towel bars, double towel bars, towel rings, paper and magazine racks, freestanding towel holders, and shower, over-the-door, over-the-cabinet and tier shelving units.

Yet another object is to provide various kitchen items made from wires or rods which are oval shaped in cross section, such kitchen items including soap dishes and holders, sponge caddies, paper towel holders, towel holders, wall-mounted paper towel holders, over-the-counter paper towel holders, napkin holders, handles for kitchen tools, trivets, wine racks, metal baskets, plate holders, bowls made from wires or rods for holding such items as fruit, banana holders, ladle and spoon stands, and utensil holders.

Yet still an additional object of the invention is the provision of storage and miscellaneous household items made from wires or rods, oval in cross section, such items including parts of tables, storage baskets, and CD/DVD holders.

These and other objects will occur to those skilled in the art from the description to follow and from the appended claims.

The term "oval cross section" is used throughout this application. The term "oval" means a cross-sectional surface which is rounded or curved at opposite ends, the opposite curved ends being connected by curved surfaces which neither complete a circle with the opposing ends nor which are straight lines interconnecting the two ends. However, the curved surfaces could have straight portions which are curved at their end portions to provide the curved ends. The oval is preferably symmetrical (and could be an ellipse). Moreover, the curved ends could be identical or could be defined by different curves. The term "metal rod with an oval cross section" or "metal rod having an oval cross section" as used herein to designate rods having an oval cross section, rather than rods which are bent in the shape of an oval. The terms "wire" or "rod" have been used above. These terms will hereafter be used interchangeably, although "rod" is most frequently used. The term "bent" is used to describe various configurations of the rod. "Bent" means shaped and does not necessarily mean that the rods were "bent" to achieve a particular configuration. They could have been bent, stamped, sintered, extruded, machined, molded, etc.

The invention involves using rods which are oval in cross section for forming all or parts of many implements which previously had been made from cylindrical rods. The rods provide an improved aesthetic appearance to the implements previously made from rods which were cylindrical in cross section. Oval-shaped rods have opposing wide surfaces convexly curved with respect to each other and opposing narrow surfaces convexly curved with respect to each other and interconnecting the wide surfaces to create an oval when the rod is viewed in cross section. The rod has a long axis extending between the wide surface and a short axis extending between the narrow surfaces, which short axis is transverse to the long axis. The implements made from the oval-shaped rod can use the wide surfaces or the narrow surfaces as their major functioning surface depending on the particular embodiment of the invention. Oval shaped rods as used according to the invention are often ergonomic.

The oval-shaped rods in many instances are transverse to each other, and sometimes are connected together by such means as welding. The oval-shaped rods can be flattened at their place of connection, such as by removing sectors from one or both of the rods or by removing the opposing narrow ends. The flattened rods according to the invention could be attached to similar rods at their flattened portions, or to rods having circular cross sections according to the prior art, or to sheets or plates of metal, with the flattened portions of the rods providing a broader attaching region to improve the attachment, whether by welding, connecting fasteners such as screws, soldering, and adhesion connection or the like, over line or point contact between cylindrical rods contacting other rods at the place where they are to be attached together.

The terms "upwardly" and "downwardly" means that one of the designated wide surfaces or narrow surfaces generally face in these directions when the device being described is positioned in its normal position of use. When two parts which are oval in cross section are described as having wide surfaces which face each other and face away from each other, this means that the opposing wide surfaces face each other and that the wide surface on the other side of the part face away from each other. Oftentimes the position of the surfaces is described without considering bends or curls in the part. The invention can be described as a utility member having at least one bent metal rod and an additional metal rod (which could be bent or straight). Each of these rods has an oval cross section with opposing wide surfaces and opposing narrow surfaces. The utility device has at least one stabilizing member for engaging a fixed item (such as a rod, counter, floor etc.) to restrain the utility device on the fixed item, and a utilitarian member operatively connected to the at least one stabilizing member. The respective wide and narrow surfaces of the at least one oval-shaped rod of which the utilitarian member is composed act as a functioning surface for functioning, for example, to hang or support clothing items, to support mail, to guide items such as clothing into a container, to support bottles and other containers such as for use in bathrooms and kitchens, to hold paper towel rolls and toilet tissue, to support magazines, to hold bottles of wine, to hold fruit, to hold coffee cups or mugs by their handles, to support paper napkins in a napkin holder, to support cooking utensils or to support CDs. The size of the oval-shaped rods of the at least one stabilizing member and of the utilitarian member differ because they have different purposes. The respective rods each have a uniform cross section, the respective long dimension between the respective wide surfaces are of the same length for the respective rods as are the respective dimensions between the narrow surfaces. Thus, each rod is of uniform cross sections, but the different rods have at least two different cross sections.

BRIEF DESCRIPTION OF THE DRAWINGS

The invention may take physical form in certain parts and arrangement of parts, the preferred embodiment of which will be described in detail in the specification and illustrated in the accompanying drawings which form a part hereof, and wherein:

FIG. 5 is a perspective view of a hanging hook, S hook or double hook according to an embodiment of the invention, and FIG. 5A is a cross section of the device.

FIG. 6 is a perspective view of a hanger according to the invention, and FIGS. 6A and 6B are cross sections of taken in the directions 6A-6A and 6B-6B.

FIG. 21D is a cross section of the transition between the sides and bottom thereof, taken in the direction 21D-21D.

FIGS. 21A, 21B and 21C are top, front and side views of an over-the-counter mail center or newspaper and magazine holder according to the invention.

FIGS. 30A, 30B and 30C are top, front and side areas of a wall mounted magazine/tissue holder according to the invention, and FIGS. 30D and 30B are taken in the directions 30D-30D and 30E-30E.

FIG. 44 is a perspective view of a two tier elongated shelving unit according to the invention, and FIG. 44A is taken in the direction 44A-44A.

FIG. 45 is a perspective view of a cookbook holder according to the invention, and FIG. 45A is taken in the direction 45A-45A.

DESCRIPTION OF THE PREFERRED EMBODIMENTS

Figure 1:
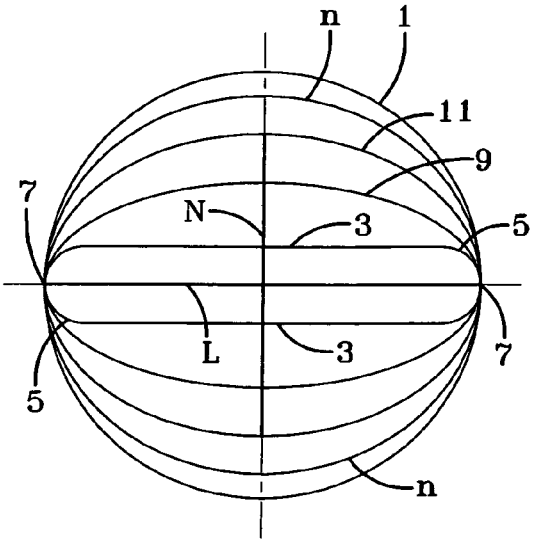
FIG. 1 is a schematic view of oval cross sections of rods forming components of the embodiments of the invention.
Figure 2:
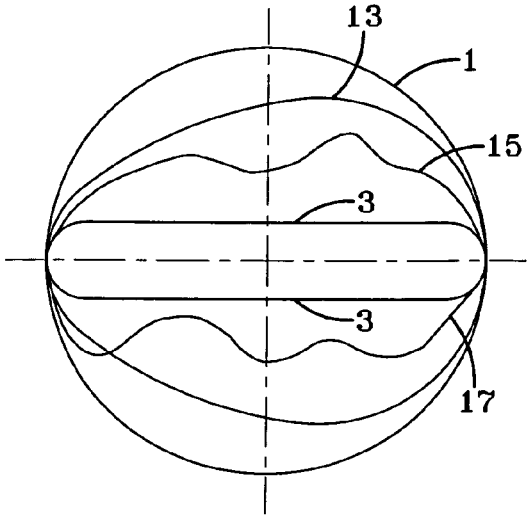
FIG. 2 shows the cross sections of other rods having non-circular cross sections.

The preferred embodiments of the present invention relate to implements made from metal rods used primarily in the household. Traditionally, such implements are made using cylindrical rods, that is, rods whose cross sections are circles. Occasionally, the rods have square cross sections. The present invention relates to the replacement of these cylindrical rods by oval-shaped rods, whereby improvements in the aesthetics and functioning of these implements can be achieved. Referring first to FIG. 1, a set of curved cross sections of metal rods is shown. Numeral 1 indicates a circle, which is the cross section of a cylindrical rod. This is the typical cross section of rods used in the prior art and in the prior art of the various embodiments discussed below. Numeral 3 represents the straight lines extending between the tangents of two semicircles 5. Numerals 3 and a portion of semicircles 5 can be described as a "flat, racetrack-shaped profile." All of the other curves, 9, 11 . . . n do comprise the cross section of the oval-shaped rod from which the various embodiments of the present invention are made. Such cross sections, defined by the curves 9, 11 . . . n are symmetrical. FIG. 2 shows an egg-shaped cross section defined by curve 13, and there are an infinite number of egg-shaped curved lying between major axis L and circle 1. The oval-shape cross sections shown in FIG. 1 are ellipses, and other oval-shape curves can be defined by mathematical formulas as well. However, random curves defining the cross section of the oval-shape rods are possible, as shown for example by line 15 in FIG. 2. Not only is line 15 not a regular curve, but its upper and lower portions are not symmetrical. Furthermore, a part of curve 15 is a straight line 17. The preferred form of the invention incorporates one of the curves 9, 11 . . . n shown in FIG. 1. Moreover, the rod itself can have variations along its length, so for example, the rods in the embodiments described below could have their crosswise diameters change along the length of the rod.

Figure 3:
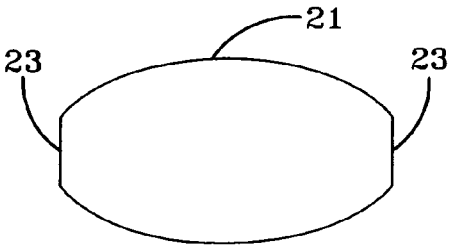
FIGS. 3 and 4 show two versions of modifications to a rod with an oval cross section which has been modified by flattening to facilitate welding of the rod to another piece.

Occasionally the oval rods may have to be modified for either aesthetic reasons or for functional reasons. For example, when the oval rods must be welded to each other or to another piece, it has been found advantageous to modify the oval shape. FIG. 3 shows the cross section of a rod having an oval shape 21, whose narrow ends have been omitted as shown at blunt ends 23. FIG. 3 thus shows a notched rod 21 having blunt ends 23 to conceal what otherwise would be exposed rod edges when rods with oval cross section could be used, for example, in making baskets having a grid-like construction made from rods having cross sections 21 which are arranged in the form of a grid. The exposed edges of the rods are not visible. Modifications to a rod to increase the area of contact with another piece is referred to herein as "flattened," although this does not necessarily mean the rod was submitted to a flattening manufacturing step.

Figure 4:
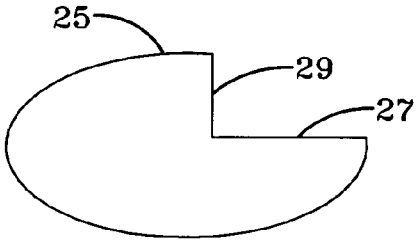

FIG. 4 shows another notched rod 25 which has a sector omitted to yield blunt edges 27 and 29. Notched rod 25 can be used in the same situations as was notched rod 21 shown in FIG. 3. A notched rod can also be referred to as "flattened."

Reference has been made to improve light reflection from oval-shaped rods incorporated in the invention as compared to cylindrical rods. Light reflected from a cylindrical surface projects radially and much light is not reflected towards the viewer's eyes. In an oval-shaped rod, much more light is reflected to the viewer's eyes. The invention is not restricted to rods with oval cross sections, which rods are highly reflective. The rods need not be treated at all, and could have a non-reflective coating, such as a bronze coating.

Oval-shaped rods according to the preferred embodiments of the invention have elliptically-shaped cross sections as shown in FIG. 1. Each oval has a long axis L and a narrow axis N, shown for example for oval 11. Although many different sizes of oval rods can be used in the practice of the present invention and to make the various embodiments discussed below, it has been found that, for the following embodiments, the profiles of which have the narrow axis N with a length of 0.12 inch and a long axis L having a length of 0.25 inch, or have the narrow axis N with a length of 0.16 inch and a long axis L with a length of 0.32 inch. Products having these dimensions function very well, had adequate support for items to be held thereby and were aesthetic to look at and ergonomic to use.

The invention can be described as being a utility device having at least one bent utilitarian item which comprises at least one part made from a metal rod having an oval cross section, the oval cross section having opposing wide surfaces and opposing narrow surfaces interconnecting the wide surfaces, and a stabilizing member for keeping the utility device in a stable operating condition when in use by engaging a stationary surface (in most cases, but when the entire utility device moves when in use, the stabilizing member keeps the device stable when the devices is in storage).

FIG. 5 shows a hanging device in the form of a double hook 31. As shown in FIG. 5A, double hook 31 has an oval cross section bounded by a curve 33 which is in the form of an ellipse. A very acceptable version of double hook 31 was provided using an oval-shaped rod with the height at its long axis having a dimension of 0.25 inch and a narrow axis having a dimension of 0.51 inches. Double hook 31 has a wide surface 35 and a narrow surface 37. Double hook 31 can be described as being bent with the wide surfaces being bent so that their long axes are parallel both before and after the bending, whereas the narrow axes, those extending between the wide surfaces, are not parallel in the bent portion of the hook but rather converge inside of the hook and diverge outside of the hook. Double hook 31 has a stabilizing member in the form of a bent supporting section, upper hook 38, for engaging a support, and a utilitarian member in the form of a hanging section or lower hook 39 facing in the opposite direction from upper hook 38.

Double hooks as shown can be used in many ways. For example, one of the hooks can extend over a horizontal support, and the other hook can be used to support such items as luggage with handles, suit bags with handles, and the like. Regardless of how it is used, it is sleek and modern in appearance.

FIG. 6 shows a hanging device in the form of a hanger 41 having a stabilizing member in the form of a bent supporting section or hook 43, and a utilitarian member in the form of a transverse portion or bow 45 to which hook 43 is connected by means of a connecting section 44 at its midpoint. Bow 45 is shown with its wide surfaces 47 being on the upper and lower portions of bow 45, and the narrow surfaces 49 interconnecting surfaces 47 forming the sides of bow 45. Bow 45 is curved convexly as viewed from the top. Having wide sides 47 on the upper part of bow 45 decreases the likelihood of forming creases or wrinkles on clothing or other textiles hanging on hanger 41. Furthermore, the bow has a more aesthetic appearance due to its high reflection as compared to cylindrical rods. Hook 43 is made from a smaller bent rod both for aesthetic and functional reasons since it would not be able, or would be less likely to be able, to wrinkle any textile hung thereon. Referring to FIG. 6A, hook 43 has wide surfaces 51 which face up and down when hanger 41 is in use, and narrow surfaces 53 facing in the horizontal position. Wide surfaces 51 on the inside of hook 43 engage a larger portion of the support on which hanger 41 is hung, which both spreads out the force at the point of contact with the support and makes the engagement with the support more stable since there is a wider contact area. Additionally, having the wide surfaces 51 facing upwardly and downwardly makes the hook need not protrude so much above a supporting bar as would a comparable cylindrical rod, which is more aesthetic. Also, having the wide surfaces hook 43 and bow 45 positioned as they are makes it easier for hanger 41 to be handled, making it a more ergonomic device. Furthermore, the higher visible reflection of an oval rod over a round rod improves its aesthetics, making it look sleek and modem.

Figures 7, 7A:
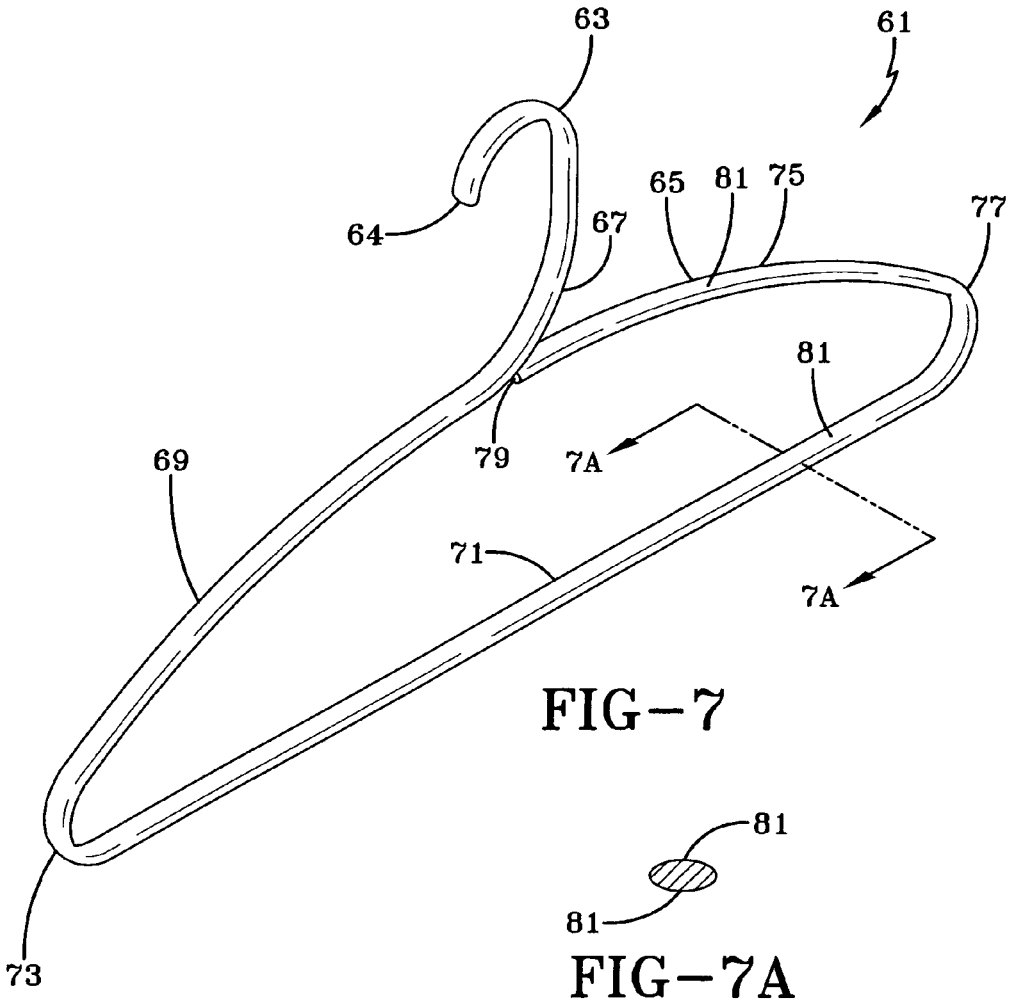
FIG. 7 is a perspective view of another hanger according to the invention.
FIG. 7A is a cross-sectional view of the hanger taken in the direction 7A-7A.

Another hanging device is shown in FIG. 7 as a double hanger 61, since shoulder covering clothing and pants can be hung thereon. Hanger 61 is a one-piece hanger having as a stabilizing member, a hook-shaped section 63 having a free end 64, a connecting section 67, and a utilitarian member in the form of a bow in the shape of a rounded triangle having a first curved part 69, a transverse portion or crossbar 71 extending from a curve 73 interconnecting portions 69 and 71, and a second curved part 75 which extends from a curve 77 interconnecting parts 71 and 75. Transverse portion 75 terminates at a free end 79. End 79 is welded to the base of connecting section 67 to avoid any instability of hanger 61 and to prevent any fabrics or the like from getting stuck between end 79 and first curved part 69. Hanger 61 is made from a rod with an oval cross section shown in FIG. 7A having its wide surfaces 81 facing generally upwardly and downwardly in order to engage clothing hung thereon while reducing the likelihood of wrinkling or creasing any clothing hung on hanger 61, and for not creasing or folding any trousers or the like hanging crossbar 71. Wide surface 81 at the underside of hook 63 adds stability to hanger 61 when it is hung from a support, and the entire unit is aesthetic by virtue of the rods with the oval cross section. Hanger 61 has the features discussed earlier about not extending high above a supporting bar and reflecting more visible light than would a hanger made from a cylindrical tube. Hanger 61 is sleek and modem in appearance.

Figure 8:
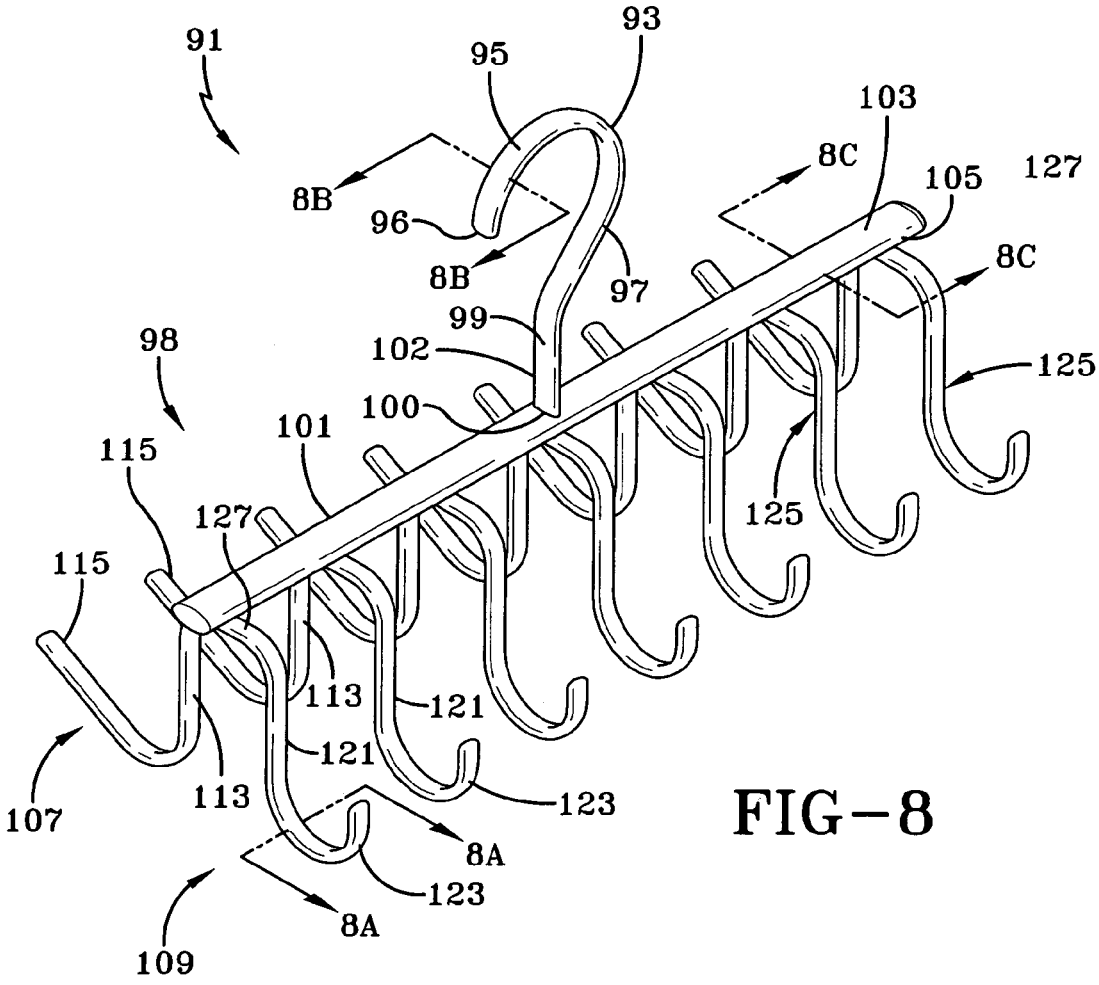
FIG. 8 is a perspective view of a tie, belt and scarf holder according to the invention.
Figure 8A:
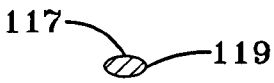
FIGS. 8A, 8B and 8C are cross sections of different parts of the structure taken in the directions 8A-8A, 8B-8B and 8C-8C.
Figure 8B:
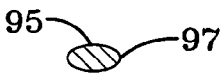
Figure 8C:
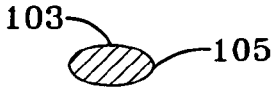

Referring next to FIG. 8, a hanging device in the form of a tie, scarf and belt holder 91 is shown. Holder 91 has a stabilizer member in the form of a bent supporting section or hook 93 which is made from a rod having an oval cross section, as shown in FIG. 8B, and has wide surfaces 95 and narrow surfaces 97. Hook 93 terminates in a hanging section 98 comprising a stem 99 and a utilitarian member in the form of a transverse member 101, the latter being oval in cross section as shown in FIG. 8C. Transverse member 101 has wide surfaces 103 and narrow surfaces 105. Hook 93 has at one portion at free end 96 and at an opposite portion a connecting section 102 which is welded to the middle part of transverse member 103 at a weld 100.

The utilitarian member further includes a pair of item-supporting holders or arms 107 and 109, arm 107 being a tie holder and arm 109 being a belt holder. Tie holders 107 each include a suspended portion 113 from which is bent a little less than 90° an inclined section 115 over which ties can be draped. Tie holders 107 are made from rods which are oval in cross section, having wide surfaces 117 and narrow surfaces 119 shown in FIG. 8A. Wide surfaces 117 face in the generally upward and downward directions for providing a relatively broad surface to hold ties thereon which are less likely to crease them than would either the narrow surfaces 119 or a tie holder made from cylindrical rods.

Tie holders 107 extend from one side of transverse member 103, and belt holders 109 extend from the other side so that both ties and belts can be supported on their respective holding arms. Belt holders 109 include a suspended section 121 and an upwardly turned hook 123 over which the buckle of a belt may be slipped so that the belt is supported by hook 123.

Although each of tie holders 107 and belt holders 109 could be made independently of each other, it is economically and structurally advantageous to make each of tie holders 107 and belt holders 109 out of a single element 125. Element 125 thus comprises a tie holder 107 on one half, and a connecting portion 127 for connecting each belt holder 109 to a respective tie holder 107. The midportion of each of elements 125 is welded to the underside, wide surface 103 of transverse member 101. As noted above, the sizes of each of the oval-shaped rods forming hook 93, transverse member 101 and holding sections 125 are all different as shown in FIGS. 8A, 8B and 8C, since they each have different weight supporting capacities. Having the wide sections in each case doing most of the functional work for tie holder 107 and belt holder 109 both stabilizes the unit in operation, is less likely to crease products hung therefrom, and is aesthetically pleasing. It is sleek and modern. The advantages of the oval-shaped rods over cylindrical rods are present in tie and belt holders 91. Unwanted creases are not put in the ties due to the upward-facing wide spaces.

Figure 9:
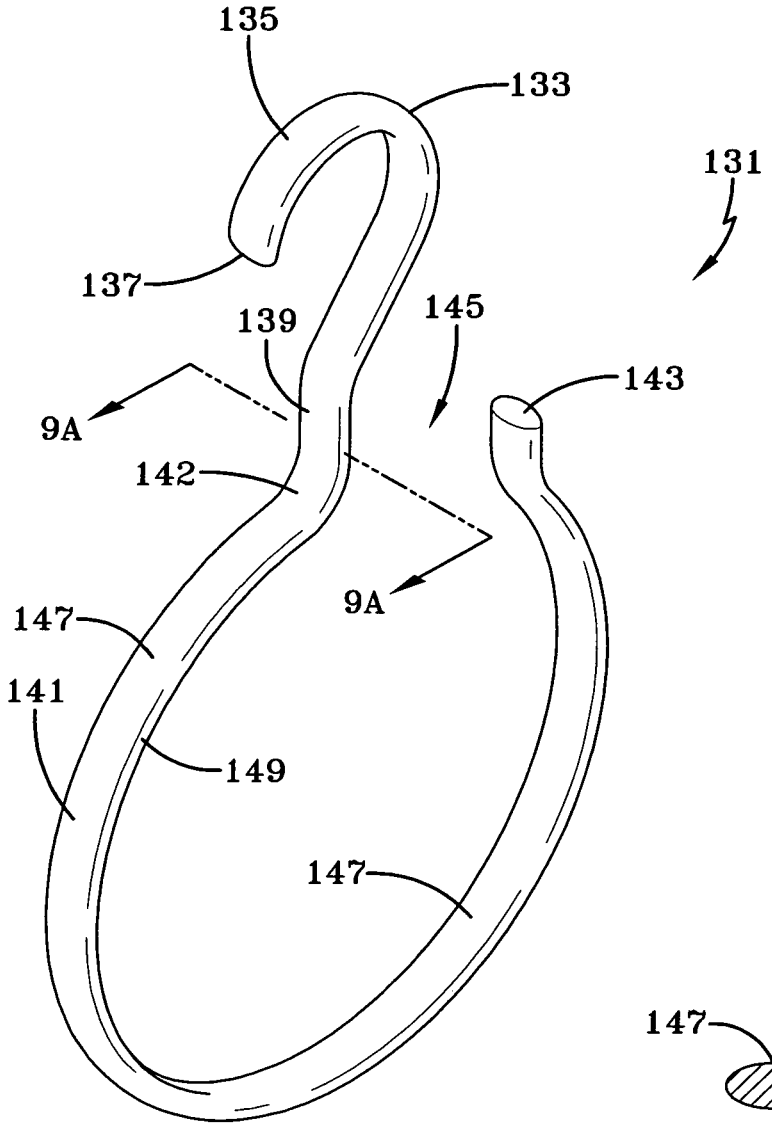
FIG. 9 is a perspective view of a hanging hook, accessory loop or hanging loop according to the invention.
Figure 9A:
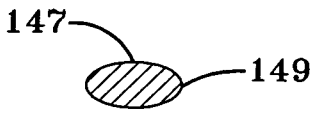
FIG. 9A is a cross section taken in the directions 9A-9A.

Another hanging device or hanging loop 131 is shown in FIG. 9, which comprises a stabilizing member in the form of a bent supporting section 133 composed of a hook 135 facing in one direction and terminating in a free end 137. Bent supporting section 133 further includes a stem or an integral connecting section 139 facing in the opposite direction and a utilitarian member in the form of an integral hanging section or loop portion 141 connected by a connecting portion 142 to connecting section 139, hanging section 141 being in the form of an open circle or loop having an upwardly turned free end portion 143 which is separated from connecting section 139 by a gap 145. As shown in FIG. 9A, hanging device 131 is made from a rod having an oval cross section having wide surfaces 147 and narrow surfaces 149. Hanging device 131 can be hung from a support by hook 135, and various items can be hung on hanging device 131 by being slipped through gap 145 and engaging hanging section 141. Hanging device 131 is bent so that its wide surfaces face both inwardly and outwardly with the long axes remaining parallel, while the short surfaces form the sides of hanging device 131 and the axes for the narrow surfaces extend in a converging direction inside of the curved surfaces and in a diverging direction outside of the curved surfaces. Flat surface 147 inside of hook 135 distributes the force on the support from which hanging device 131 is hung to stabilize the device more than would be the case if hanging device 131 were bent so that the narrow surfaces 149 would engage the support or if the unit were made from a cylindrical rod. The appearance of hanging device 131 is more attractive than would be a device made from a cylindrical rod because it is not located as high above the support on which it is hung (its narrow axis is less than the diameter of a corresponding cylindrical rod), and because of the increase in visible reflection of light. It has a modern and sleek appearance.

Figures 10, 10A, 10B:
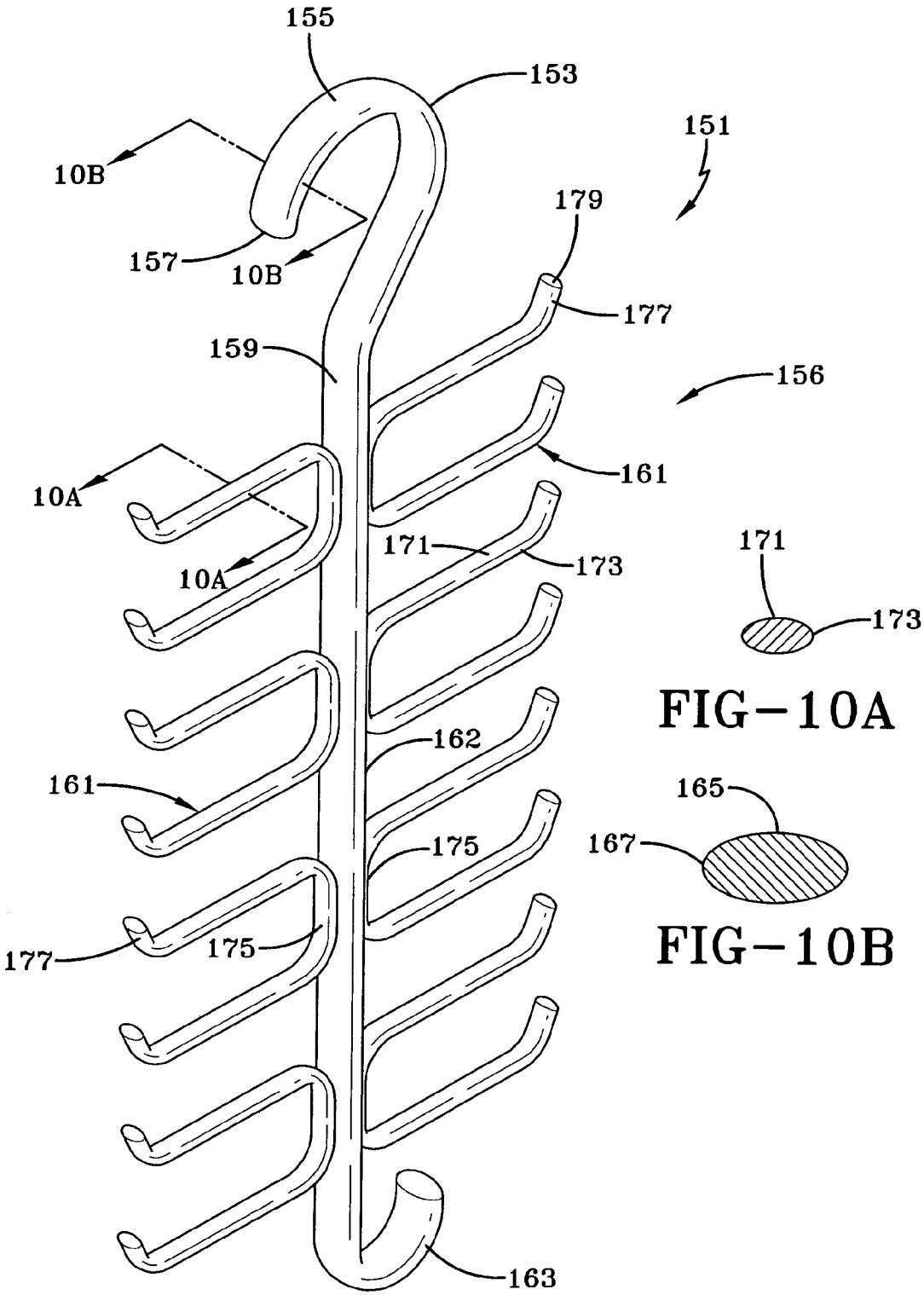
FIG. 10 is a perspective view of a tie and belt holder or vertical tie/belt rack for being hung on a horizontal support according to the invention.
FIGS. 10A and 10B are cross sections taken in the direction of the arrows 10A-10A, and 10B-10B.

A hanging device in the form a tie and belt holder or vertical tie/belt rack 151 is shown in FIG. 10. Holder 151 has as a stabilizing member a bent supporting or hook-shaped section 153 composed of a hook 155 with a free end 157 and hanging section 156 comprising a vertical stem 159 and arms 161. The utilitarian member includes stem 159 which extends to a stem-connection section 162 and terminates in a lower hook 163 which is of a smaller diameter than hook 155, and serves as a belt holder whereby the buckles of belts can be slipped over hook 163 to hang the belt therefrom. Hook-shaped section 153, stem 159, stem connecting section 162 and hook 163 are made from a metal rod having an oval cross section with wide surfaces 165 and narrow surfaces 167 as shown in FIG. 10B.

Arms 161 extend from stem connecting section 162. Arms 161 are oval in cross section, as shown in FIG. 10A, and have a wide surface 171 and a narrow surface 173. The rods of arms 161 are smaller than the rod forming supporting section 153, connecting section 159, stem connecting section 162 and hook 163. Wide faces 171 extend upwardly and downwardly, for engaging ties hung thereon with a reduced likelihood of putting any folds or creases in the ties since the wide surface is broader than the narrow surfaces 173 and would not make a line contact as would cylindrical rods. Arms 161 are conveniently formed in a generally U-shaped fashion with a pair of arms 161 extending from respective connecting sections 175. The respective connecting sections 175 are welded to opposite wide surfaces of stem connecting section 162 so that arms 161 are in vertical alignment on both sides of stem connecting section 162. Each arm 161 terminates in a bent-up portion 177 having a free end 179 for preventing ties from slipping off the end of arms 161. Wide surface 171 of hook-shaped section 153 enhances the stability of holder 151 when it is hung on a support. This unit, like the others, has improved aesthetic appearance over such devices made from cylindrical rods, and has a sleek and modern look.

Figure 11:
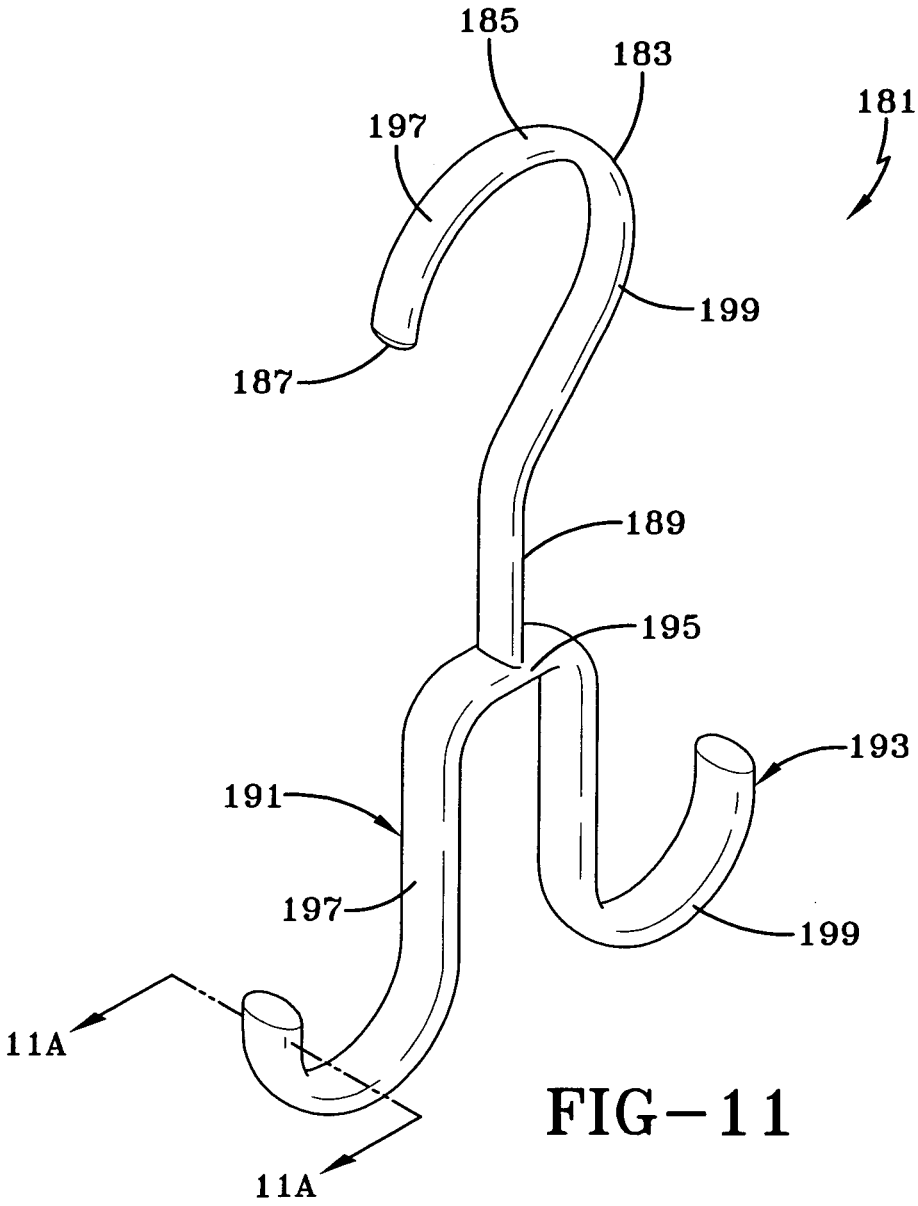
FIG. 11 is a front view of a hanging device with two hook-like portions for supporting items on the device, or rod hook according to the invention.
Figure 11A:
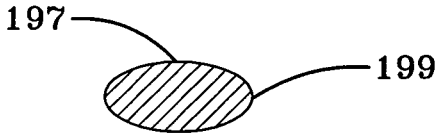
FIG. 11A is a cross section taken in the direction 11A-11A.

FIG. 11 shows a hanging device or rod 181 which has as a stabilizing member a bent supporting section 183 comprising a hook 185 facing in one direction (to the left as shown), having a free end 187 and a connecting section 189. A pair of hook-like members 191 and 193 face in opposite directions from each other and are inverted from hook 185, and form the utilitarian member of the device. Hook-like members 191, 193 are connected together by means of a horizontal connecting portion 195 which is welded to the end of connecting section 189. Hanging device 181 is composed of rods having cross sections which are oval in shape having wide surfaces 197 and narrow surfaces 199, as shown in FIG. 11A. Wide surfaces 199 engage the supporting member for device 181 and units hung from device 181 in hook-like members 191 and 193, offering the same advantages as those discussed earlier with respect to such embodiments in FIGS. 5 and 9. Hanging device 181 is constructed of components having oval cross sections, and has a sleek and modern appearance.

Figure 12:
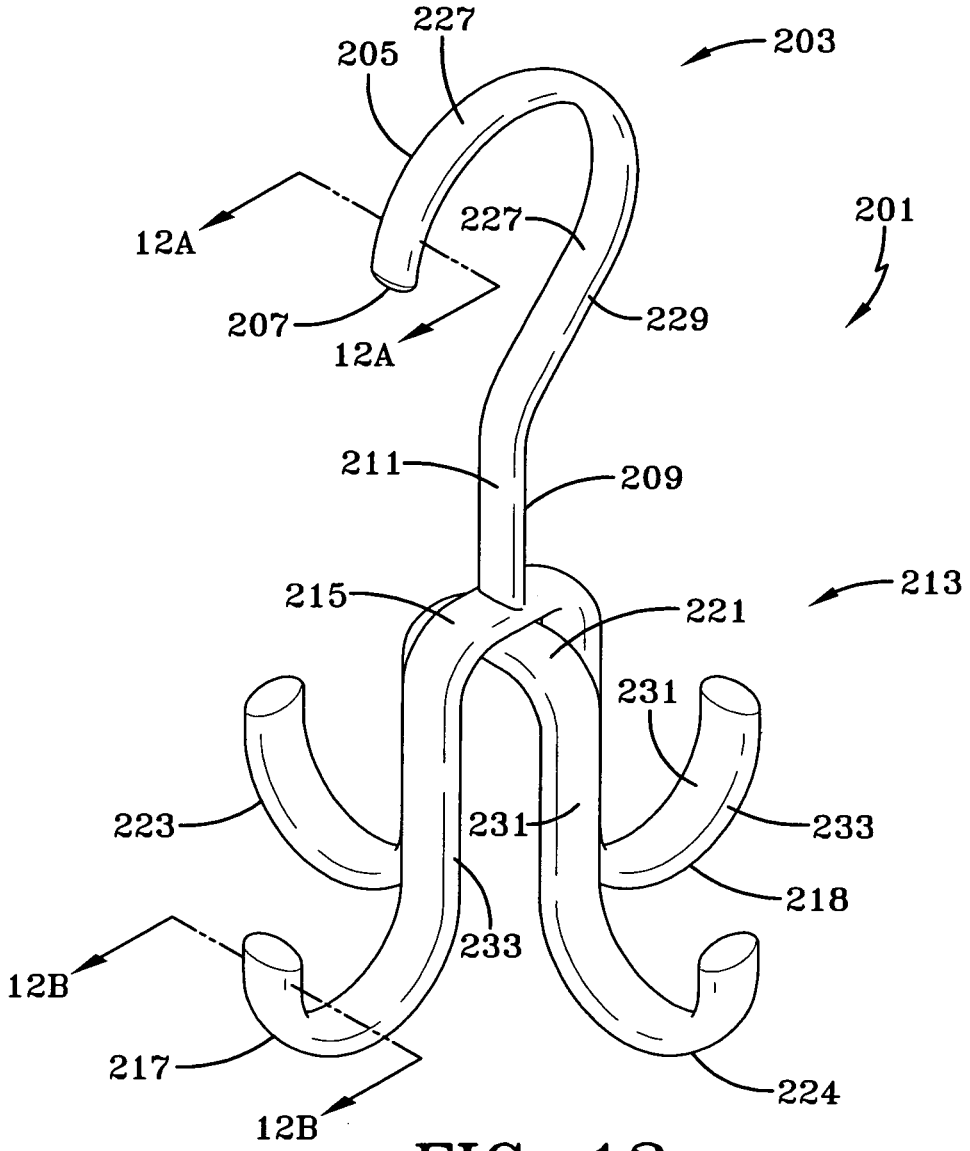
FIG. 12 is a perspective view of a hanging device having four article-supporting hooks, or rod hook according to the invention.
Figure 12A:
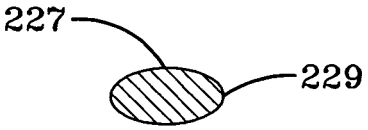
FIGS. 12A and 12B are cross sections taken in the directions 12A-12A and 12B-12B.
Figure 12B:
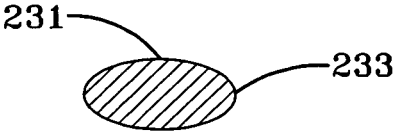

A similar hanging device or rod hook 201 is shown in FIG. 12. Hanging device 201 has as a stabilizing member a bent supporting section 203 composed of a hook 205 facing in one direction and having a free end 207 and a connecting section 209 forming a stem 211. Hanging device 201 has a hanging section 213 as the utilitarian member, which has a first connecting member 215 connected transversely to the stem 211 and first hook-like members 217 and 218 facing in opposite directions and being integral with first connecting member 215. A second connecting member 221 is attached to the first connecting member 215 beneath and in line with the longitudinal axis of stem 211. Two oppositely facing, hook-like members 223, 224 are integral with second connecting member 221, and hook-like members 223, 224 are 90° angularly displaced from hook-like members 217, 219. The rods are oval in cross section with bent section 203 having wide surfaces 227 and narrow surfaces 229, as indicated in FIG. 12A. The components of hanging section 213 have wide surfaces 231 and narrow surfaces 233, as shown in FIG. 12B. The wide surfaces both stabilize the device in use and are less likely to wrinkle or put folds or creases in products hanging from hook-like member 217, 218, 223 and 224. Hanging device 201, like the other devices disclosed herein, are attractive to view and appear sturdy when used, as they are. Hanging device 201 appears to be sleek and modern, having a sleek and modern look.

Figures 13, 13A:
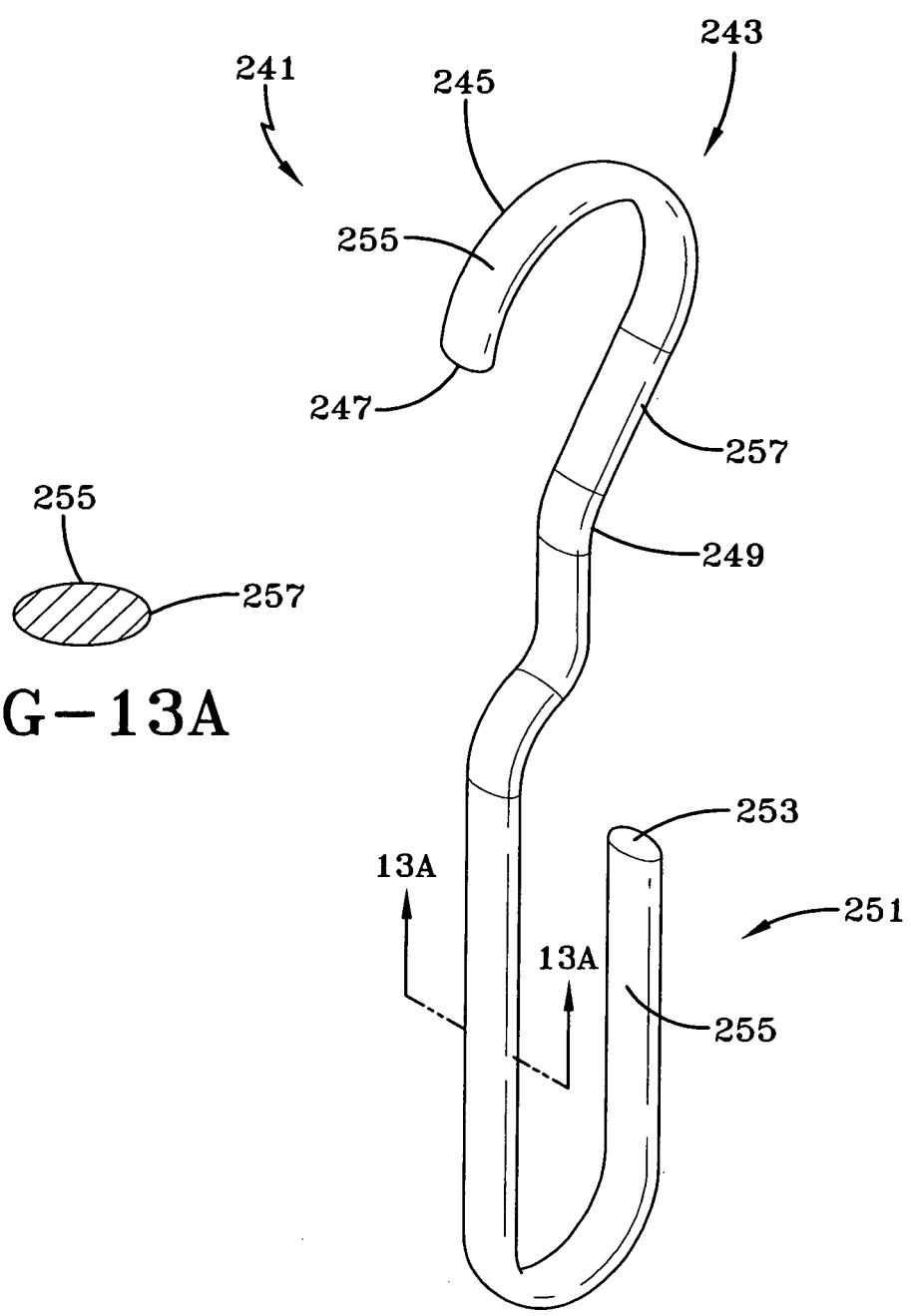
FIG. 13 is a perspective view of another hanging device with a single integral hook for receiving items to be suspended on the device according to the invention.
FIG. 13A is a cross section taken in the direction 13A-13A.

Another hanging device 241 is shown in FIG. 13. Hanging device 241 has a bent supporting section 243 as a stabilizing member, incorporating a hook 245 which has a free end 247 and an integral connecting section 249. Hanging device 241 has as a utilitarian member a hanging section 251 in the form of a "U" extending integrally from connecting section 249. Hanging device 241 has a free end 253. Hanging device 241 is oval in cross section, has its wide surfaces 255 on the inside and outside of device 241, and has narrow sections 257 forming the sides of device 241, as shown in FIGS. 13 and 13A. Thus, the long axes of the bent supporting section remain parallel where device 241 is bent, whereas the narrow axes converge inside of device 241 and diverge outside of the device. The wide axes provide stability to device 241, tend not to wrinkle or put folds or creases in items hung thereon, as would narrower surfaces, and they provide hanging device 241 with an aesthetic appearance.

Figure 14:
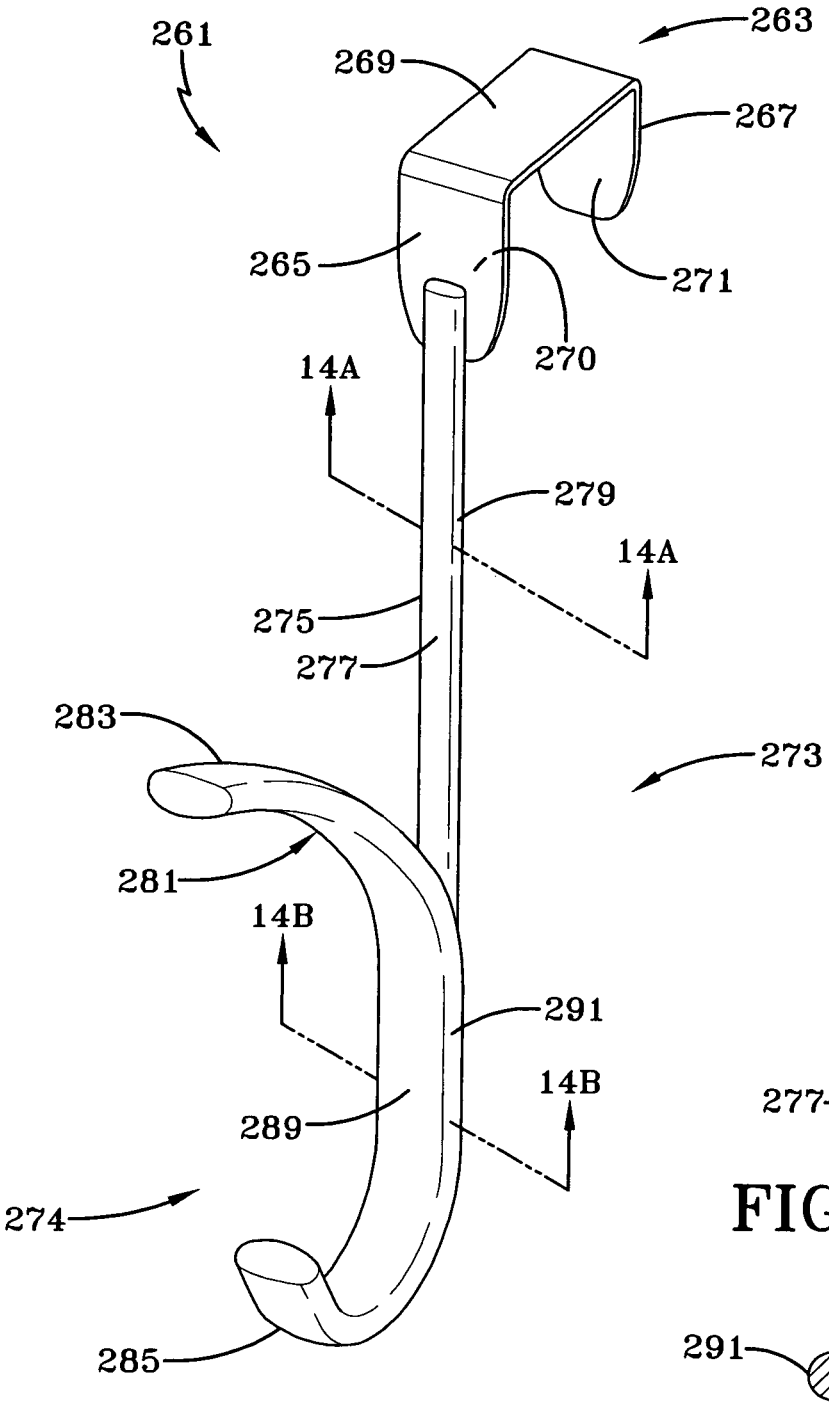
FIG. 14 is an over-the-door or double hook assembly according to the invention, with cross sections taken in the directions 14A-14A and 14B-14B shown in FIGS. 14A and 14B.
Figure 14A:
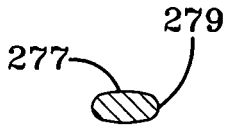
Figure 14B:
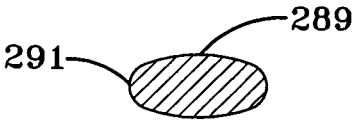

An over-the-door double hook hanging device 261 is shown in FIG. 14. It includes a stabilizing member in the form of a supporting section 263 that is in the shape of an open rectangle (it is more precisely an open right parallelepiped having parallel sides 265 and 267 which are connected by a crosspiece 269). Crosspiece 269 is engageable with the top of a door (a room door or a cabinet door, for example) or a vertical wall, and parallel sides 265 and 267 extend downwardly for being disposed on opposite sides of the door or wall. The interior surfaces 270 and 271 of vertical sides 265, 267 are disposed adjacent to the door or wall when crosspiece 269 engages the top of the door or wall. Hanging device 261 further includes as a utilitarian member a holding section 273 which is connected to a hanging section 274. Holding section 273 comprises a connecting support or stem 275, which is a metal rod, oval in cross section, and has wide surfaces 277 and narrow surfaces 279, as shown in FIG. 14A. Hanging section 274 includes a C-shaped device or double hook 281 which is attached to the wide surface 277 of stem 275 by such means as welding. Double hook 281 has an upper arm 283 and a J-shaped lower arm 285, both of which are able to support clothing or the like hung therefrom. Double hook 281 is made from a rod which is oval in cross section, as shown in FIG. 14B, is larger than stem 275, and has wide surfaces 289 and narrow surfaces 291.

Hanging device 261 is easy to use. One merely places holding support 263 on the top of a door or vertical wall, and towels, clothing or the like are hung on one or both of elements 283 and 285 of double hook 281. This device is stable in use, attractive in appearance, and is intended not to wrinkle or crease items thereon. It has a sleek and modern look.

Figure 15:
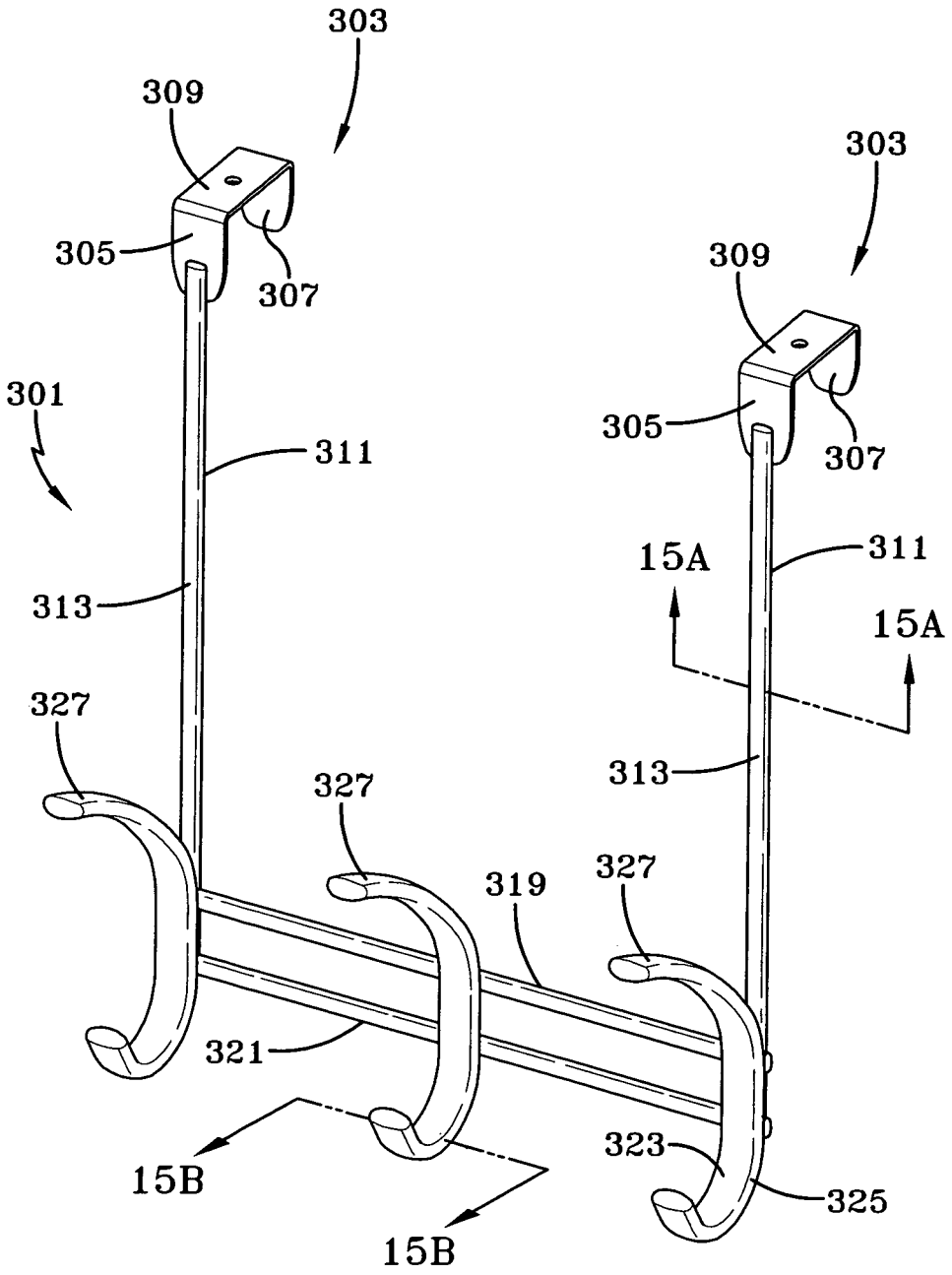
FIG. 15 is a perspective view of an over-the-door, multiple hook device, or over-the-door rack according to the invention.
Figure 15A:
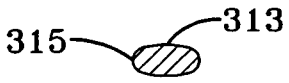
FIGS. 15A and 15B show cross sections taken in the directions 15A-15A and 15B-15B.
Figure 15B:
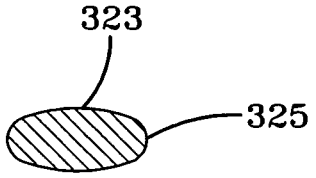

A similar device to that of FIG. 14 is shown in FIG. 15. FIG. 15 shows an over-the-door hanging device or rack 301 having connecting supports 303, as stabilizing members, each having parallel sides 305 and 307 which are connected by a crosspiece 309. The respective connecting supports 303 are parallel to each other, and their respective parallel sides 305 and 307 and the crosspieces 309 are coplanar. Connecting supports 303 function in the same way as connecting support 263 in FIG. 14. Extending downwardly from each of sides 305 is a holding section forming part of the utilitarian member, comprising parallel connecting supports composed of a pair of straight stems 311 which extend downwardly opposite to that of crosspieces 309. Stems 311 are attached to parallel sides 305 by an appropriate means such as a weld. Stems 311 are oval in cross section and have wide surfaces 313 and narrow surfaces 315 as discussed earlier, and are shown in FIG. 15A. At least one first section or cross section 319, and preferably two cross sections 319 and 321, are attached, such as by welding, to the front of stems 313. Stems 311 are made from metal rods having oval cross sections with wide faces 313 and narrow faces 315 as shown in FIG. 15A, and cross sections 319, 321 have the same characteristics. Wide surfaces 323 facing cross sections 319 and 321 are connected to the latter such as by welding, just as cross sections 319 and 321 are connected to stems 311. Hanging device 301 has at least two C-shaped devices or double hooks 327 which can be identical to double hooks 281 in FIG. 14, and reference is made to the latter for a description of device 281. Double hooks 327 have an oval cross section as shown in FIG. 15B with wide surfaces 323 and narrow surfaces 325. Utilitarian member includes stems 311, cross sections 319, 321 and double hooks 327. The features and operation of the over-the-door rack 301 is essentially the same as rack 261 in FIG. 14.

Figure 16:
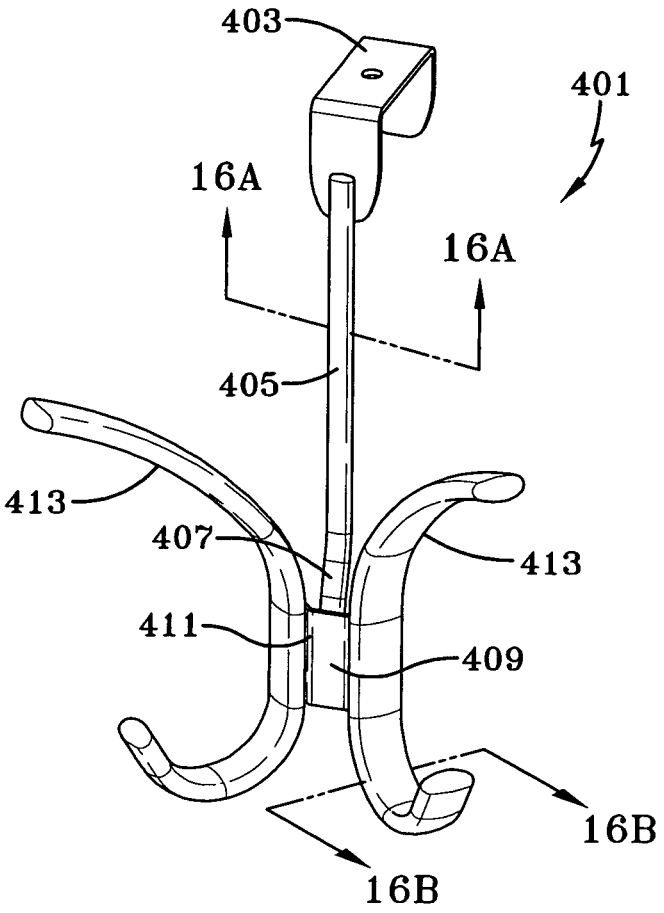
FIG. 16 is a perspective view of an over-the-door/vertical wall hanging device having two angular hooks thereon or over-the-door quad hook according to the invention, and cross sections of parts thereof taken in the directions 16A-16A and 16B-16B are shown in FIGS. 16A and 16B.
Figure 16A:
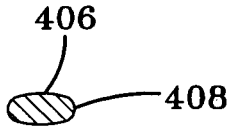
Figure 16B:
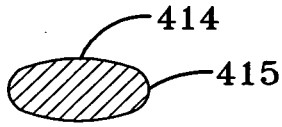

Still another over-the-door/vertical wall hanging device is shown in FIG. 16 in the form of an over-the-door double-hook device or quad hook 401. Quad hook 401 has a supporting section 403 as a stabilizing member which is similar to supporting section 263 shown in FIG. 14, reference to which is made for a discussion of supporting device 403. Quad hook 401 has a downwardly extending stem 405 which is attached the longest of the parallel sides of supporting section 403, such attachment preferably being done by welding. Stem 405 has an oval-shaped cross section shown in FIG. 16A, with wide surfaces 406 and narrow surfaces 408. Stem 405 has a slightly bent-out portion 407 for providing some clearance between the door or wall on which device 401 has been hung. A support member 409 is attached by an appropriate welding means to the lower portion of stem 405, and member 409 is bent on both of its lateral sides as shown by numeral 411. A pair of C-shaped devices or double hooks 413 are likewise attached to support member 409, again by an appropriate welding means or the like. Double hooks 413 are similar to double hooks 281 and 327 shown in FIGS. 14 and 15, respectively. Double hooks 413 are oval in cross section having wide surfaces 414 and narrow surfaces 415 as illustrated in FIG. 16B. The utilitarian member includes stem 405, and double hooks 413. Reference is made to the description of devices 281 and 327 through the previous descriptions thereof.

Double hooks 413 can be disposed at nearly any angle, normally between an angle less than 180° from each other up until the point that the proximate sides of double hooks 413 contact each other.

Stem 405 is similar to stems 275 and 311 in FIGS. 14 and 15, respectively, and reference is made to the description of stems 275 and 311 for an understanding of stem 405. Likewise, double hooks 413 are like double hooks 281 and 327 shown and discussed with reference to FIGS. 14 and 15. Reference is made to the drawing and description of double hooks 281 and 327 for an understanding of double hooks 413. Quad hook 401 has a sleek and modern appearance.

Figure 17:
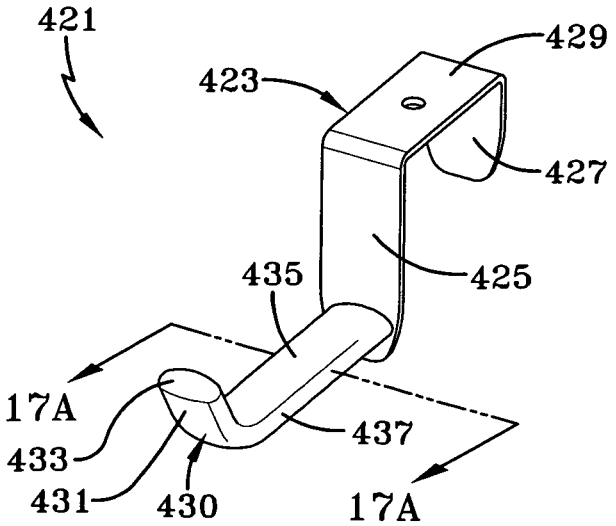
FIG. 17 is a perspective view of an over-the-cabinet hook device according to the invention.
Figure 17A:
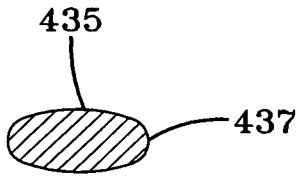
FIG. 17A is a cross section of the hook portion of the device taken in the direction 17A-17A.

Sometimes an over-the-counter device can be very helpful where the device is hung, for example, on top of a cabinet door in a kitchen or bathroom. FIG. 17 shows an over-the-cabinet device 421 having a supporting section 423 as a stabilizing member similar to connecting supports 263 in FIG. 14 and connecting supports 303 in FIG. 15. Supporting section 421 has parallel sides 425, 427 connected by a crosspiece 429 for engaging the top of the cabinet door. The interior surfaces of the sides 425 and 427 are disposed on opposite sides of the door for engaging those opposite sides. The utilitarian member is a holding section in the form of a cantilever 430 extends outwardly from the lower part of side 425. Cantilever 430 has an upwardly turned portion 431 with a free end 433. Cantilever 430 is made from a metal rod which is oval in cross section, having vertically disposed wide surfaces 435 and narrow surfaces 437 as depicted in FIG. 17A. The upper wide surface 435 is engageable by textiles or other articles hung from cantilever 429 and tends not to put much pressure on items hung thereon or to impart any creases or folds thereto. Hanging device 421 is attractive in appearance with a sleek, modern look, and stable and functional in use.

Figure 18:
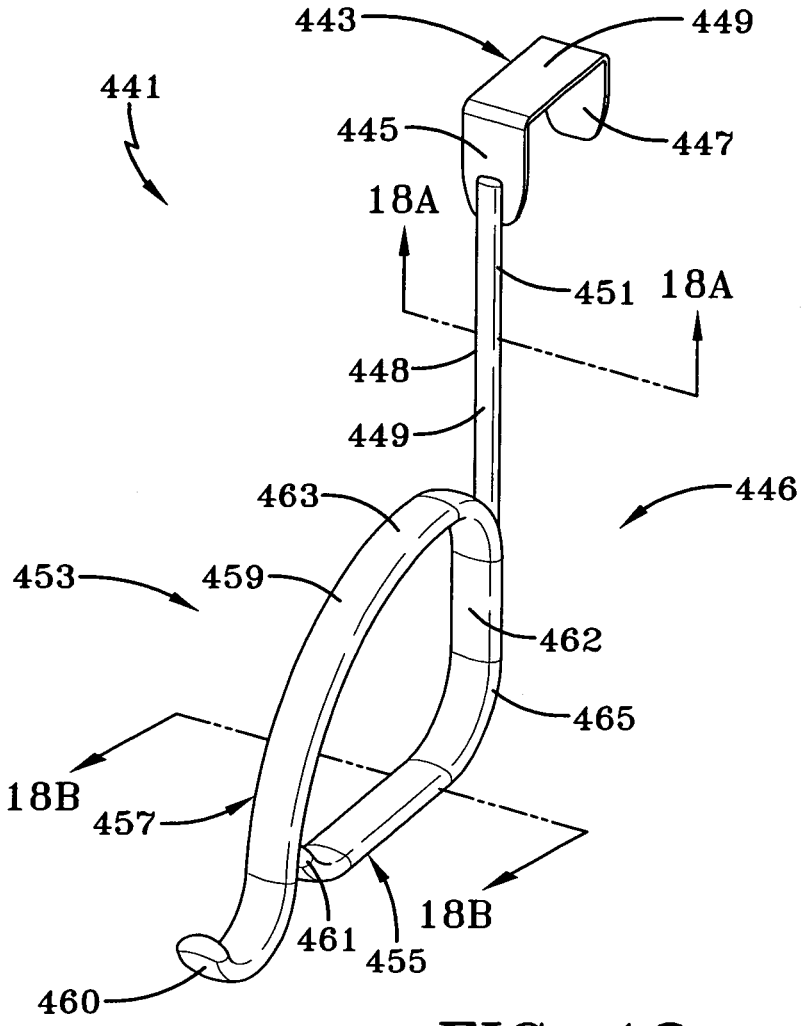
FIG. 18 is a perspective view of another over-the-door or over-the-cabinet hook device or valet according to the invention showing another type of hook portion, and two parts of its cross section taken in the directions 18A-18A and 18B-18B are shown in FIGS. 18A and 18B.
Figure 18A:
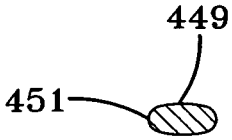
Figure 18B:
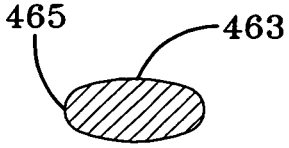

A still further embodiment of the invention is illustrated in FIG. 18. This figure shows an over-the-door hanging device or valet 441 having a supporting section 443 as a stabilizing member comprising parallel sides 445 and 447 which are connected by crosspiece 449. Supporting section 443 operates as do the other such sections shaped as open rectangles, and reference is made to the description of connecting supports 263, 303 and 403 for a discussion thereof. Attached to side 445 is a utilitarian member in the form of a holding section 446 composed of a stem 448 made of a rod, oval in cross section, having wide surfaces 449 and narrow surfaces 451 shown in FIG. 18A (and similar in structure to stems 275 and 311 discussed previously, to which reference is made), and a double-hook 453. Double-hook 453 includes a first hook-shaped portion 455 and a second hook-shaped portion 457. Hook-shaped portions 455 and 457 are essentially twisted from each other, wherein hook-shaped portion 457 has an inclined bent over portion 459 which places a hook-shaped structure 460 on the right side hook-shaped structure 461 as shown. Hook-shaped structure 460 is generally parallel to a hook-like structure 461 such that articles can be hung from each of hook-shaped portions 455, 457 in a generally side-by-side fashion. Hook-shaped portions 455 and 457 are connected by a vertical connecting section 462. Double-hook 453 has wide surfaces 463 and narrow surfaces 465 as shown in FIG. 18B. Wide surface 463 of double-hook 453 engages wide surface 449 of connecting support or stem 448 and is welded thereto. Hanging device 441 is sturdy in both function and appearance, and has aesthetic value over similar devices made from cylindrical metal parts rather than rods with an oval cross section. Device 441 has a sleek and modern look.

Figures 19A, 19B, 19C, 19D, 19E:
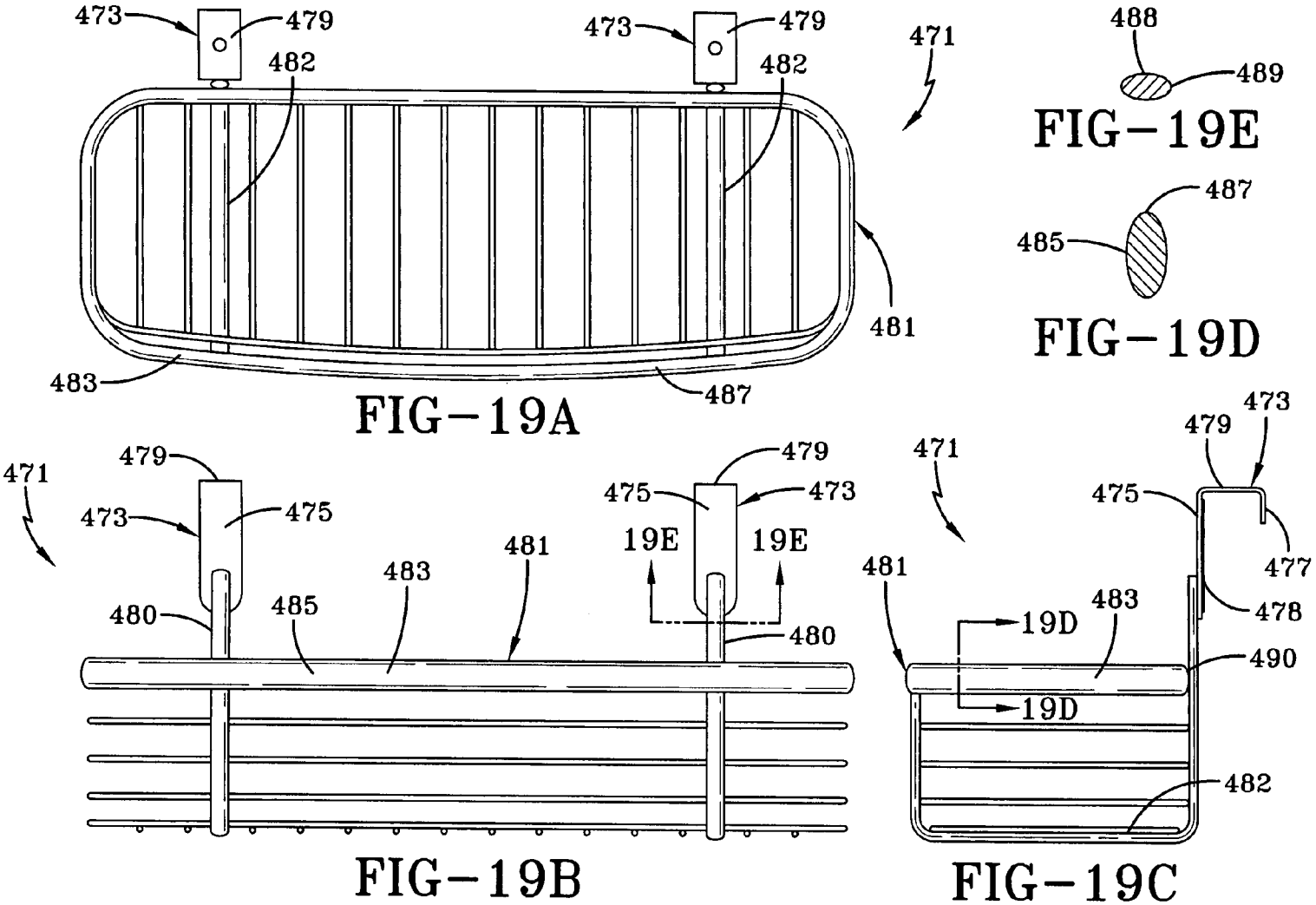
FIGS. 19A, 19B and 19C are the top, front and side views of an over-the-cabinet basket assembly according to the invention, and cross sections of the rim and stem thereof taken in the directions 19A-19A, 19B-19B and 19C-19C are shown in FIGS. 19D and 19E.

An over-the-cabinet basket assembly 471 is shown in FIGS. 19A, 19B and 19C. Basket assembly 471 has supporting sections 473 as a stabilizing member, which are similar to the supporting section 263, 303, 403, 423 and 443 discussed earlier. Supporting sections 473 each include parallel sides 475 and 477 with a crosspiece 479 interconnecting sides 475 and 477. Supporting sections 473 is slipped over the top of a cabinet door with sides 475 and 477 facing the opposite sides of the door, and crosspiece 473 engaging the top of the door. The interior surfaces of each of sides 475 and 477, and crosspiece 479 are adjacent to the door. Side 475 has a protective pad 478. Over-the-cabinet basket assembly 471 further includes a holding section in the form of a basket 481 as a utilitarian member. Basket 481 has a rim 483 which is composed of a rod with an oval cross section, having a wide surface 485 and a narrow surface 487, as shown in FIG. 19D. Referring to FIG. 19E, each of a pair of stems 480 is a smaller oval-shaped rod having wide surfaces 488 and narrow surfaces 489. Basket 481 has a rear wall 490 which is attached to stems 482 by appropriate means, such as welding. Wide surfaces 485 of basket 481 extend in a generally vertical direction with the vertical axes being vertically oriented.

The remainder of the basket is made from conventional rods which are circular in cross section and normally welded in place. Over-the-cabinet basket assembly 471 is strong, sturdy and attractive, with a sleek and modern appearance.

Figures 20, 20A:
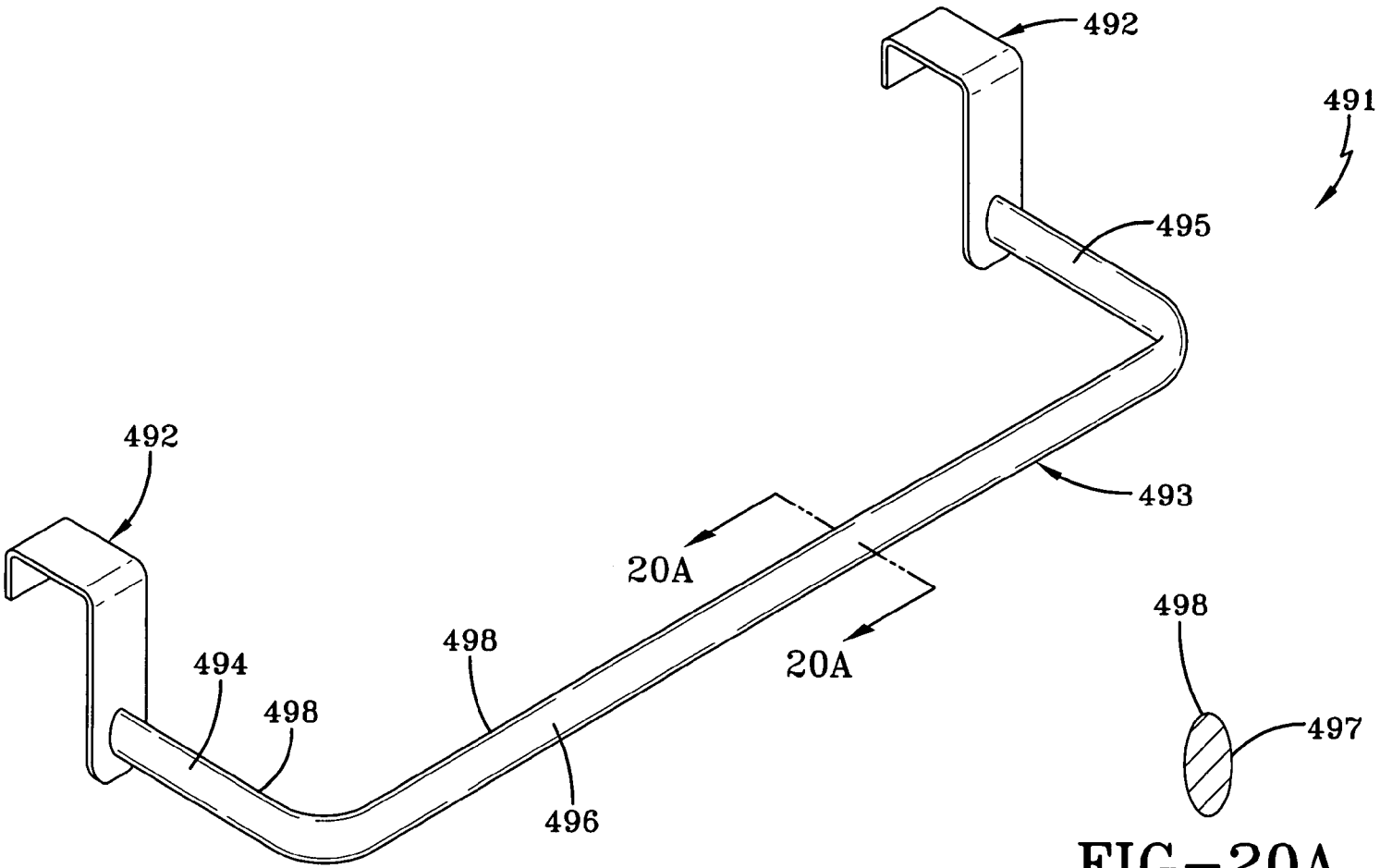
FIG. 20 is a perspective view of an over-the-counter towel holder or bar assembly according to the invention.
FIG. 20A is a cross section of the towel bar portion of the towel bar assembly taken in the direction 20A-20A.

Another embodiment of the invention is shown in FIG. 20. An over-the-counter towel bar assembly 491 is shown having stabilizing members as connecting supports 492 similar to the other connecting supports 263, 303, 423, 443 and 473 discussed above, and reference is made to the discussions of those parts for a description of supports 492. A towel bar 493 is the utilitarian member, and is connected to connecting supports 492. Towel bar 493 includes a pair of arms 494, 495 extending from supports 492, and a transverse member 496 for holding towels extends between arms 495, 496. Towel bar 493 and arms 495, 496, are made from a metal rod, oval in cross section as shown in FIG. 20A, having wide surfaces 497 in the generally vertical position and narrow surfaces 498 facing upwards and downwards to enable faster drying of towels held on rack 493. This is shown in FIG. 20A. Towel holder 491 is attractive in appearance, is very resistant to buckling or bending from vertical loads, and is easy to use and polish.

Figures 21A, 21B, 21C:
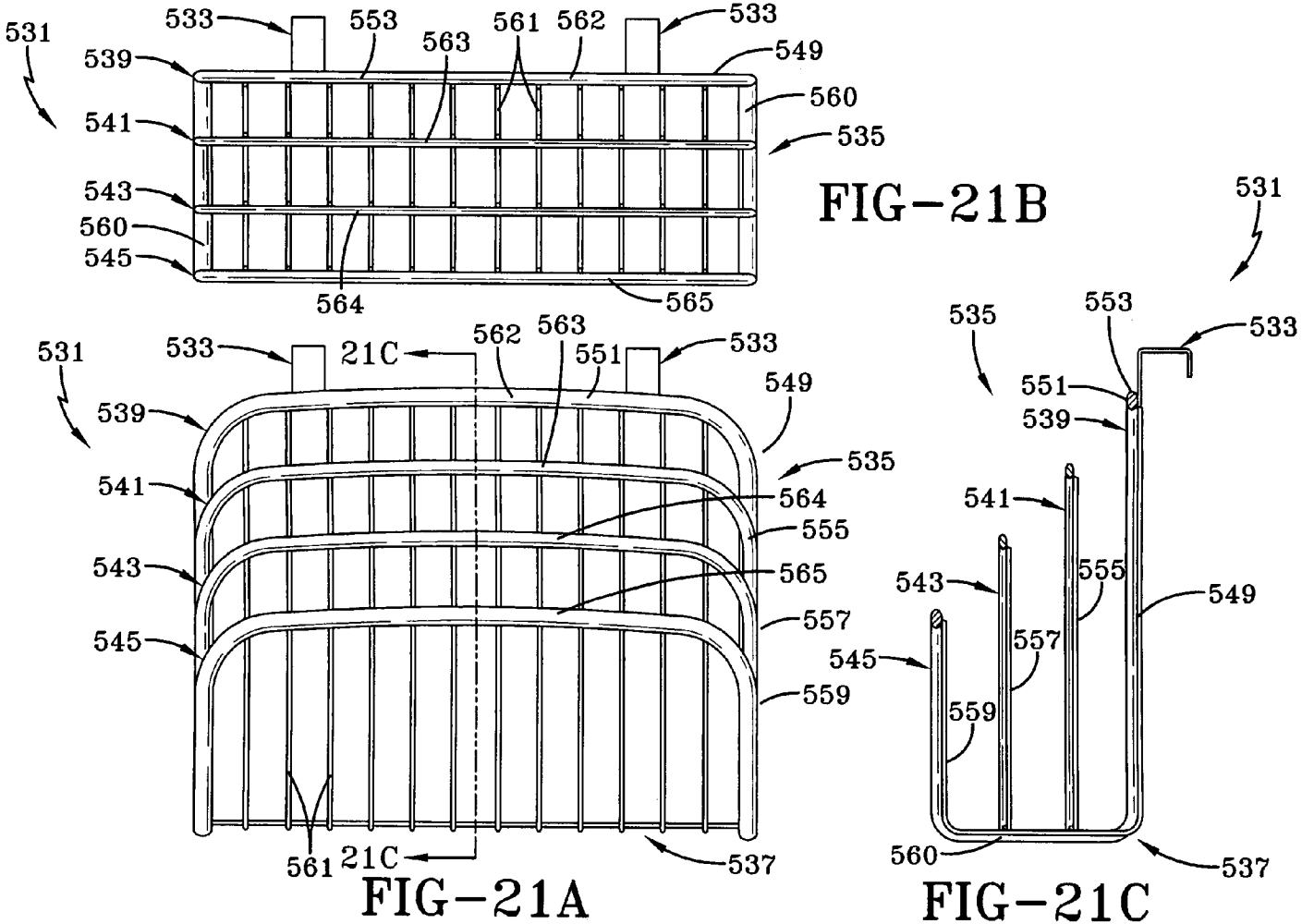
FIGS. 21A, 21B and 21C are top, front and side views of a basket according to the invention.

An over-the-counter mail center 531 is shown in FIGS. 21A, 21B and 21C. Mail center 531 is used to store sorted mail for subsequent review. Mail center 531 has a pair of connecting supports 533 as stabilizing members of the same type as connecting supports 263, 303, 403, 423, 443, 473 and 492, and reference is made to the description of the latter connecting support sections with respect to the description of supports 533. The following components are the utilitarian member. A rack 535 is attached to the respective forward faces of connecting supports 533, such as by welding. Rack 535 has a bottom 537, a pair of first side and base walls 539, a pair of second sidewalls 541, a pair of third side walls 543, and a pair of fourth side and base walls 545, the respective walls 539 and 545 being integrally connected by a base wall 560. There could be any number of additional sidewalls, or two fewer side walls. Each of walls 539, 541, 543, 545, and 560 is made from a rod with an oval cross section as shown in FIG. 21C. The respective walls 539, 541, 543, and 545 have upper crosspieces 562-565. Crosspieces 562-565 are tilted rearwardly, and having oval cross sections as shown in FIG. 21C. Each cross section has a wide section 551 and a narrow section 553. The uppermost part of each crosspiece 562-565 is a narrow surface 563, and the vertical parts of each wall 539, 541, 543 and 545 have the respective wide surfaces 551 facing forwardly and rearwardly. Base walls 560 each are configured so that wide surfaces 551 face upwardly and downwardly.

First side and base wall 539 has a pair of opposing wall supports 549. Second sidewall 541 has a pair of second wall supports 555 parallel with respective first wall supports 549, but being lower in height, as shown in FIGS. 21A and 21C. Second wall supports 555 are each welded to bottom wall 560. Third sidewall 543 has a pair of opposed third wall supports 557 which are similar to second wall supports 555, but being slightly smaller in height as shown in FIGS. 21A and 21C. Each of third wall supports 557 are welded to the bottom wall 560. Fourth sidewall 545 has a pair of opposed fourth wall supports 559 which are similar to third wall supports 557, but being lower in height than either of the latter sidewalls. Each of fourth wall supports 559 extends upwardly from bottom 537 and is integral with first wall support 549 and bottom wall 560 of bottom 537 as shown (and discussed above). Wall supports 549, 555, 557, 559, and bottom 537 support a respective series of cylindrical wires 561 so that hanging device 531 can support newspapers, magazines and the like in between the respective sidewalls 539, 541, 543 and 545 to which entrance and exit may be had from the top or from either side as shown. Sidewalls 539, 541, 543 and 545 could have end walls to keep items in the rack more securely but this would prevent the sideways entrance and exit paths of the items. Mail center 531 is sleek and modern in appearance.

Figure 22A:
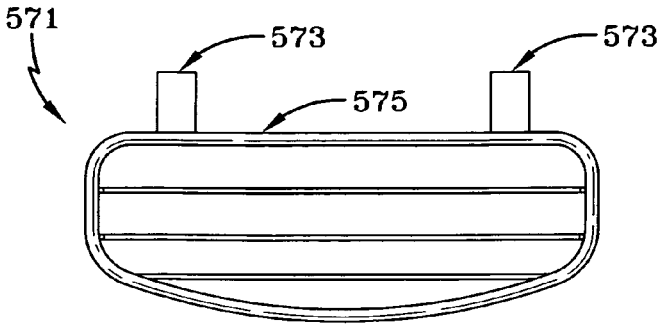
FIGS. 22A, 22B and 22C show top, front and side views of an over-the-cabinet bag holder according to an embodiment of the invention.
Figure 22E:
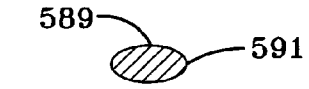
FIGS. 22D and 22E are cross sections of the top rim and the lower rim thereof, taken in the directions 22D-22D and 22E-22E.
Figure 22D:
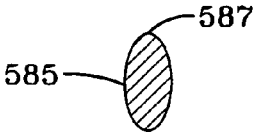
Figure 22B:
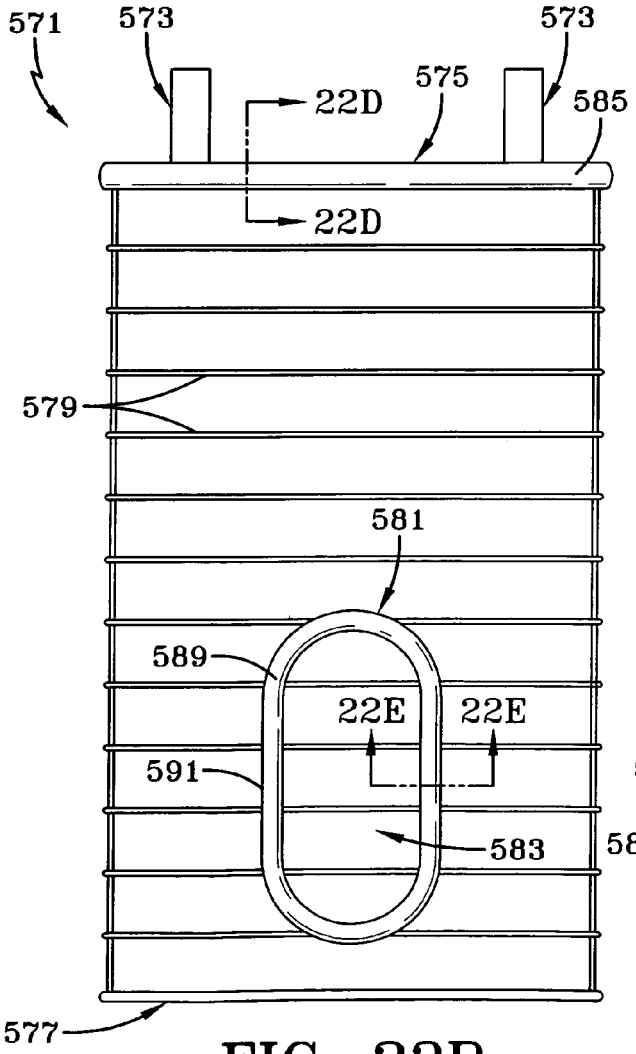
Figure 22C:
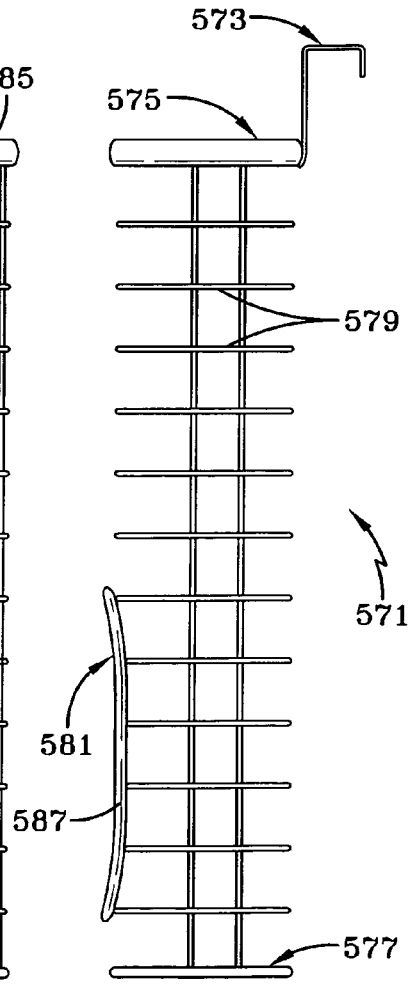

An over-the-cabinet bag holder 571 is shown in FIGS. 22A, 22B and 22C. Bag holder 571 has a pair of connecting supports 573 as stabilizing members, which are similar to the connecting supports 263, 303, etc., discussed above, and reference is made thereto for a description of connecting supports 573.

The following is a discussion of the utilitarian member. Bag holder 571 has an open top surrounded by a rim 575 and a bottom surrounded by a transition device 577. The body of bag holder 571 is constructed of wires 579 which are connected together to form a firm support by means of welding, the vertical wires being attached to rim 575 and transition device 577 by means of welding or the like. Rim 575 is oval in cross section and has wide surfaces 585 and narrow surfaces 587 as shown in FIG. 22D to provide a sturdy entrance into bag holder 571. A lower rim 581 is attached to the wires forming a lower bag withdrawal opening 583 into bag holder 571. Rim 581 is made from a rod having an oval cross section with wide surfaces 589 and narrow surfaces 591, as shown in FIG. 22E. Wide surfaces 589 form the inside and outside of rim 581 to provide a sturdy rim for bag withdrawal opening 583. Lower rim 581 is made of a rod with a smaller oval cross section than rim 575, as shown in FIGS. 22D and 22E.

Rims 575 and 581 are appealing to look at for their sleek and modem appearance, and provide the rugged support needed for bag holder 571. Empty bags are placed in bag holder 571 through the top by inserting them within rim 575 and are removed manually through opening 583 in lower rim 581. Bag holder 571 can be installed on top of a door, such as a cabinet door in a kitchen, or from the top of some appropriate vertical wall. Rims 575 and 581 are easy to polish since the wall surfaces are easily accessible, then reflect much of the light incident on them to an observer, giving them a pleasing appearance.

Figure 23A:
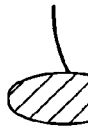
FIGS. 23A, 23B and 23C are sections taken in the directions 23A-23A, 23B-23B and 23C-23C.
Figure 23B:
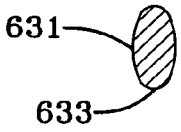
Figure 23C:
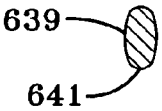
Figure 23:
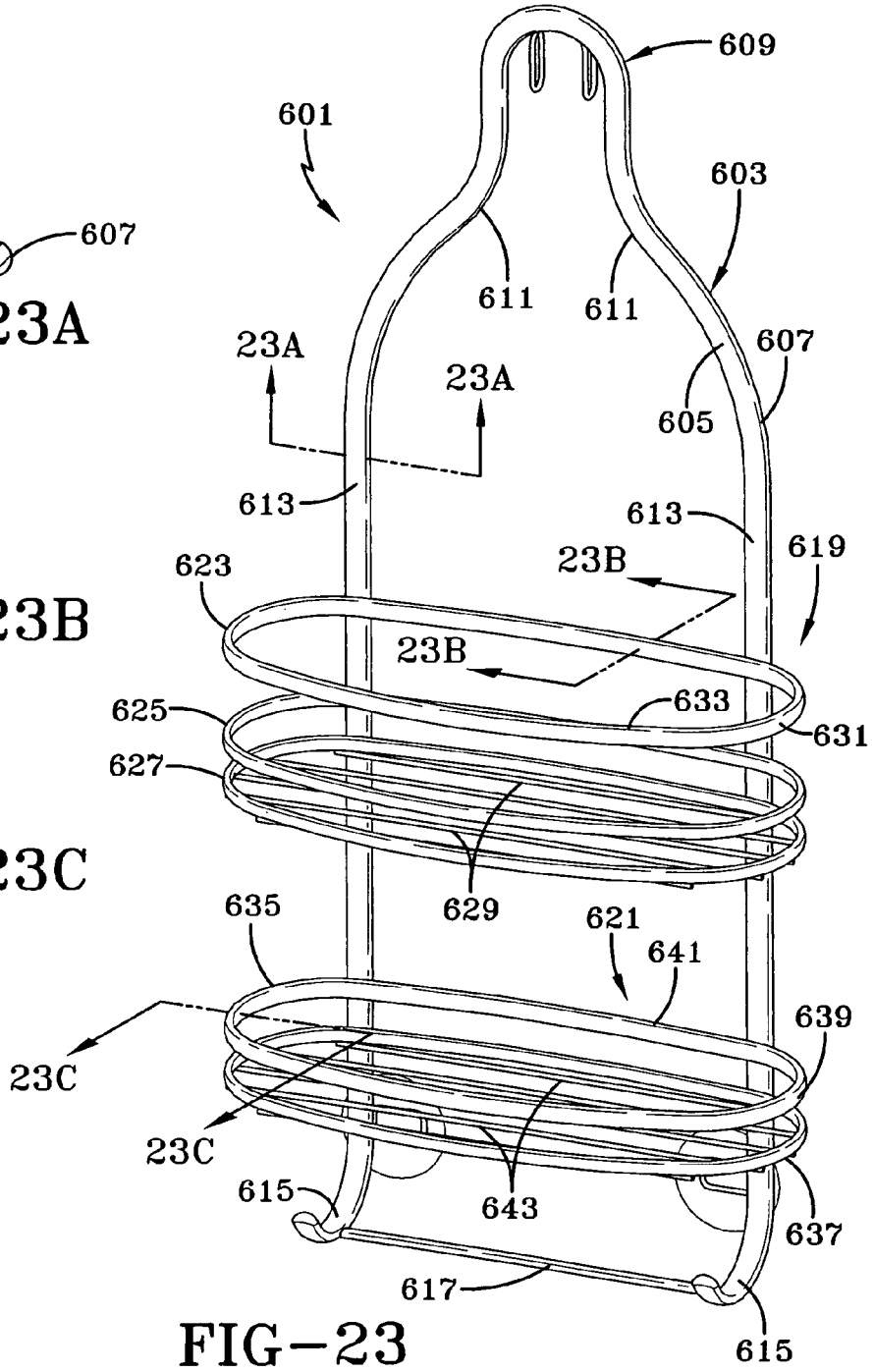
FIG. 23 is a perspective view of a shower caddy according to the invention.

Another hanging device is a shower caddy 601 shown in FIG. 23. Shower caddy 601 has a frame 603 made from a rod with an oval cross section, as shown in FIG. 23A, and has wide spaces 605 which are connected by narrow spaces 607. Wide spaces 605 face generally forwardly and backwardly for supporting the load as shower caddy 601 is hung on a showerhead and rests against a wall when in use. Frame 603 has an upper portion 609 of a relatively small diameter which can be hung on a showerhead so that frame 603 essentially rests against the wall from which the showerhead extends. Upper portion 609 is the stabilizing member, and the remainder of the parts of shower caddy 601 form the utilitarian member. Frame 603 is bent at connecting portions 611 into two parallel legs 613. Legs 613 extend downwardly and are curled or cupped at their lower ends to form a pair of parallel J-shaped hooks 615 which are separated by a transverse member 617 for holding a washcloth, towel or the like. Situated above J-shaped hooks 615 are a pair of baskets 619 and 621. Upper basket 619 is composed of a set of three parallel and overlapping rings 623, 625 and 627, each of which is attached to respective arms 613 by an appropriate means, such as welding, to form the sides of upper basket 619. A set of parallel wires 629 extends across lower ring 627 to which they are attached by an appropriate means, such as welding. Wires 629 can be cylindrical in cross section and form the bottom of upper basket 619 for supporting shampoo bottles, conditioner bottles, soaps, etc. Each of rings 623, 625 and 627 are rods which are oval in cross section, as shown in FIG. 23B. They have wide surfaces 631 and narrow surfaces 633 connecting wide surfaces 631. Wide surfaces 631 face outwardly and inwardly, and are generally vertically oriented, whereas narrow surfaces 633 face upwardly and downwardly. This arrangement provides a greater surface area for bottles and the like held in upper basket 619 to lean against and to form a broader base of support. The separation of wires 629 and rings 623, 625 and 627 provides for easy drainage of water from water emanating from a shower on which shower caddy 601 is being supported.

Lower basket 621 is similar in construction to that of upper basket 619 but is shown as having only two loops 635 and 637 configured similar to loops 623, 625 and 627 and made from a rod having an oval cross section, but with the oval cross section being smaller than that of the basket 619, as shown in FIG. 23C. Loops 635 and 637 have wide surfaces 639 and narrow surfaces 641. Wire rods 643, circular in cross section, extend across the bottom of loop 637 to provide a drainable basket for holding other items to be used in the show, such as soap, small containers and the like. Shower caddy 601 is attractive in appearance for its sleek, modern look, and sturdy in operation. It, like the other articles discussed herein, is preferably made from a metal, such as steel, and preferably is chrome plated both to improve its appearance and prevent corrosion. The various edges are polished clean by any appropriate means in order to render the unit safe in operation.

Figure 24:
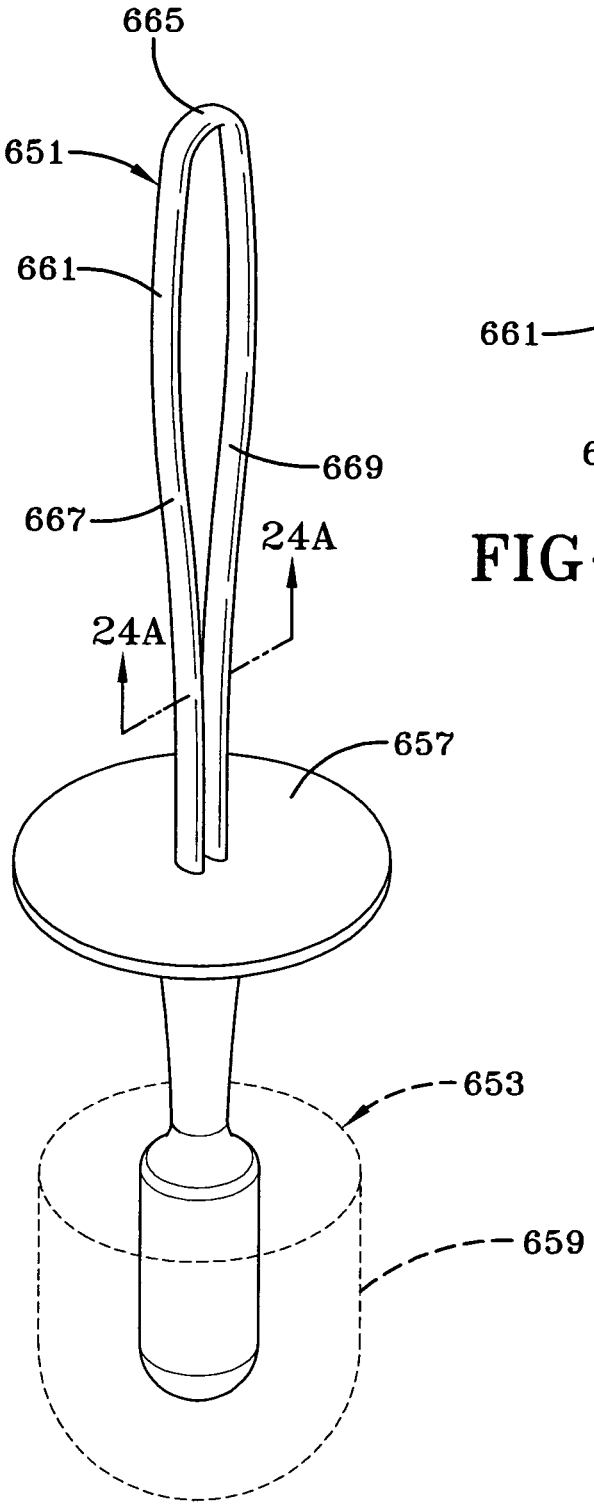
FIG. 24 is a perspective view of a bowl brush according to the invention.
Figure 24A:
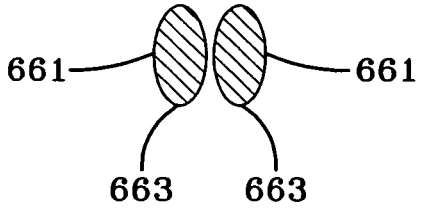
FIG. 24A is a cross section of the handle portion of the brush taken in the direction 24A-24A.

A toilet bowl cleaner brush device 651 is shown in FIG. 24. Bowl cleaner 651 rests in a storage bowl device 653 having a brush container 659. Cleaner brush 651 has a handle 665 with opposing arms 667, 669, each made from a rod oval in cross section, both of which are shown in FIG. 24A, each having wide surfaces 661 and narrow surfaces 663 interconnecting the wide surfaces. When handle 665 is in a straight position, the long axes are parallel as are the short axes. However, when the rod is bent, the long axes remain parallel and the short axes become non-parallel at the bent section. Wide surfaces 661 face outwardly to enable a greater contact by a person's hand when handle 665 is gripped than would be the case if narrow surfaces 663 faced outwardly, and the narrow surfaces then would be more irritating to the person's hand. Although the bent over shape is shown for bowl cleaner brush 651, rods having oval cross sections could be used in many different shapes and varieties for other kinds of tools, depending on the size of the tool, the amount of force to be placed on the handle and the like. The handle could be made in a generally straight form as shown, could be bent or twisted, or could take many other configurations. The foregoing parts, other than storage bowl device 653, are the utilitarian member. Cover 657 engages the top of brush container 659 and is a stabilizing member when in storage. Using the rod with the oval cross section provides an attractive, sleek and modem appearing handle which is rugged in use and easy to grip.

Figure 25A:
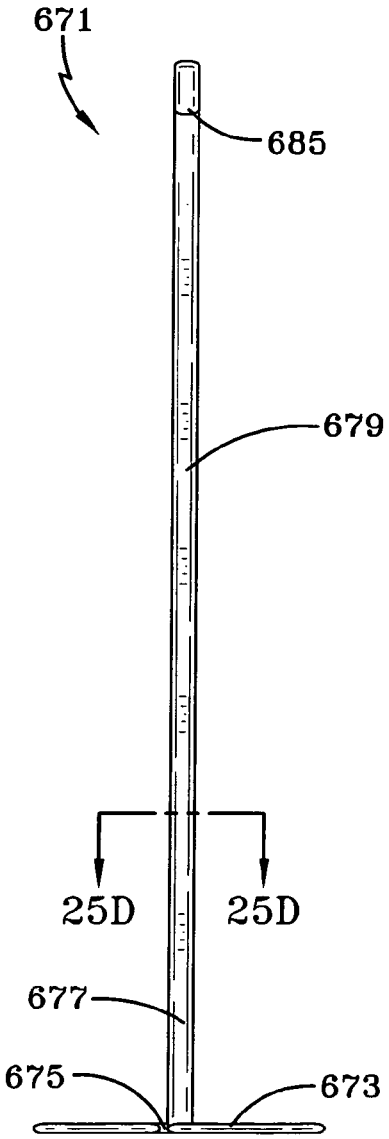
FIGS. 25A, 25B and 25C are front, side and tope views of a toilet paper roll holder or roll stand according to the invention.
Figure 25B:
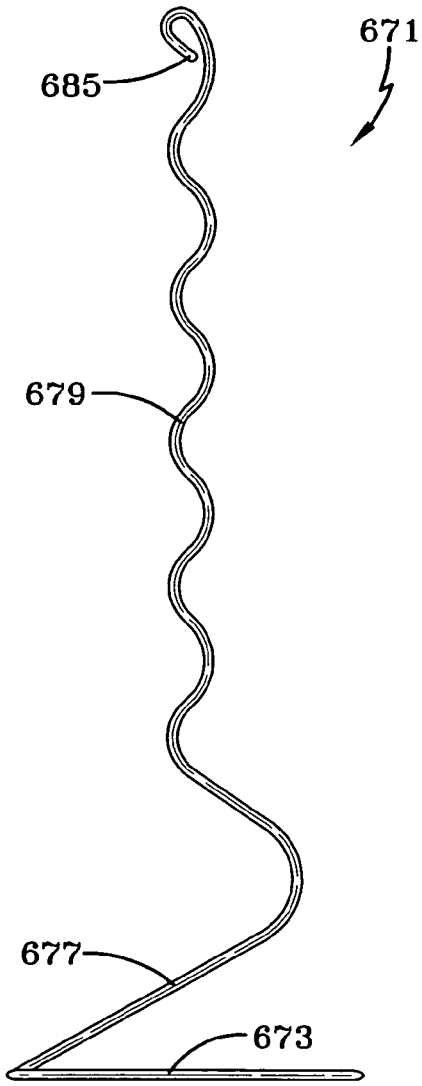
Figure 25D:
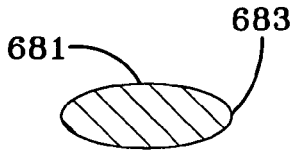
FIG. 25D is taken in the direction 25D-25D.
Figure 25C:
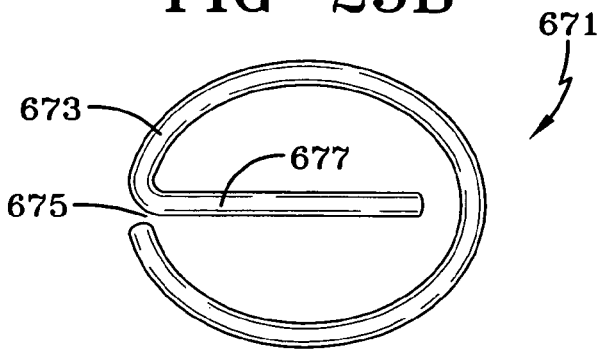

FIGS. 25A-25D show a toilet paper roll holder or reserve 671. Roll reserve 671 is of a one-piece construction comprising a base 673 which is basically in the form of an open circle having an opening 675, and forms the stabilizing member. A connecting portion 677 extends upwardly from base 673 at an angle of about 30° from which extends a generally vertically oriented holding portion 679 which is shaped like a sine wave. Reserve 671 is made from a metal rod which is oval in cross section having wide surfaces 681 and narrow surfaces 683 as shown in FIG. 25D. One uses roll reserve 671 by simply sliding a roll of toilet paper wound about a cardboard tube onto a free end 685 of holding section 679 and allowing the toilet paper roll to drop onto the top of connecting section 677 or on top of another roll or rolls which have already been placed on roll reserve 671. Parts 677, 679 and 685 form the utilitarian member. Reserve 671 is effective in use, and sleek and modern in appearance.

Figure 26A:
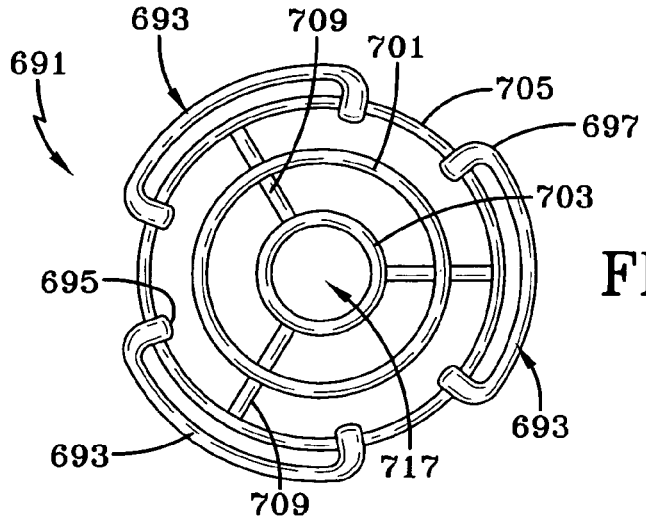
FIGS. 26A and 26B are front and top views of a toilet paper roll reserve according to an embodiment of the invention.
Figure 26B:
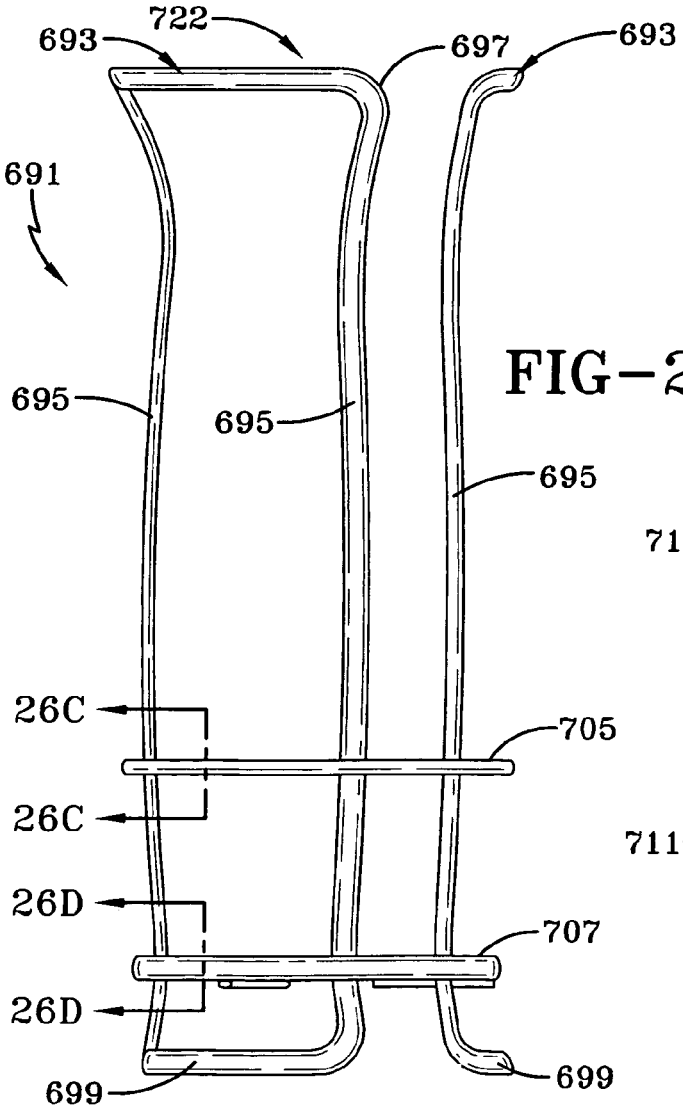
Figure 26C:
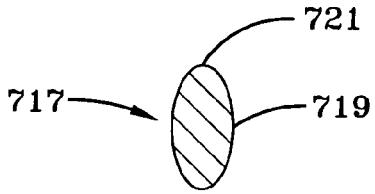
FIGS. 26C and 26D are taken in the directions 26C-26C and 26D-26D.
Figure 26D:
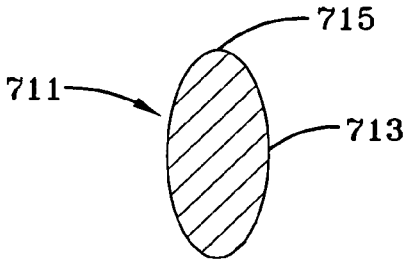

Another toilet paper roll holder or reserve 691 is shown in FIG. 26A-26D. Reserve 691 includes a set of three stands 693, which each comprise a pair of parallel support legs 695 which are made from a common chrome-plated metal rod having a flared out upper portion 697 and a curved foot portion 699 (forming the stabilizing member, the remainder parts being the utilitarian member) connecting each pair of legs 695. Flared out upper portion 697 generally defines a funnel or recess 722 for directing toilet paper rolls into the cylinder defined by legs 695. A base comprises a pair of concentric rings 701 and 703 forming the bottom of reserve 691 upon which toilet paper rolls rest. An upper band 705 wraps around six legs 695, and a lower band 707 also extends around legs 695. Bands 705 and 707 are each welded to the respective legs 695, to add stability and support to roll reserve 691. Base ring 703 has extending from it three equiangularly spaced radial arms 709 which are welded to band 707, and upon which is welded concentric ring 701. Each arm 709 is welded to rings 701 and 703. The entire unit is made from metal rods as described above, which are oval in cross section. One type of rod shown in cross section 711 in FIG. 26D, has a relatively large cross section, having wide surfaces 713 and narrow surfaces 715, and is used for all of the components of roll reserve 691, except for band 707. Band 707 has a cross section 717, oval in shape, and as shown in FIG. 26C, has wide surfaces 719 and narrow surfaces 721. Wide surfaces 713 and 719 face inwardly (and outwardly) so that the area of contact with the respective toilet paper rolls is greater than it would be if the narrow surfaces 715 and 721 faced inwardly. Roll reserve 691 is used by orienting a toilet paper roll stored therein so that its axis is generally parallel with the central axis of rings 701 and 703. Toilet paper rolls are installed by dropping them down recess 722. This is a sleek and modern looking unit.

Figure 27A:
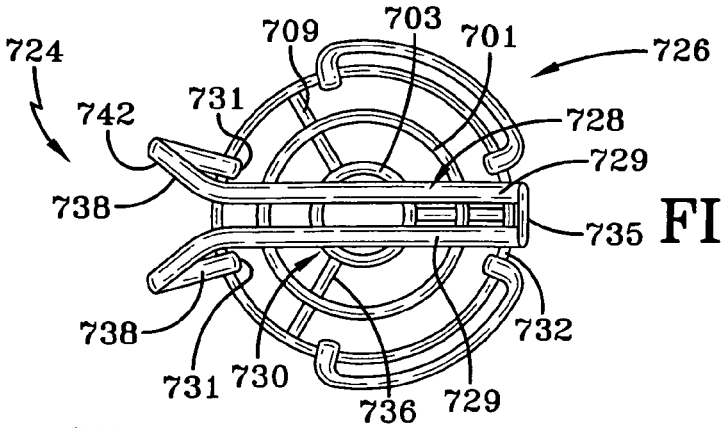
FIGS. 27A and 27B are top and front views of a combination toilet paper roll reserve and roll holder according to the invention.
Figure 27B:
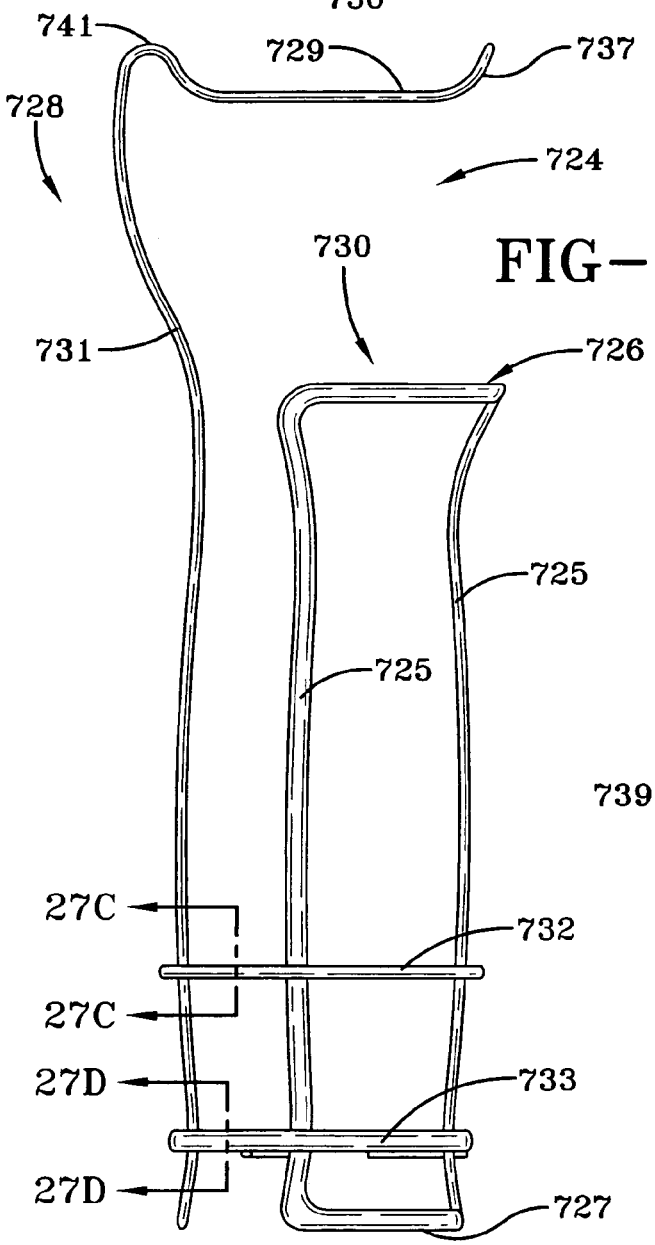
Figure 27C:
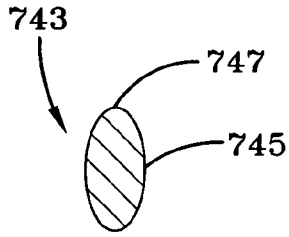
FIGS. 27C and 27D are taken in the directions 27C-27C and 27D-27D.
Figure 27D:
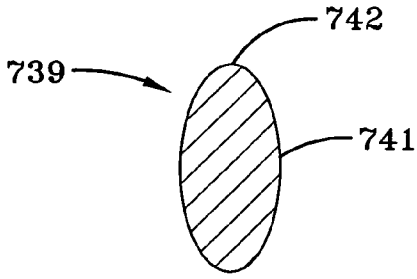

FIGS. 27A-27D show another sleek and modem looking toilet paper roll stand and holder 724. Stand and holder 724 is similar to reserve 691 in that it has a set of legs 725 which are similar to legs 695, forming a pair of stands 726, each being like a stand 693 shown in FIGS. 26A and 26B and described above, and reference is made thereto for an understanding of legs 725 and stands 726. Stands 726 each have ground engaging feet 727 interconnecting legs 723, feet 727 being the stabilizing members. Roll stand and holder 724 further has a toilet paper roll support arm structure 728 formed by a pair of parallel arms 729 which extend generally at a 90° angle over a recess 730 defined both by stands 726 and structure 728, from a pair of vertical roll support legs 731. Roll support legs 731 extend upwardly from a connecting member in the form of an arc connecting the lower ends of legs 731. Roll support legs 731 serve the same function as legs 725. An upper circular band 732 and a lower circular band 733 are wrapped around legs 725 and support legs 731 to which bands 732 and 733 are welded. The pair of horizontal parallel arms 729 are connected at an upper end by crosspiece 735, and form an upwardly turned elbow 737 for retaining a toilet paper roll on arms 729. The opposite ends of arms 729 have diverging portion 738 from which legs 731 extend downwardly. Legs 725 and 731 form a storage unit for toilet paper rolls, and a toilet paper roll in use is threaded onto arms 729 for use. All of the components of holder 724 are composed of chrome-plated steel or other metal formed into a rod having a cross section 739, which is oval in cross section having wide surfaces 741 and narrow surfaces 742 as shown in FIG. 27D, except for band 732 which is made from a rod with a cross section 743 having wide surfaces 745 and narrow surfaces 747, band 732 being smaller in cross section than band 733. Components 701, 703 and 709 have the same construction and function as these parts did in toilet paper roll reserve 691, and reference is made to the early description of reserve 691, and stand and holder 724. All of the parts other than the feet 727 constitute the utilitarian member.

A magazine stand 751 is shown in FIGS. 28A-28D. Magazine stand 751 includes a pair of bent rods 752 forming a pair of generally vertical legs 753 extending down from horizontal crosspieces 755, and from which extend horizontal feet 757, the latter being the stabilizing members (the remaining parts constitute the utilitarian member). A magazine and newspaper-holding basket 759 sits on crosspieces 755 to which it is welded. Magazine 759 has attached to it as discussed below, a pair of upper arms 761 bent at 90° from generally vertical members 763 and extending in opposite directions as horizontal members 765 from curved portions 767. Horizontal members 765 could be either a handle or a newspaper or magazine support, or if used in a bathroom, as toilet paper roll supports. Newspapers or magazines could be draped over each of horizontal members 765.

Basket 759 is composed of a bent rod 768 which is composed of two pairs of generally parallel vertical portions 768 at opposite ends of basket 759, each of which has an outwardly flared portion 769 which are connected by a crosspiece 770 which serves as easy to grip handles. Vertical portions 765 extend downwardly and are curved into horizontal base pieces 772 which are parallel to each other. A rim 773 wraps around the upper end portions of element 761, and is welded to each of vertical portions 765. A set of U-shaped, generally stiff metal wires 777, circular in cross section, are disposed in a parallel, equidistantly-spaced orientation, to form the ends and sides of basket 759. U-shaped wires 771 are welded at their bottom portions to base portions 772 of bent rod 768 and to the opposite ends of rim 773. Legs 752 are welded to the underside of horizontal base pieces 772 to complete the construction of magazine stand 751.

Figure 28A:
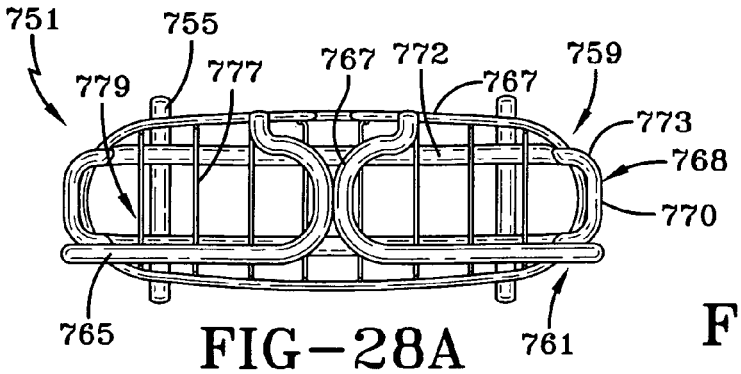
FIGS. 28A, 28B and 28C are top, front and side views of a combination magazine holder or stand and toilet paper roll holder according to an embodiment of the invention.
Figure 28D:
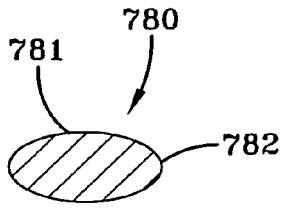
FIG. 28D is taken in the direction 28D-28D.
Figure 28B:
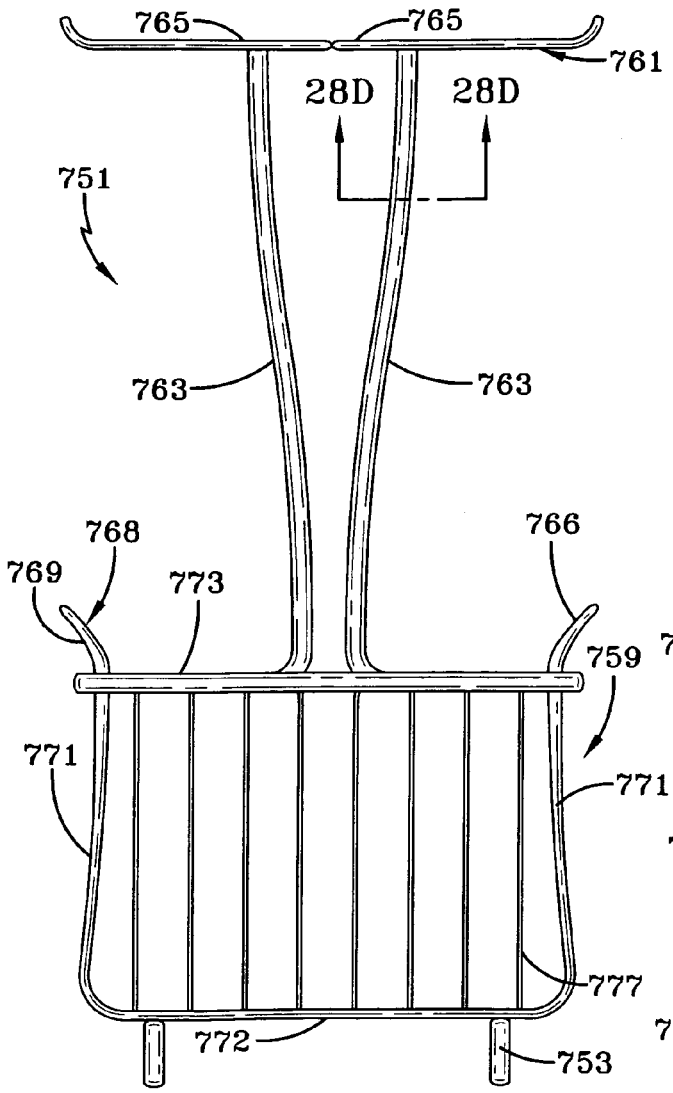
Figure 28C:
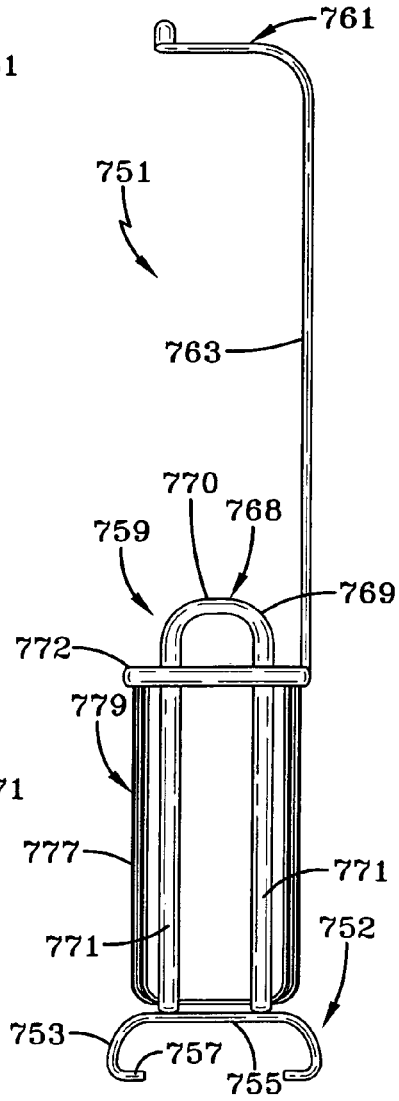

Each of the components of magazine stand 751, other than U-shaped metal wires 777, are made from an oval-shaped rod as discussed above. An oval-shaped rod having a cross section 780 is shown in FIG. 28D, and includes wide surfaces 781 and narrow surfaces 782. As can be seen from FIGS. 28A-28C, wide surfaces 781 generally face inwardly so as to contact the magazine and the like stored in magazine stand 751 and to support whatever is held on horizontal members 765. Crosspiece 770 can be engaged a person's hands who is moving stand 751 to distribute the pressure more evenly over crosspiece 770 to make handling magazine stand 751 easier than if narrow surfaces 782 were engaged by a person's hands. Magazine stand 751 is attractive to look at, being sleek and modern in appearance, easy to use and economical to manufacture.

Figure 29D:
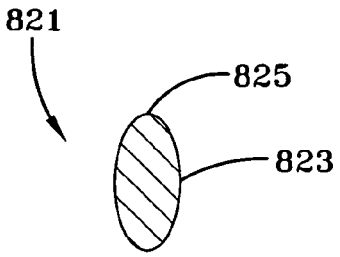
FIG. 29D is taken in the direction 29D-29D.
Figure 29A:
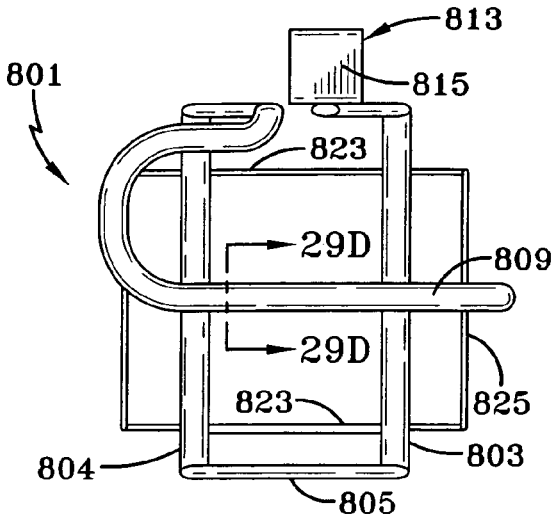
FIGS. 29A, 29B and 29C are top, front and side views of a combination toilet paper roll reserve and toilet paper roll holder according to the invention.
Figure 29B:
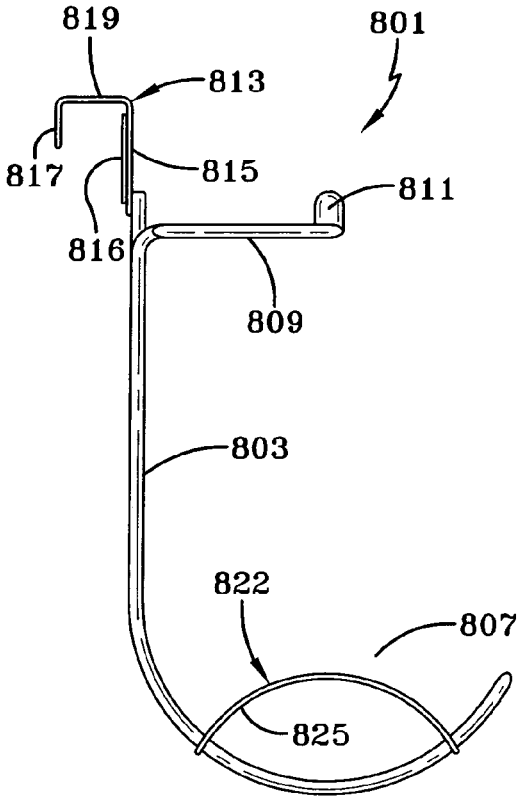
Figure 29C:
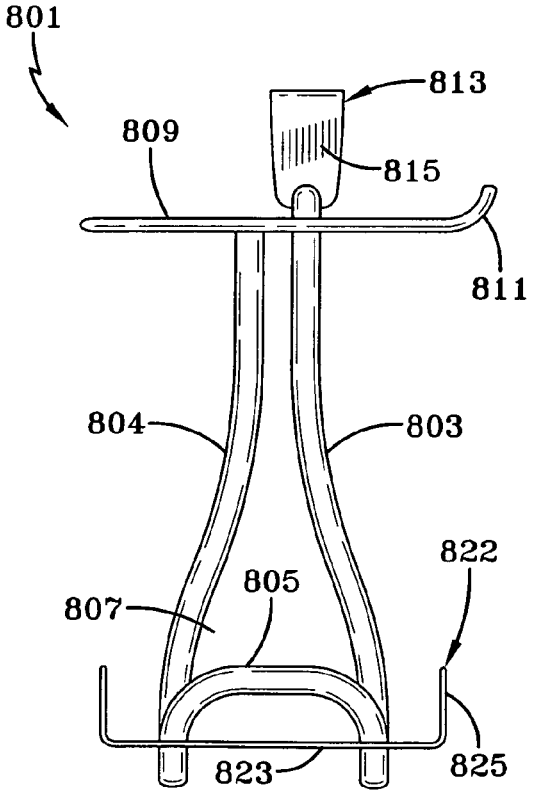

An over-the-tank toilet tissue roll holder and reserve 801 is shown in FIGS. 29A-29C. Tissue holder 801 has a metal rod bent to form a pair of parallel, J-shaped arms 803 which extend vertically as shown, and which are connected by a crossover curved portion 805 to form a toilet roll reserve portion 807. The upper part of arm 804 is bent to form a horizontal member 809 having an upturned end portion 811. A toilet paper roll could be slid onto member 809 for use, and one or more toilet paper rolls could be placed in reserve 807 for storage.

Toilet tissue roll holder and reserve 801 has welded to it a supporting section 813 which, like supporting the sections 263, 303, 443, 473, 492, 533 and 573, has three sections and is the stabilizing member. Thus, supporting section 813 includes a proximal side 815 and a parallel, distal side 817 and a crosspiece 819 interconnecting sides 815 and 817. A protective pad 816 can be on the back of side 815. The rod forming each of elements 803-805, 809 and 811 (which, with the support discussed below, form the utilitarian member) are made from an oval-shaped rod 821 having wide surfaces 823 and narrow surfaces 825, as illustrated in FIG. 29D. The oval-shaped rod is incorporated in toilet paper roll holder 801 so that wide surfaces 823 face toilet paper roll(s) installed in holder 801 for contacting any toilet paper rolls.

Toilet tissue roll holder and reserve 801 is installed on a toilet tank, with parallel sides 815 and 817 disposed on opposite sides of the top of the tank, and the top of the tank engaging the inside of crosspiece 819. A longitudinal support 822 comprised of a closed piece made of cylindrical wire is provided to prevent the longitudinal movement of toilet paper rolls stored in compartment 807. Support 822 comprises straight, opposing parallel sides 823 which are bent at their longitudinal end portions to form partially circular end pieces 825 which are curved to prevent the sliding motion of toilet paper rolls supported between opposing crosspieces 825. Toilet tissue roll holder and reserve is effective in use, and sleek and modem in appearance.

A wall mounted tissue/magazine holder 841 shown in FIGS. 30A-30C. Holder 841 include a basket 843 which is very much like basket 759 shown in FIGS. 28A-28C, and is the utilitarian member. Basket 843 thus includes a bent rod 845, similar to bent rod 768, which has upstanding parallel end portions 846 which are joined together by parallel crossover members 847 at their upper ends, and parallel base members 849. Thus in basket 843, the lower parts of vertical portions 846 are bent slightly outwardly as shown at the bend in rods 845 at 851. Basket 843 further includes a rim 853, much like rim 773 which wraps around the upper portions of vertical members 846 to which it is welded. A set of U-shaped cylindrical wires 855, like wires 777, are arranged in a parallel, equidistant relationship, being welded to base members 849 and rim 853 to complete basket 843. The upper portions of vertical members 846 are flared out at portions 857, which define handles by which basket 843 can be lifted. Basket 843 can be a complete unit and function as such, without the additional items discussed below.

Basket 843 could have mounting plates 859 attached, such as by welding, to one or more parallel, vertical parts of wires 855. Mounting plates 859 have holes 861 through which screws, nails or the like could be inserted for attaching basket 843 to a wall, door or other vertical structure, and form the stabilizing member. Mounting plates 859 could be dispensed with and replaced with some other mounting device, which could include some sort of adhesive, hook, etc.

Tissue/magazine holder 841 further includes a toilet tissue roll holder 862 extending from its base. Roll holder 862 comprises a bent rod having an upper horizontal portion 864 attached, such as by welding, to the pair of base members 849 of basket 843, a bent down portion 863 of slightly more than 90° (as shown, it is about 102°), and a bent out horizontal portion 865. Another rod serving as a roll support 867 has a bent central portion 869 which is welded or otherwise attached to portion 865. Rod 867 has opposing flared-up ends 871. Roll support 867 can support tissue rolls or any other type of rolls which would be appropriate for where tissue/magazine holder 841 is located.

Tissue/magazine holder 841 has two relatively large oval-shaped rods with cross sections 873 and a relatively smaller oval-shaped rod with cross section 875, as shown respectively in FIGS. 301D and 30E. Rod cross section 873 is used in rim 853 and roll holder 862. Cross section 873 has wide surfaces 876 and narrow surfaces 877, and it can be seen that wide surfaces 876 are generally directed to engage the magazines or rolls in which the rod contacts them. Narrow rod cross section 875 is used for bent rod 845, and has wide surfaces 878 and narrow surfaces 879. The wide surfaces are oriented so that they engage magazines which may be resting upon them.

Magazine rack 841 is most likely to be used in a bathroom where it would be attached to a wall or cabinet, but could be used in a kitchen or elsewhere in a facility where attachments to a vertical surface are helpful. It is sleek and modern in appearance.

It should be noted that various combinations of different parts of the embodiments described herein could be used with other embodiments. For example, with respect to tissue/magazine holder 841, roll holder 862 as shown in FIGS. 30A-30C could be replaced with toilet holder 801, although horizontal member 809 and supporting section 813 would be eliminated, and U-shaped arms 803 and 804 may have to be modified, replaced with one or more rods with oval cross sections to be suspended from the magazine holder, and rod 821 could be retained, modified, or omitted.

Figures 31A, 31B, 31C, 31D:
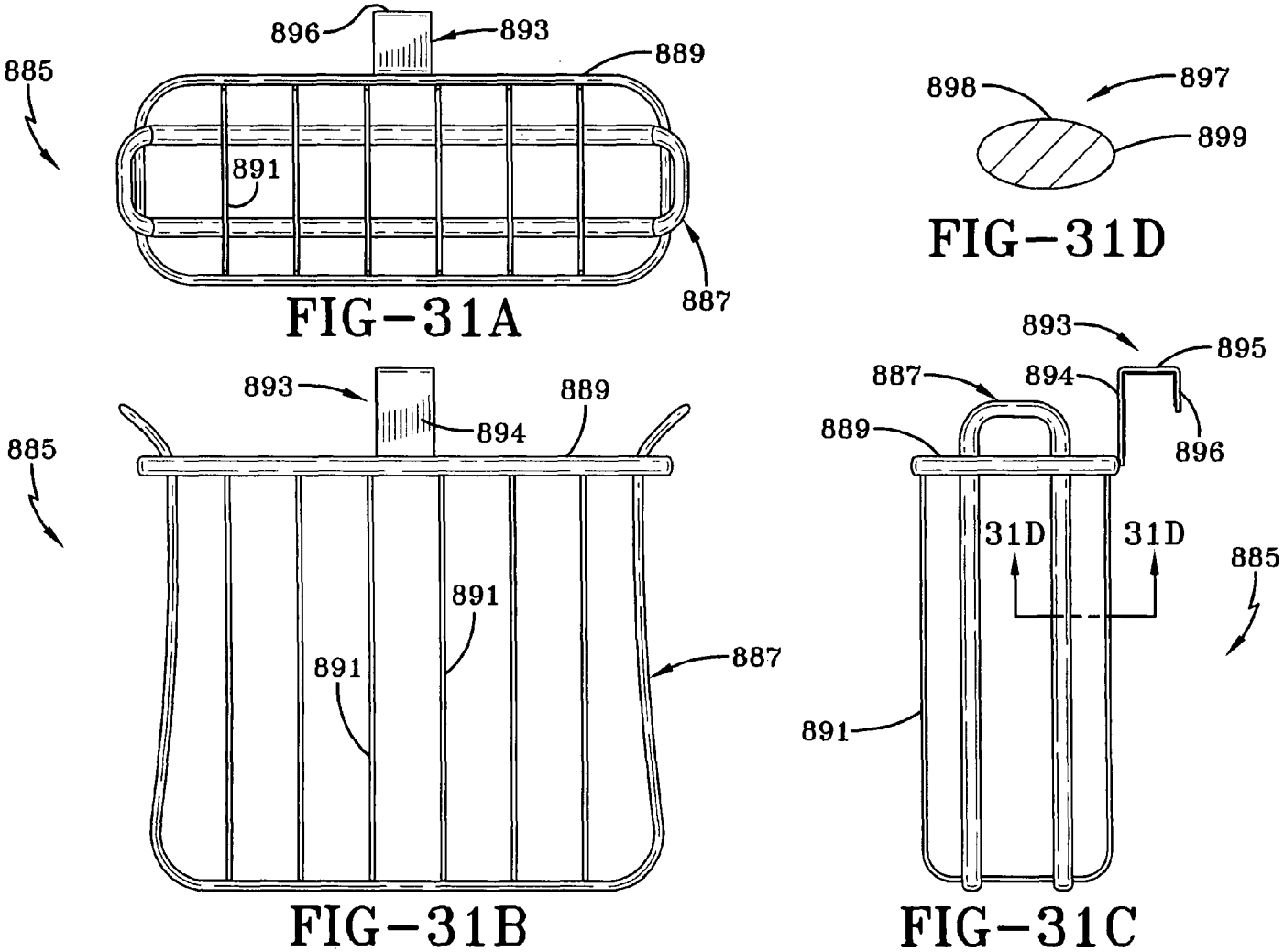
FIGS. 31A, 31B and 31C are top, front and side views of an over-the-tank magazine rack according to the invention.
FIG. 31D is taken in the direction 31D-31D.

An over-the-tank magazine rack or holder 885 similar to that shown in FIG. 30A-30C is shown in FIG. 31A-31C. Magazine rack 885 has a bent rod 887, which is similar in construction and intended use as bent rod 845, and reference is made to the description of FIGS. 30A-30C for a description of bent rod 887. Likewise, magazine rack 885 has a rim 889, similar in structure and function to rim 853 shown in the preceding group of figures, and reference is made to the description of rim 853 for a description of rim 889. A set of parallel, generally U-shaped, cylindrical bent wires 891 are welded or otherwise attached to the base portion of bent rod 887 to the top surface thereof, and to rim 889, in the same manner that bent wires 855 were attached to base portion 849 and rim 853 in FIGS. 30A-30C. For a description of bent wires 891 and the function for holding magazines by magazine rack 885, reference is made to the description of magazine holder 841 of the preceding group of figures. Magazine holder 885 replaces wall mounting plates 859 with an over-the-tank bracket 893, the stabilizing member (the remainder of magazine holder 885 is the utilitarian member). Bracket 893 is similar to the over-the-door, over-the-cabinet and over-the-tank mounting brackets discussed in the previous embodiments of the invention. Bracket 893 has a vertical portion 894 which is welded to an outside surface of rim 889. Extending horizontally from a bend in bracket 893 is a horizontal portion 895 which is of long enough dimension to exceed the thickness by a small amount of a toilet tank wall. A downwardly extending member 896 which is parallel with member 894 but shorter in length is provided. Horizontal portion 895 must not only slightly exceed the thickness of the tank, but should not be so long as to prevent the installation of the tank cover over the tank while holding bracket 893 in place.

Bent rod 887 and rim 889 are oval in cross section, as discussed in other embodiments, and their cross section 897 is shown in FIG. 31D. Cross section 897 has wide surfaces 898 and narrow surfaces 899. As in the other embodiments, each section which is attached to the oval cross section is attached to wide surfaces 898 for giving strength and stability to the attachment. Over-the-tank rack 885 works well and looks sleek and modern.

Figure 32A:
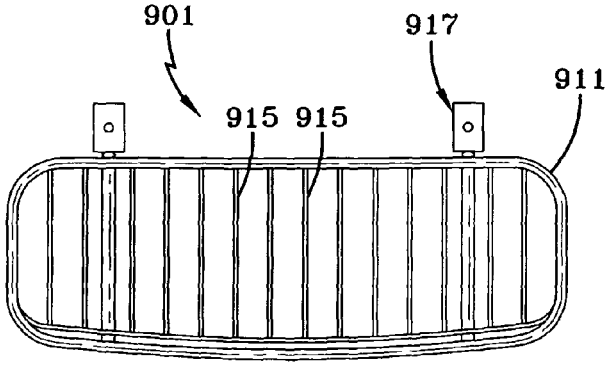
FIGS. 32A, 32B and 32C are top, front and side areas of an over-the-cabinet magazine basket assembly according to the invention.
Figure 32D:
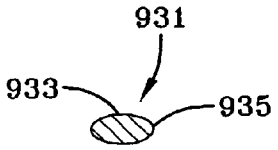
FIGS. 32D and 32E is taken in the directions 32D-32D and 32E-32E.
Figure 32E:
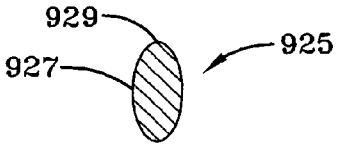
Figure 32B:
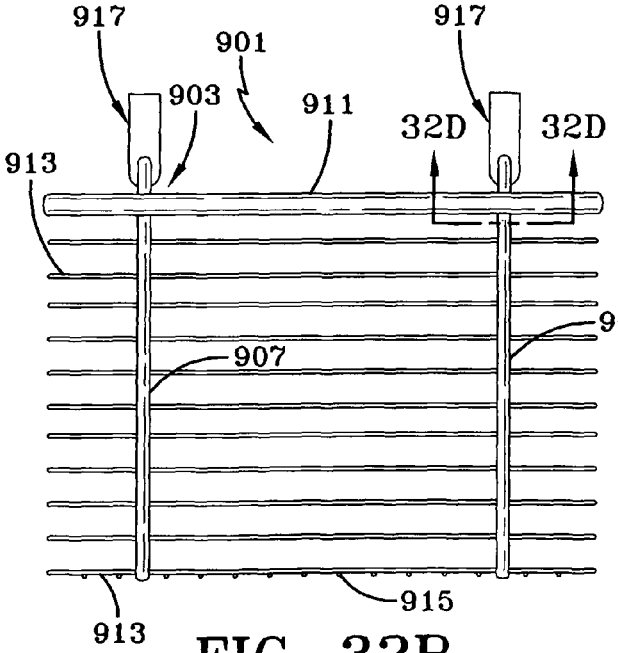
Figure 32C:
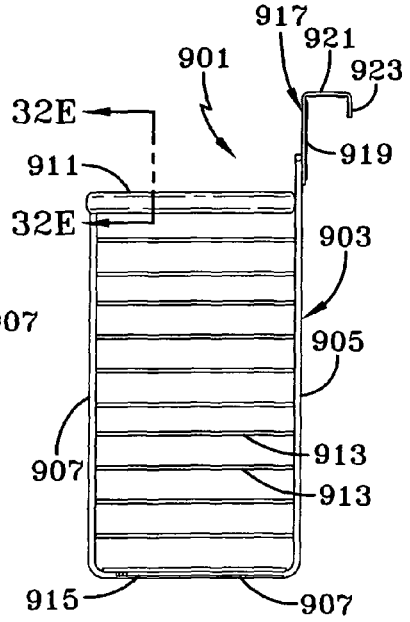

An over-the-cabinet basket assembly 901 is shown in FIGS. 32A-32C. Basket assembly 901 has a pair of parallel, bent rods 903, each bent into a generally U-shaped form, with a rear vertical member 905, and an underlying base member 907.

Vertical member 905 exceeds the height of member 907 slightly for reasons described below. A rim 911 defines the upper opening of basket assembly 901. Bent rods 903 are welded or otherwise attached to the inside surface of rim 911 at the front portion thereof, and to the outside surface of rim 911 at the back surface of rim 911. A set of parallel, closed, cylindrical wire members 913 each generally following the configuration of rim 911, are welded or otherwise attached to vertical members 905 and 907 of bent rods 903, with rods 905 being slightly higher than rod 907. Members 913 are parallel to each other, and disposed equidistantly, one over the other, to form the side portions of basket assembly 901. A set of parallel cylindrical wire forms 915 are welded or otherwise attached to the bottom surface of the lowermost wire member 913 in a parallel relationship. Over-the-cabinet brackets 917, forming the stabilizing members, are welded or otherwise attached to the rear surface of vertical portions 905 of bent rod 903. Brackets 917 have vertical portion 919 from which extends a bent over horizontal portion 921 which is perpendicular to portion 919, and a rearward, downwardly bent vertical portion 923 which terminates in a free end and is shorter in length than vertical portion 919. The distance of portion 921 between portions 919 and 923 should be sufficient to slightly clear the width of a cabinet door from which it is to be suspended. In use, basket assembly 901 could be hung so that the basket portion of it extends into a cabinet, or so that the basket portion extends outwardly from the cabinet door. For use in a kitchen, for example, basket assembly 901 could be hung so that it faced into the cabinet, and can hold such items as bottles for dish soap, a box of steel wool and any other implements or containers used in a kitchen. Basket assembly 901 could face outwardly from a door as well, and could hold, for example, tools in a workshop. All of the parts other than brackets 917 form the utilitarian member. Rim 911 is made from a rod with an oval cross section 925, having wide surfaces 927 and narrow surfaces 929, shown in FIG. 32E. Wide surfaces 927 would face the surface of any other component to be welded or otherwise attached to it. Bent rods 903 have a smaller cross section 931 as depicted in FIG. 32D, with wide surfaces 933 and narrow surfaces 935. Wide surfaces 933 also face the surfaces of other components to be attached to it, as shown in FIGS. 32A-32C. Over-the-cabinet basket assembly is efficient, and has a sleek and modern appearance.

Figure 33A:
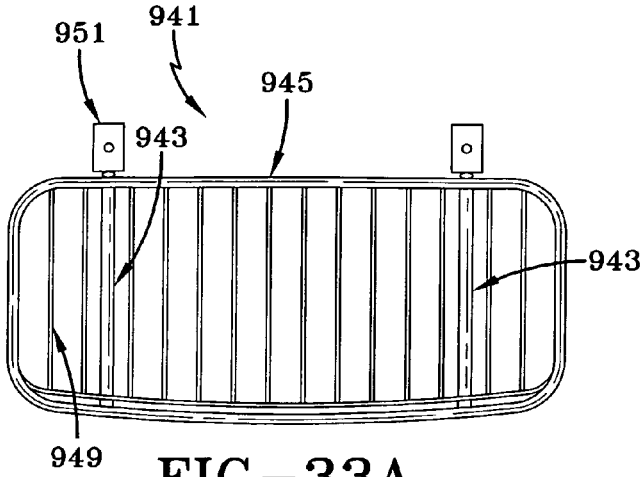
FIGS. 33A, 33B and 33C are top, front and side areas of another over-the-cabinet magazine basket assembly according to the invention.
Figure 33D:
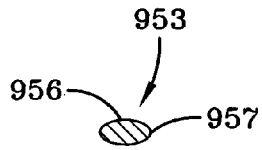
FIGS. 33D and 33E is taken in the directions 33D-33D and 33E-33E.
Figure 33E:
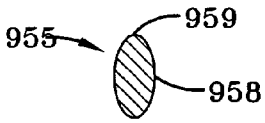
Figure 33B:
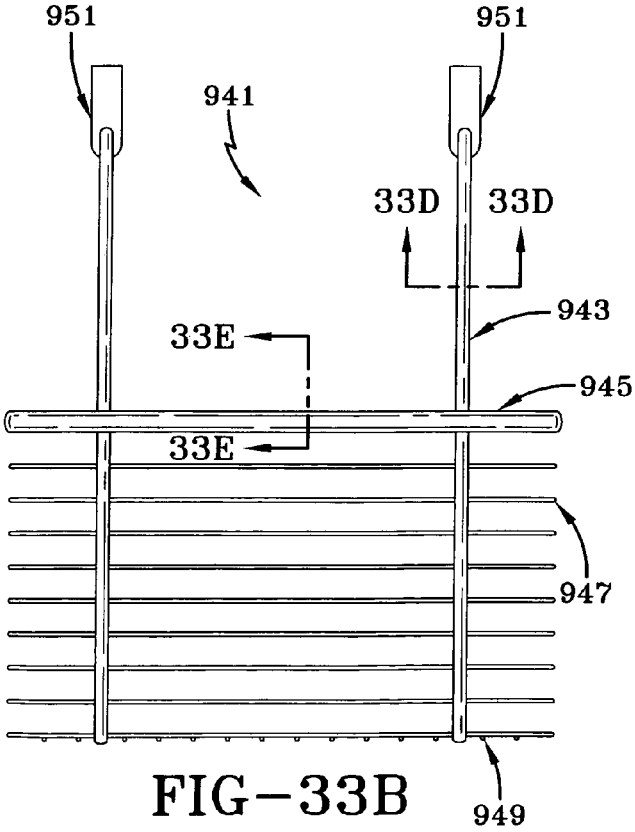
Figure 33C:
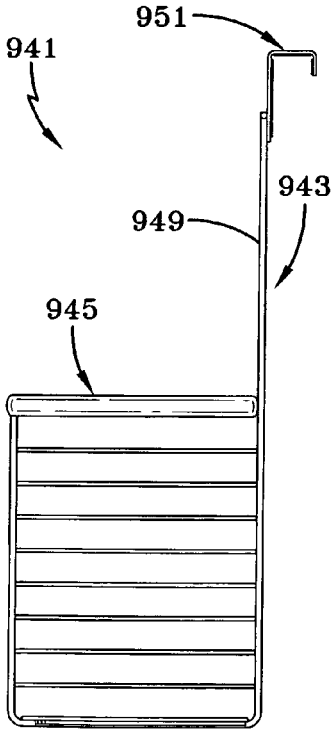

An over-the-cabinet basket assembly 941 is shown in FIGS. 33A-33C. Basket assembly 941 is very similar to basket assembly 901, in FIGS. 32A-32C. Thus, basket assembly 941 includes a pair of bent rods 943, a rim 945, wire members 947 and wire forms 949, all very similar to bent rods 903, rim 911, wire members 913 and wire forms 915, and reference is made to a discussion of the latter elements set forth above with respect to an explanation of corresponding elements in FIGS. 33A-33C.

Bent rods 943 include a rear vertical extension 949 whose length above rim 945 is much longer than the length of vertical member 905 above rim 911 in FIGS. 32A-32C. The reason is that basket assembly 941 includes an over-the-cabinet bracket 951 (the stabilizing members), similar to previous over-the-cabinet brackets, and rear vertical extension 949 of bent rods 943 must be of sufficient length so that one can have easy access to the opening defined by rim 945 to put things in the basket assembly and to remove them. The length of extension 949 depends both on the height of the door (or other vertical support with which basket assembly 941 is used) and the depth of the basket assembly.

Bent rods 943 and rim 945 are made from rods with oval cross sections 953 and 955 respectively, as shown respectively in FIGS. 33D and 33E. Cross section 953 has wide surfaces 956 and narrow surfaces 957, and cross section 955 has wide surfaces 958 and narrow surfaces 959. Basket assembly 941 is an effective unit with a sleek and modern appearance.

Figure 34A:
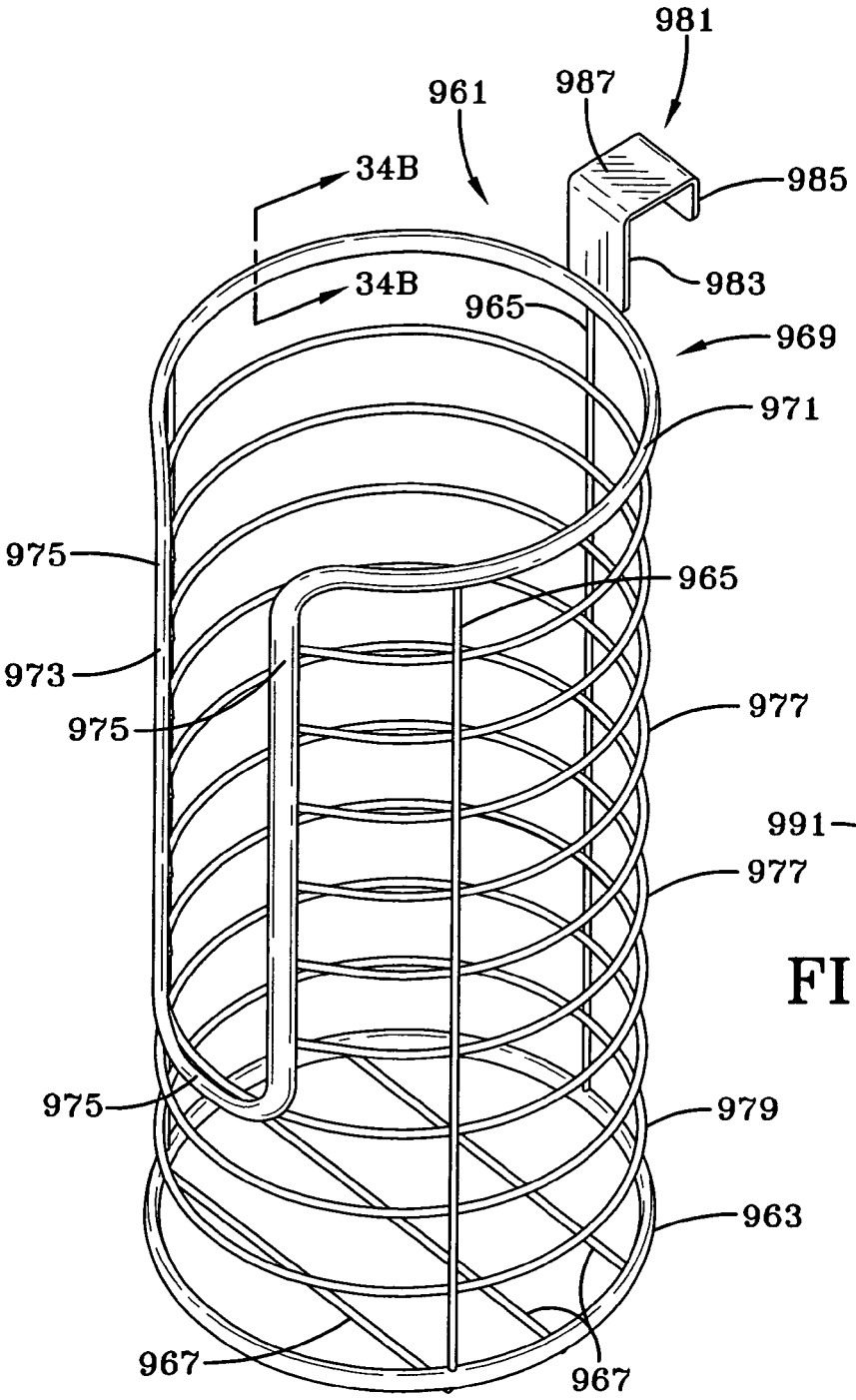
FIG. 34A is a perspective view of a toilet paper roll reserve.
Figure 34B:
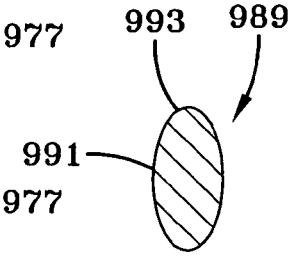
FIG. 34B is taken in the direction 34B-34B.

FIG. 34A shows an over-the-tank vertical toilet paper roll holder 961 according to the invention. Roll holder 961 includes a circular base 963 from which extend three vertical rods 965. Vertical rods 965 are equidistantly spaced. Although many different attachment structures are possible, in this case there are holes in base 963 into which rods 965 are inserted and secured. Rods 965 could be welded to base 963, held in with appropriate fasteners or the like. The bottom of holder 961 is formed by horizontal wire forms 967 which are parallel to each other, and which are connected at their opposite ends to base member 963 by welding or some other appropriate means. An access member 969 includes a top and access rim having a top rim portion 971 and a side access portion 973 with a bottom 975. A set of parallel, coaxially, equidistantly spaced, partially circular rings 977 are attached at their opposite free ends to side rim 973. Circular rings 979 are welded to rods 965, and are spaced as were partially circular rings 977. One uses holder 961 by simply placing rolls of paper into access 969, and by merely grasping a roll in holder 961 through access member 969 and lifting it out of holder 961. A cross section 989 of access member 969 is shown in FIG. 34B. Cross section 989 has wide surfaces 991 and narrow surfaces 993. The foregoing discussion related to the utilitarian member. The stabilizing member is over-the-tank bracket 981, composed of opposing vertical portions 983 and 985, and horizontal portion 987. Wide surfaces 991 face the inside of roll holder 961 to engage the rolls, and to give holder 961 a sleek and modern appearance.

Figure 35:
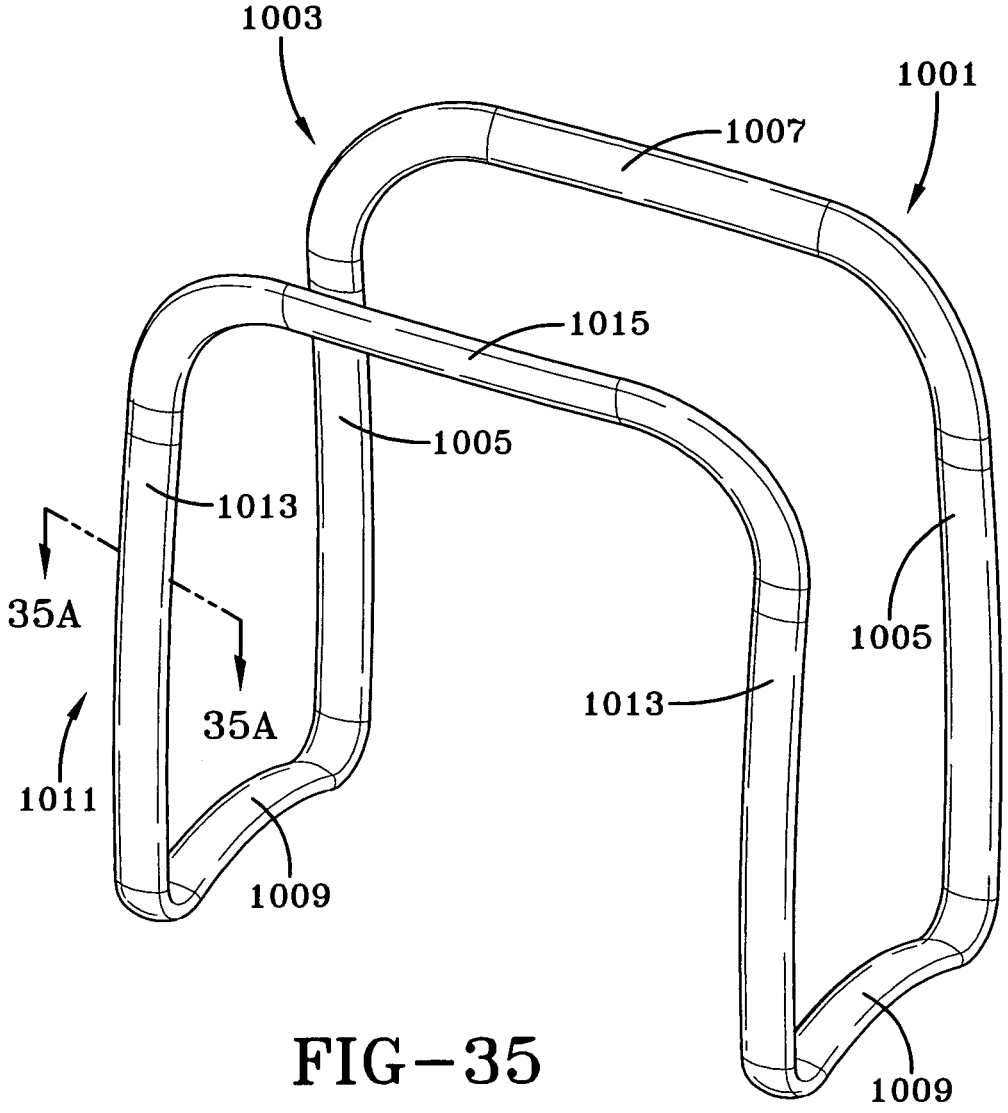
FIG. 35 is a perspective view of a napkin holder.

Referring next to FIG. 35, a napkin holder 1001 is shown. Napkin holder 1001 is comprised of a bent rod including a first three-sided portion 1003 having a pair of opposing, parallel upstanding legs 1005 and a crosspiece 1007 which interconnects legs 1005, and is generally perpendicular to them.

A pair of feet 1009 are parallel to each other and are bent from sides 1005, and are curved slightly upwardly to leave a small gap beneath the central portion between the ground engaging portion of feet 1009, forming the stabilizing member—the remaining parts constitute the utilitarian member. A second, three-sided portion 1011 extends upwardly from the end portions of the respective feet 1009, opposite to three-sided portion 1007. Portion 1011 is composed of a pair of upstanding legs 1013 which are parallel to each other, and which are connected by a crosspiece 1015 which is parallel to crosspiece 1007. Three sided portions 1003 and 1011 are slightly bent towards each other so that the width of the space between crosspieces 1007 and 1015 is slightly closer to each other at their top portions than they are their lower portions, and the height of legs 1013 is somewhat less than the height of legs 1005. This construction enables groups of napkins held in napkin holder 1001 to be slightly pinched between three-sided portions 1003 and 1011 to keep the napkins in place, and to make them easily graspable to pull the napkins out of holder 1001.

Figure 35A:
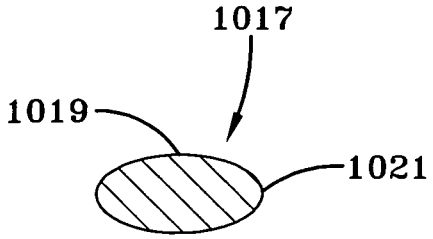
FIG. 35A is taken in the direction 35A-35A.

Referring to FIG. 35A, napkin holder 1001 is made from a metal rod with an oval cross section 1017 having wide surfaces 1019 and narrow surfaces 1021. Wide surfaces 1019 of opposing three-sided portions 1003 and 1011 face each other so as to more firmly grasp napkins held in napkin holder 1001 with a lower chance of tearing the napkins, particularly when the napkins are removed from napkin holder 1001. One-piece holder could be fabricated in different ways, and could be comprised of two pieces, welded together and then plated to hide the weld seam. Napkin holder 1001 has a sleek and modern appearance.

Figure 36B:
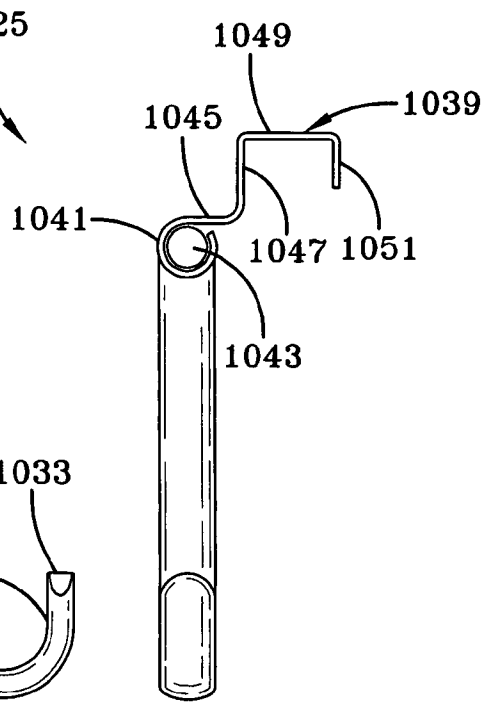
FIGS. 36A and 36B are top and side areas of an over-the-cabinet paper towel holder according to the invention.
Figure 36A:
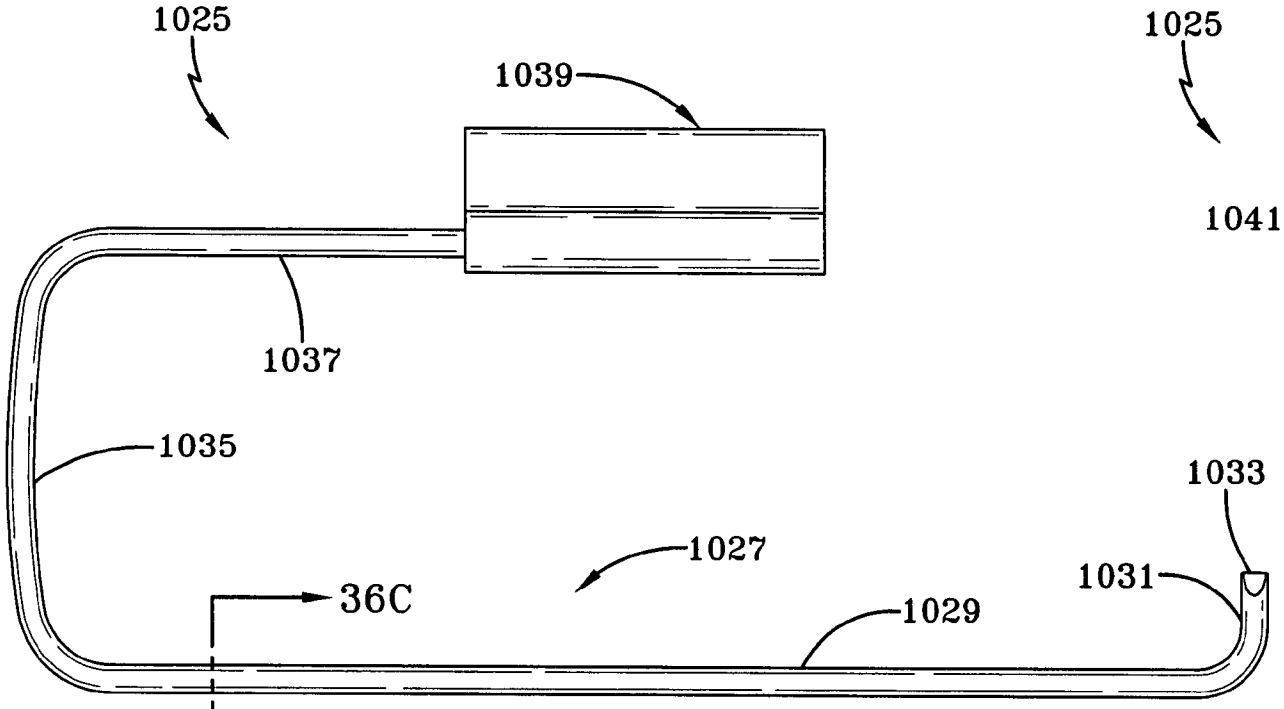

An over-the-cabinet paper towel holder 1025 is shown in FIGS. 36A and 36B. Paper towel holder 1025 includes a bent rod 1027 having a straight arm 1029 with a curled up end portion 1031 terminating in a free end 1033. The other end of arm 1029 is curled into a perpendicular portion 1035, which is in turn bent into a straight portion 1037 which is shorter than, and parallel to, arm 1029. An over-the-cabinet bracket 1039, the stabilizing member, is bent over and attached to arm 1037. Bracket 1039 has an attachment portion 1041 which is curled to have a cross section which is almost circular, and a diameter which is only slightly larger than the diameter of a free end portion in the form of a cylinder. Element 1041 is attached to a cylindrical portion 1043 of rod 1027 by welding, applying an appropriate adhesive, pressing or the like. Bracket 1039 is a bent piece of metal having a straight portion 1045 which is generally perpendicular to metal portion 1027, and from which is bent a section 1047. Section 1047 is perpendicular to section 1045. A crosspiece 1049, perpendicular to section 1047, extends away from section 1047 and terminates in a free end portion 1051. The length of section 1049 should be of sufficient length to extend over the thickness of a cabinet door, so that the towel holder can hang on the cabinet and not preclude the door from opening and closing. Several different lengths may be necessary to the extent that the thickness of cabinet doors vary. The length of arm 1029 should be sufficient so that a roll of paper towels can fit between free end portion 1031 and section 1035. Likewise, the length of section 1035 should be sufficient so that a full roll of paper towels can fit on arm 1029 and not contact either section 1037 or bracket 1039. All of the foregoing components of towel holder 1025, other than bracket 1039, constitute the utilitarian member.

Figure 36C:
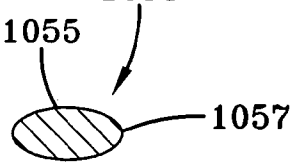
FIG. 36C is a cross section of the towel bar taken in the direction 36C-36C.

Sections 1029, 1031, 1035 and 1037 are bent from a metal rod having an oval cross section 1053 with wide surfaces 1055 and narrow surfaces 1057, as shown in FIG. 36C. Wide surfaces 1055 face inwardly towards each other so that wide surfaces 1055 on arm 1029 engage the upper portion of a paper towel roll installed on arm 1029. Cylindrical portion 1043 could be integral with the remainder of rod 1027, or be attached to it. Various ways of making an integral unit are possible. For example, the raw material from which rod 1027 is made could comprise a cylindrical bar from which the oval bar is formed using appropriate metal working processes.

Paper towel holder 1025 could be mounted so that arm 1029 is inside the cabinet when the cabinet door is closed to hide the paper towels from view or could be outside of the cabinet rendering the towels more accessible. Paper towel holder 1025 has a sleek and modern look.

Figures 37A, 37B, 37C, 37D:
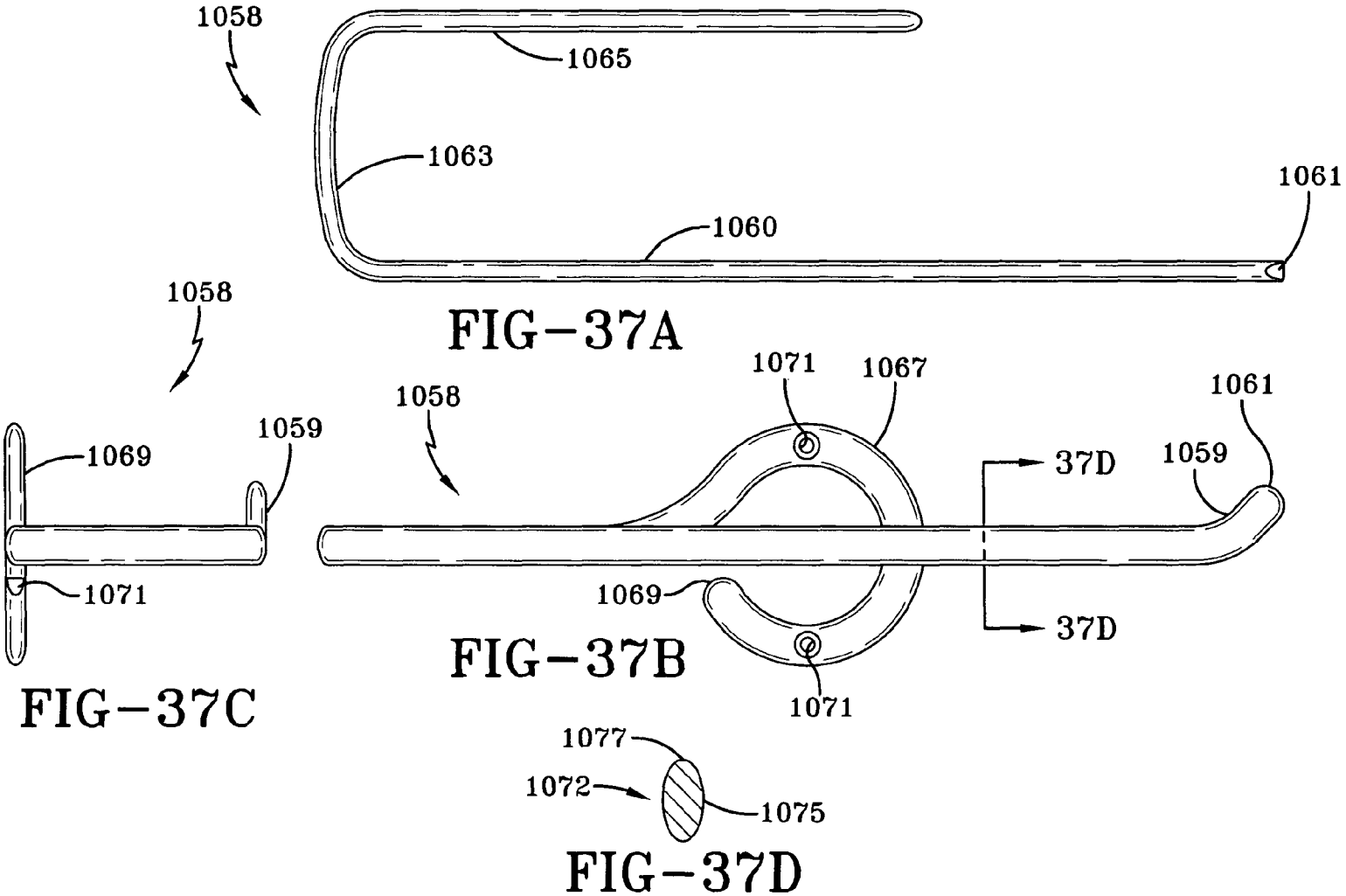
FIGS. 37A, 37B and 37C are top, front and side views of a wall mounted paper towel holder according to the invention.
FIG. 37D is taken in the direction 37D-37D.

Another form of a paper towel holder is a towel holder 1058 shown in FIGS. 37A-37C. Towel holder 1058 is attached to a wall when in use. Towel holder 1058 includes a horizontal arm 1060 which is integrally connected to a bent up portion 1059 which terminates in a free end 1061. Horizontal arm 1060 terminates at its opposite end in a crosspiece 1063 which is at generally right angles to arm 1057, and to which is connected a bent over horizontal arm 1060 which is parallel to arm 1057. Ann 1065 terminates in a bent over portion or wall connecting portion 1067 (the stabilizing member —the remaining parts are the utilitarian member) which is in the shape of an open eye hook. Wall connecting portion 1067 has a free end 1069 and a pair of holes 1071 through which a connector can be used to attach paper towel holder 1058 to a wall.

Paper towel holder 1058 is made in its entirety by a metal rod having an oval cross section 1072, shown in FIG. 37D, with wide surfaces 1073 and narrow surfaces 1075. The oval rod is oriented so that wide surfaces 1073 are facing the wall to which holder 1058 is to be attached, and which engage the inside of a paper towel roll inserted on an arm 1060. The length of arm 1060 should be sufficient to extend through the wall of a paper towel holder and the length of arm 1063 should be sufficient so that full roll of paper towels could fit on arm 1060 and not touch opposing arm 1065. Paper towel holder 1058, like paper towel holder 1025 can efficiently be made, is decorative to view due to its sleek and modem appearance, and performs its function very well.

Figure 38A:
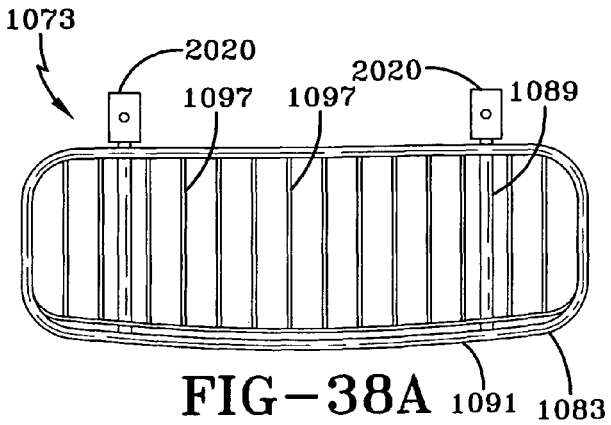
FIGS. 38A, 38B and 38C are top, front and side views of an over-the-cabinet caddy according to the invention.
Figure 38D:
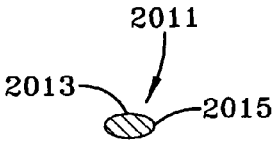
FIGS. 38D and 38E are taken in the directions 38D-38D and 38E-38E.
Figure 38E:
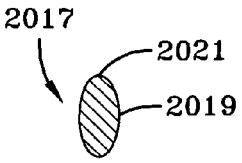
Figure 38B:
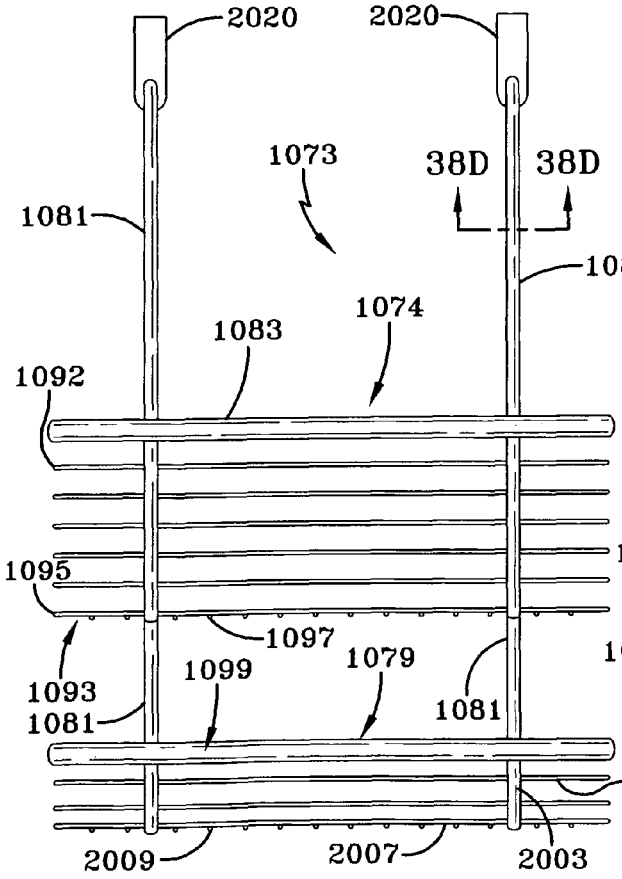
Figure 38C:
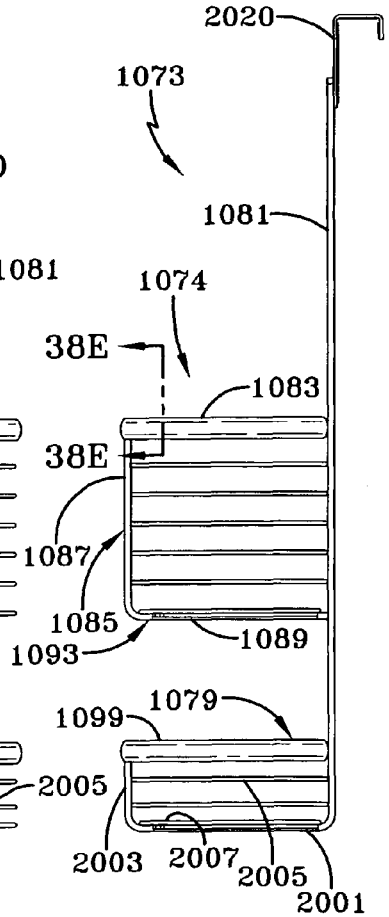

An over-the-cabinet basket assembly 1073 having a sleek and modern look, is shown in FIGS. 38A-38C. Basket assembly 1073 includes an upper basket 1079 and a lower basket 1079, each of which are attached to vertical rods 1081, which constitute the utilitarian member. Upper basket 1079 includes a rim 1083 from which extend a pair of L-shaped support members 1085 having a vertical support 1087 and a horizontal support 1089, the latter two supports being bent from a metal rod. Rim 1083 is bent to form a generally rectangular opening to basket 1079, with a front arm 1091 being bent slightly forwardly. Rim 1083 is attached to vertical members 1081 by welding or some other means of attachment. The stabilizing members are over-the-counter brackets 2020 attached to the tops of vertical members 1081. A set of wire forms made from cylindrical metal wire, having the same general configuration as rim 1083, are shown at numeral 1092. Forms 1092 are stacked one over the other at an equidistant basis to form the side portion of basket 1079. A bottom member 1093 has a peripheral portion 1095 having the configuration of rim 1083 and wire forms 1092, and across which are provided a set of parallel, equidistantly disposed wire forms 1097 which extend between the opposing sides of bottom member 1095 which run from the rearward section (adjacent vertical members 1081) forwardly in the direction opposite to the location of members 1081. Lower basket 1079 is composed of an upper rim 1099 which is attached by welding or some other appropriate means to support members 1081. Basket 1079 further includes a pair of base members 2001 which are bent to form upwardly extending members 2003 to which rim 1099 is also attached such as by welding. Members 2001 and 2003 are all integral with vertical member 1081 from which they are bent. A set of wire forms 2005 identical to wire forms 1091, are disposed in a parallel equidistant fashion beneath rim 1099 to form the sides of lower basket 1079. Lower basket 1079 further includes a bottom member 2007 having the same general shape as wire foil is 2005, and across which are attached straight, parallel, equidistantly disposed wire forms 2009 forming the bottom of lower basket 1079. Wire forms 1092, 1095, 1097, 2005, 2007 and 2009 are all cylindrical in cross section. Vertical members 1081 and rims 1083 and 1099 are all oval in cross section. Members 1081 have cross section 2011 with wide surfaces 2013 and narrow surfaces 2015, as shown in FIG. 38D. Rims 1083 and 1099 have cross sections 2017 with wide surfaces 2019 and narrow surfaces 2021, illustrated in FIG. 38E. It can be seen that the cross-sectional area of rims 1083 and 1099 are larger than the cross section of vertical members 1081. It can further be seen that wide surfaces 2013 and 2019 face the components to which they are attached for increasing the area of contact and the effectiveness of the attachment, as well as to improve the appearance of basket assembly 1073.

Figure 39:
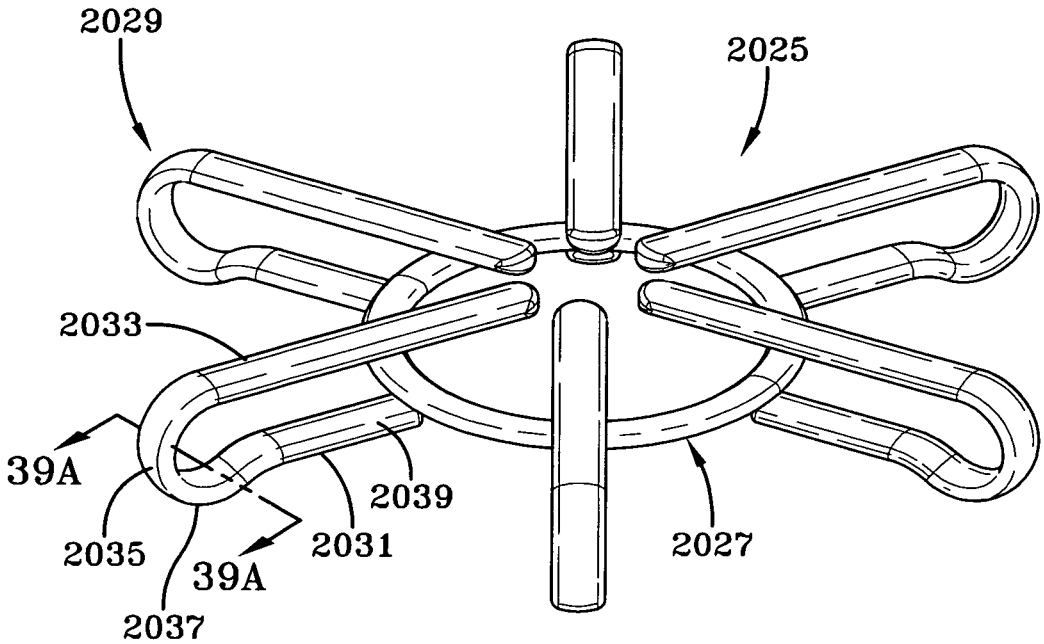
FIG. 39 is a perspective view of a trivet according to the invention.

A trivet 2025 is shown in FIG. 39. Trivet 2025 includes a circular intermediate member 2027 and set of five combination feet and support members 2029, with five being shown in FIG. 35, although this number could be varied provided that the trivet is stable with and without a load. Combination feet/support members each include a generally U-shaped member having a horizontal arm 2031 disposed below and attached to intermediate member 2027, a straight, parallel support member 2033 on the opposite side of member 2027 and a curved crossover piece 2035 having a bent down portion 2037 disposed below a horizontal portion 2039 of foot 2031 for bearing the weight of the unit (along with the other portions 2037). Arm 2039 is welded or otherwise attached to the bottom of intermediate member 2027 and the upper surface of each support member 2033 is parallel to support any pot, dish, bowl, or other container or the like on trivet 2025. Bent down portions 2037 constitute the stabilizing members; the remainder of the parts are the utilitarian member.

Figure 39A:
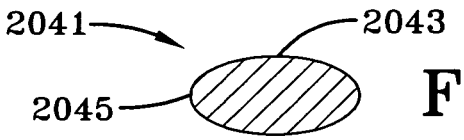
FIG. 39A is taken in the direction 39A-39A.

Each component of trivet 2025 has a cross section 2041 shown in FIG. 39A which has wide surfaces 2043 and narrow surfaces 2045. Wide surfaces 2043 are the upwardly facing surfaces of support member 2033 to increase the area of contact with the container or the like supported by trivet 2025, and wide surfaces 2043 face downwardly at curved portions 2037 to increase the stability of the unit. Likewise, the broad areas of each component which contact each other and are attached to each other, increase the strength and stability of the attachment. Furthermore, the oval-shaped components of trivet 2025 add to the attractiveness of this unit, which has a sleek and modern look.

Figure 40:
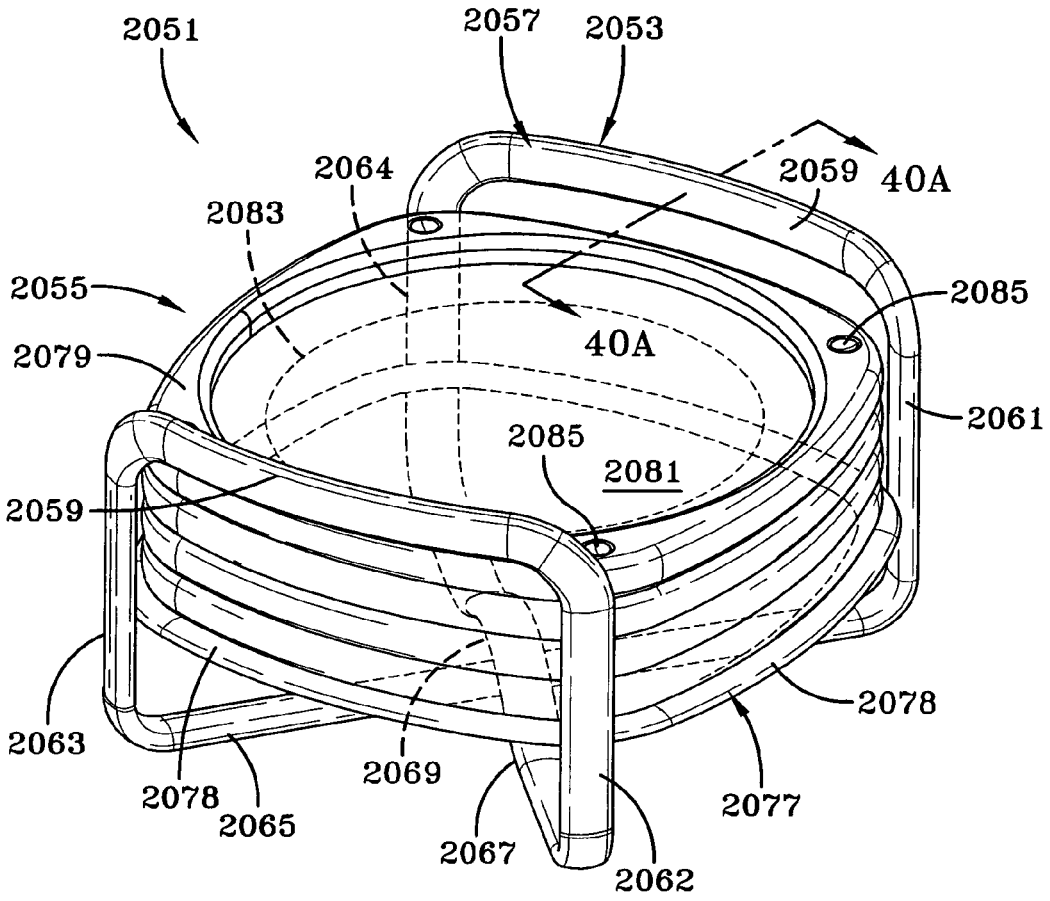
FIG. 40 is a perspective view of a coaster holder and set of coasters according to the invention.

FIG. 40 shows a coaster assembly 2051. Coaster assembly 2051 includes a coaster holder frame 2053 with horizontal foot members (forming the stabilizing members; the remainder are the utilitarian member) and a set of coasters 2055. Coaster holder frame 2053 includes a unitary piece of bent rod 2057 which is bent from a pair of upper horizontal, curved members 2059, convex with respect to each other, from which extend downwardly at the opposite ends of members 2059 four respective vertical legs 2061-2064. Interconnecting the base portions of legs 2061 and 2063 is a horizontal foot member 2065 which runs diagonally beneath coaster assembly 2051. Another foot member 2067 interconnects leg members 2062 and 2064, and foot member 2067 includes an upwardly curled portion 2069 where foot member 2067 extends over foot member 2065.

Figure 40A:
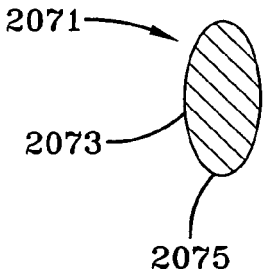
FIG. 40A is taken in the direction 40A-40A.

Coaster holder frame 2053 has an oval cross section 2071 with wide surfaces 2073 and narrow surfaces 2075 as shown in FIG. 40A. A support member 2077 is welded or otherwise attached to each of leg members 2061-2064 in a horizontal manner when foot members 2065 and 2067 are on a horizontal surface. Support member 2077 is attached to legs 2061-2064 at a position above foot members 2065 and 2067. Support member 2077 has oval cross section 2071 as well. Support is generally square in configuration, with outwardly curved out sides 2078.

Each coaster 2055 has a peripheral portion 2079 which is preferably made from hard, rigid plastic, and supports a coaster support member 2081 which could be made from metal or plastic. Coaster support member 2081 is a circular disk. Support member 2079 includes a lip 2083 which extends beneath disk 2081, and to which disk 2081 is attached by a heating and cooling of the plastic of which one or both of support member 2079 and disk 2081 are composed, by means of an appropriate adhesive or some other attaching device. Small feet, the tops 2085 of which are shown, can be provided to support each coaster 2055 on a table or other flat planar surface.

Wide surfaces 2073 of each of bent rod 2057 and support member 2077 face the coasters when they are in place to provide stable support to the coasters, as well as to improve the appearance of coaster assembly 2051, which has a sleek and modem appearance. Likewise, wide surfaces 2073 of foot members 2065 and 2067 face downwardly to improve the support of member 2057 against its resting surface.

Figures 41, 41A:
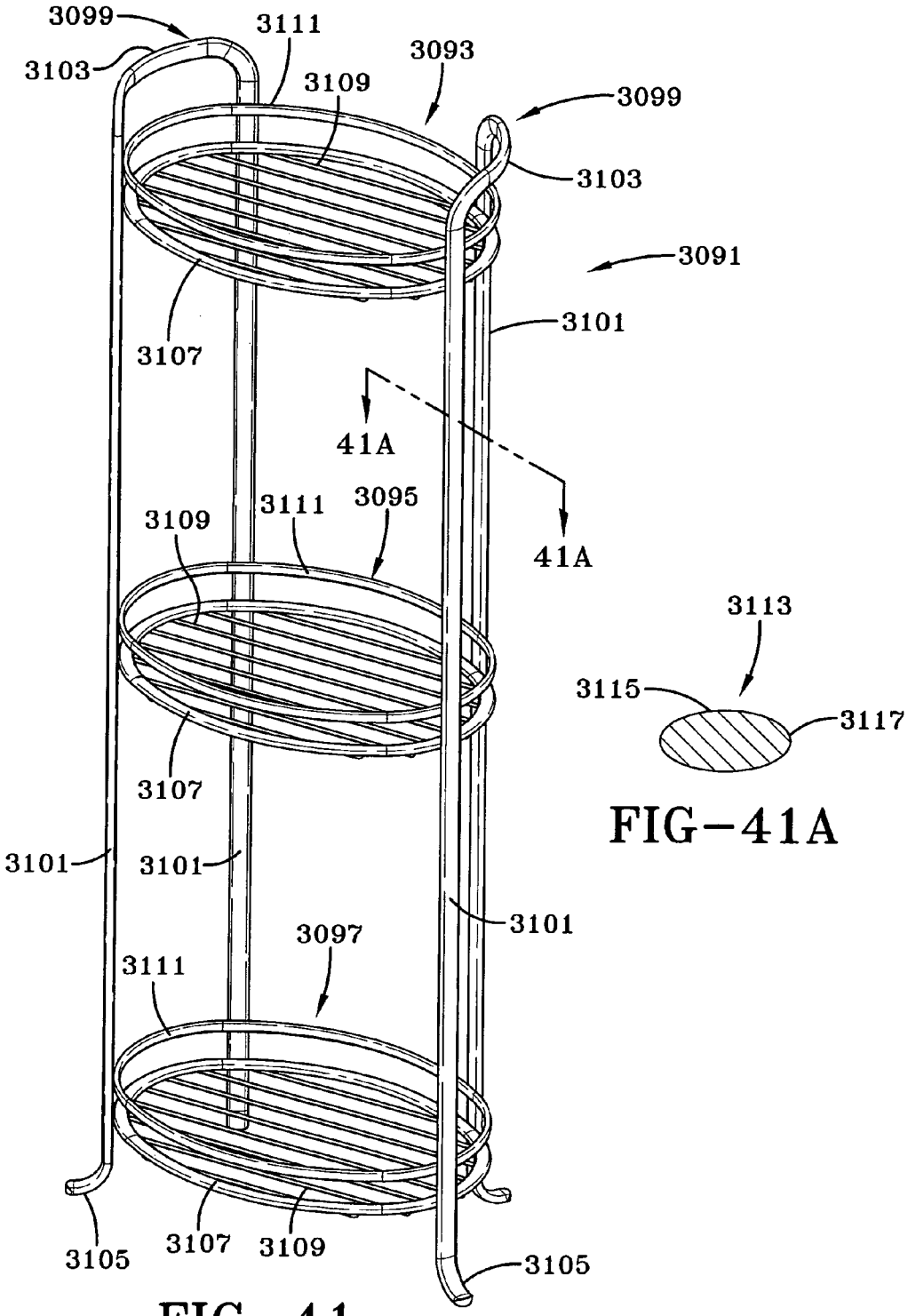
FIG. 41 is a perspective view of a three tier shelving unit according to the invention.
FIG. 41A is taken in the direction 41A-41A.

A tier shelving unit is shown in FIG. 41. More specifically, a three tier shelving unit 3091 is shown respectively in FIG. 41. Three tier shelving unit 3091 includes a top tier 3093, a middle tier 3095 and a bottom tier 3097. A pair of vertical support members 3099 are in an opposing relationship to each other. Each support member 3099 has a pair of parallel vertical legs 3101, which are connected at their respective ends by an outwardly curved crosspiece 3103. Each of legs 3101 terminates at its lower end with an outwardly curved out foot portion 3105 (forming the stabilizing member—the remaining parts are the utilitarian member) for providing stable support to tier shelving unit 3091. Tier 3093 is welded or otherwise attached to support members 3099 near the top of the latter units, tier 3097 is welded or otherwise attached to support members 3099 and tier 3095 is attached to support members 3099 between tiers 3093 and 3097, advantageously midway between the top and bottom of support members 3099.

Each tier 3093, 3095 and 3097 includes a base rim 3107, which is welded or otherwise attached to vertical support members 3099. Each rim member 3107 defines the shape of each tier. A set of wire forms 3109, which are made from cylindrical wire, are arranged parallel to each other and equidistantly spaced apart from each other, and are attached to base rims 3107 by welding or some other appropriate attaching means. As shown, wire forms 3109 are attached to the bottom of each rim 3107. An upper rim 3111 is disposed above each of bottom rims 3107 to provide side support for preventing any items held on the respective tiers 3093, 3095 and 3097, from falling out of the respective tiers. Referring to FIG. 41A, each vertical support member 3099, and rims 3107 and 3111 have oval cross section 3113 having wide surface areas 3115 and narrow surface areas 3117. Vertical support members 3099 are arranged so that wide surfaces 3115 face the inside of tier shelving unit 3091, as are upper rims 3111. This arrangement provides relatively broad contact area between vertical support members 3099 and upper rims 3111 to increase the welding area and the effectiveness of the weld. Furthermore the wide surface area provides further support to any items held in the respective tiers 3093, 3095 and 3097. Bottom rims 3107 are arranged so that their wide surfaces 3115 face upwardly and downwardly, both to provide a wider support area for items held on the respective tiers, and to provide a relatively wide area for wire forms 3109 to be welded to the respective lower rims or otherwise be attached thereto. Tier shelving unit 3091 is a stable and attractive unit, with a sleek and modern look. In a preferred embodiment, each tier has an elliptical shape in plan view, with a major axis of about 8 inches and a minor axis of about 5 ⅜ inches, yielding a major to minor axis of about 1.5. Tier shelving unit 3091 works very well, and has a sleek and modern appearance.

Figure 42:
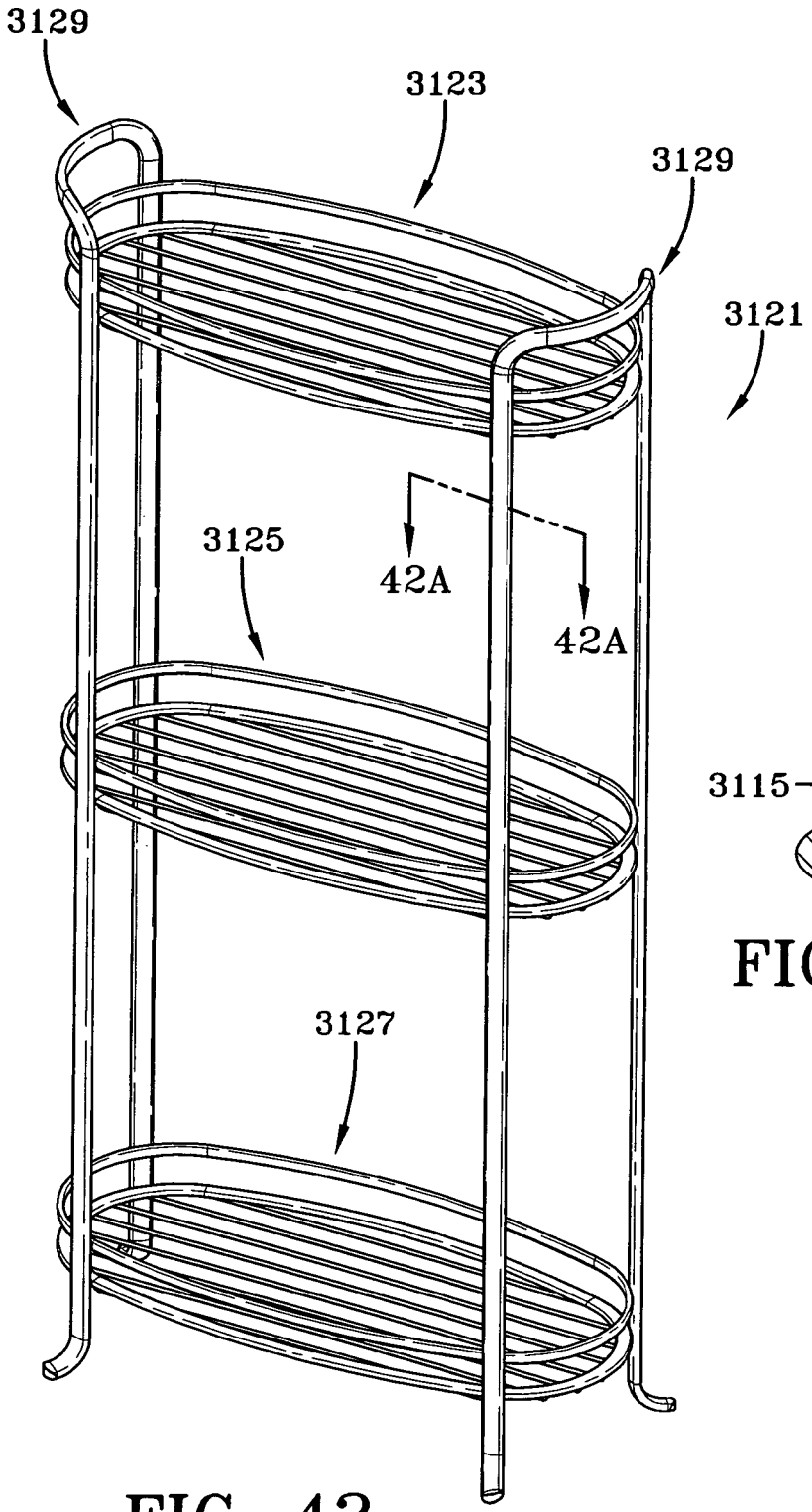
FIG. 42 is a perspective view of a three tier elongated shelving unit according to the invention.
Figure 42A:
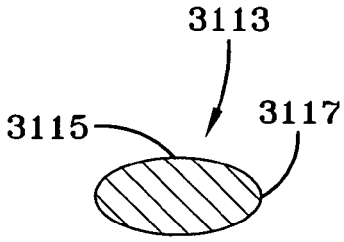
FIG. 42A is taken in the direction 42A-42A.

Another tier shelving unit 3121, similar to tier shelving unit 3091, is shown in FIG. 42. Tier shelving unit 3121 has a set of tiers 3123, 3125 and 3127. Tiers 3123, 3125 and 3127 are supported in place by their attachment to vertical support members 3129. Each tier is basically elliptical in plan view. The main difference between tier shelving unit 3121 and tier shelving 3091 is the shape of the respective tiers, tiers 3123, 3125 and 3127. In a preferred embodiment, the major axis is 12 inches and the minor axis is about 5⅜ inches, yielding a axis of about 2.2 ratio of the major axis to the minor axis of about 2.2. The bent rods from which the vertical support members and rims are made can be the same as those for shelving unit 3091, wherefor FIG. 42A is identical to FIG. 41A. Tier shelving unit 3121 also has a sleek and modern appearance.

Figure 43:
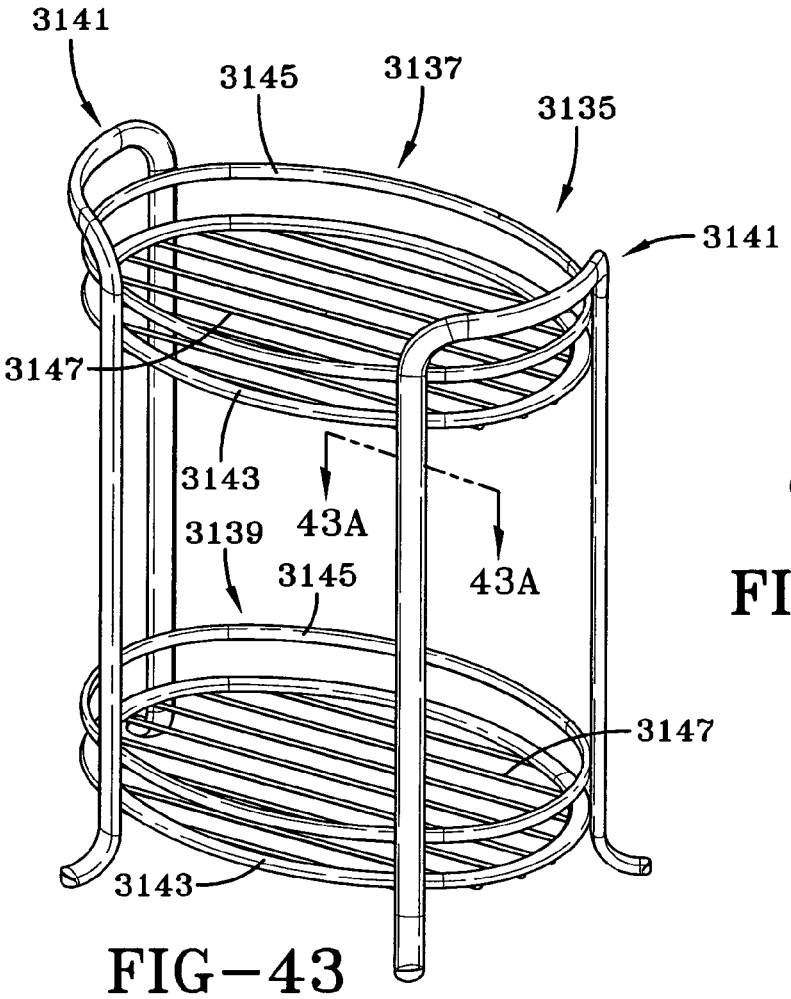
FIG. 43 is a perspective view of a two tier shelving unit according to the invention.
Figure 43A:
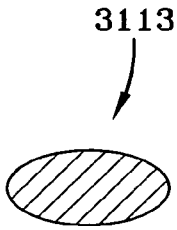
FIG. 43A is taken in the direction 43A-43A.

Another sleek and modern tier shelving unit 3135 is shown in FIG. 43. Shelving unit 3135 is very similar to shelving units 3091, except that shelving unit 3135 only has two tiers, upper tier 3137 and lower tier 3139. Shelving unit 3135 includes vertical support members 3141, lower rims 3143, upper rims 3145 and wire forms 3147 forming the bottom of tiers 3137 and 3139 corresponding to vertical support members 3099, lower rims 3107, upper rims 3111 and wire forms 3109 in the shelving unit 3091 discussed above and shown in FIG. 41. The preferred dimensions for tiers 3137 and 3139 are the same as the tiers for three tier shelving unit 3091. Since it is contemplated that the same rod with an oval-shaped cross section as was used in shelving unit 3091, cross section 3113 is indicated in FIG. 43A. Reference is made to the description of shelving unit 3091 for explanation of shelving unit 3135.

A sleek and modern two tiered shelving unit 3151 is shown in FIG. 44. Shelving unit 3151 is similar to shelving unit 3121 discussed with respect to FIG. 42, and includes an upper tier 3153 and a lower tier 3155. The tiers are supported by vertical support members 3157. Upper tier 3153 and lower tier 3155 each have an upper rim 3158 and a lower rim 3159. Vertical support members 3157 and rims 3158 and 3159 are preferably made from the same size and configuration as those having the cross section 3113, as shown in FIG. 44A. The only significant difference between two tier shelving unit 3151 and three tier shelving unit 3121 is the number of tiers, since the ratio of the major axis over the minor axis is the same as are the dimensions of each tier in the preferred embodiment. An understanding of tier shelving unit 3151 can be obtained from the description given above for tier unit 3121, as well as from the description of shelving unit 3091 and 3135.

A cookbook holder 3165 is shown in FIG. 45. Cookbook holder 3165 is made from a single piece of bent metal, and includes a pair of generally vertical, straight, parallel and opposed legs 3167 having a first pair of support portions at their lower portions for contacting a support surface, said opposing legs being separated from each other at their lower ends by a slightly curved crosspiece 3169. Cookbook holder 3165 has forwardly extending pieces 3171 which extend from the upper portion of legs 3167, and are straight, parallel and opposed to each other, and from each of which extend parallel, inclined straight legs 3173 which are also opposed to each other, and have at their respective ends a generally forwardly extending foot portion 3175 from curved elements 3177 which support the forward part of cookbook holder 3165 when the holder is in use. Foot portions 3175 and the end portions of crosspiece 3169 from the stabilizing members; the remaining parts of cookbook holder 3165 constitute the utilitarian member. The angle between each foot portion 3175 and inclined legs 3173 is about 15°. The forward ends of each portion 3175 is bent, and portions 3175 are connected by a crosspiece 3179. Cookbook holder 3165 is made from a bent rod having a cross section 3181 having wide sides 3183 and narrow sides 3185 as illustrated in FIG. 45A. Crosspiece 3179 is oriented so that wide surfaces 3183 are generally perpendicular to inclined legs 3173, so that when a cookbook is resting in cookbook holder 3165, the lower portions of the cover and pages engage or are approximate to wide surfaces 3183 of crossover piece 3179, and the front and back covers engage narrow surfaces 3185 on each of inclined legs 3173. Narrow surfaces 3185 extend forwardly and rearwardly from legs 3167 and from crossover piece 3169.

Cookbook holder 3165 is simple in construction, consisting only of one piece, and effective in use in that it holds cookbooks in open position in a manner easy to use. Cookbook holder 3165 is very sturdy and stable. To use cookbook holder 3165, one opens the book, sets the spine of the book between inclined legs 3173, and sets the base of the open book against a second pair of support portions 3175, so that the forward faces of the open pages could contact portions 3175 near crosspiece 3179. Cookbook holder 3165 is efficient and has a sleek and modem appearance.

Figure 46:
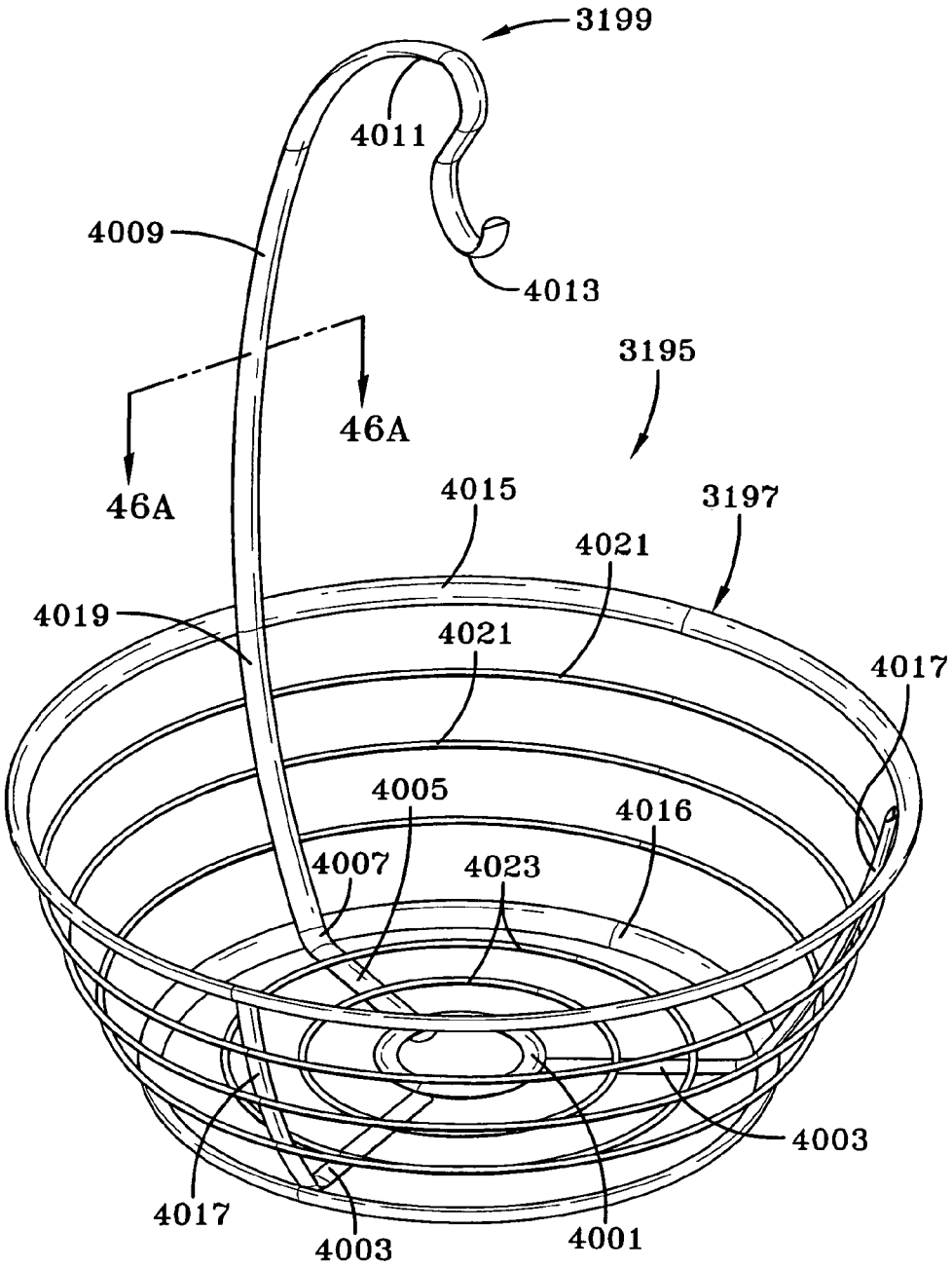
FIG. 46 is a perspective view of a fruit bowl and banana holder according to the invention.

Referring next to FIG. 46, a fruit bowl with banana hanger 3195 is shown. Fruit bowl with banana hanger 3195 includes a fruit bowl 3197 and a banana hanger 3199. Bowl 3197 has a base with a centrally disposed, bottom ring 4001, welded to which and extending therefrom are a pair of radial support arms 4003 and the base of banana hanger 3199. Banana hanger 3199 includes a radial arm 4005 forming its base, which extends radially from the bottom ring 4001 to a bottom corner 4007, and then to an upstanding curved leg 4009 which terminates at its upper end in a hooked over portion 4011 having at its free end a hook 4013 from which a bunch of bananas can be suspended.

Figure 46A:
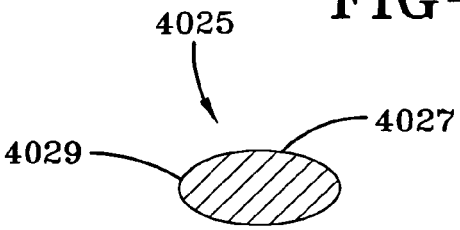
FIG. 46A is taken in the direction 46A-46A.

Fruit bowl 3197 has an upper rim 4015 which is concentric with a lower rim 4016, axially disposed from lower rim 4016 and somewhat larger. Lower rim 4016 is the stabilizing member. Arms 4003 and 4005 include a bent up, curved portion 4017 and 4019, respectively which define a projected surface of the interior of fruit bowl 3197. A series of concentric rings 4021 are welded to respected elements 4017 and 4019, wherein rings 4021 are concentric with each other and with rims 4001, 4015 and 4016, and equidistantly spaced from each other and from rims 4007 and 4015. The parts other than lower rim 4016 constitute the utilitarian member. Coplanar rings 4023 are welded or otherwise attached to flat portions 4003 and 4005, and are concentric with rims 4001 and 4016, and are equidistantly spaced from each other. Rings 4021 and 4023 are made from wires with cylindrical cross sections. Rims 4001, 4015 and 4016 are all made from a rod having a oval cross section 4025 as shown in FIG. 46A, and have wide surfaces 4027 and narrow surfaces 4029. Rims 4001, 4015 and 4016, as well as curved portion 4019 of banana holder 3199, all have wide surfaces 4027 facing the bowl so that any fruit that contacts these members would contact the wide area which is less likely to damage the fruit. Likewise, wide surfaces 4027 on hook 4013 facilitate the stable engagement of a bunch of bananas hung from banana holder 3199.

Fruit basket and banana holder 3195 is a very effective and stable in use and has a very attractive appearance. Like the other embodiments, it has a sleek, modern and efficient appearance.

Figures 47, 47A, 47B:
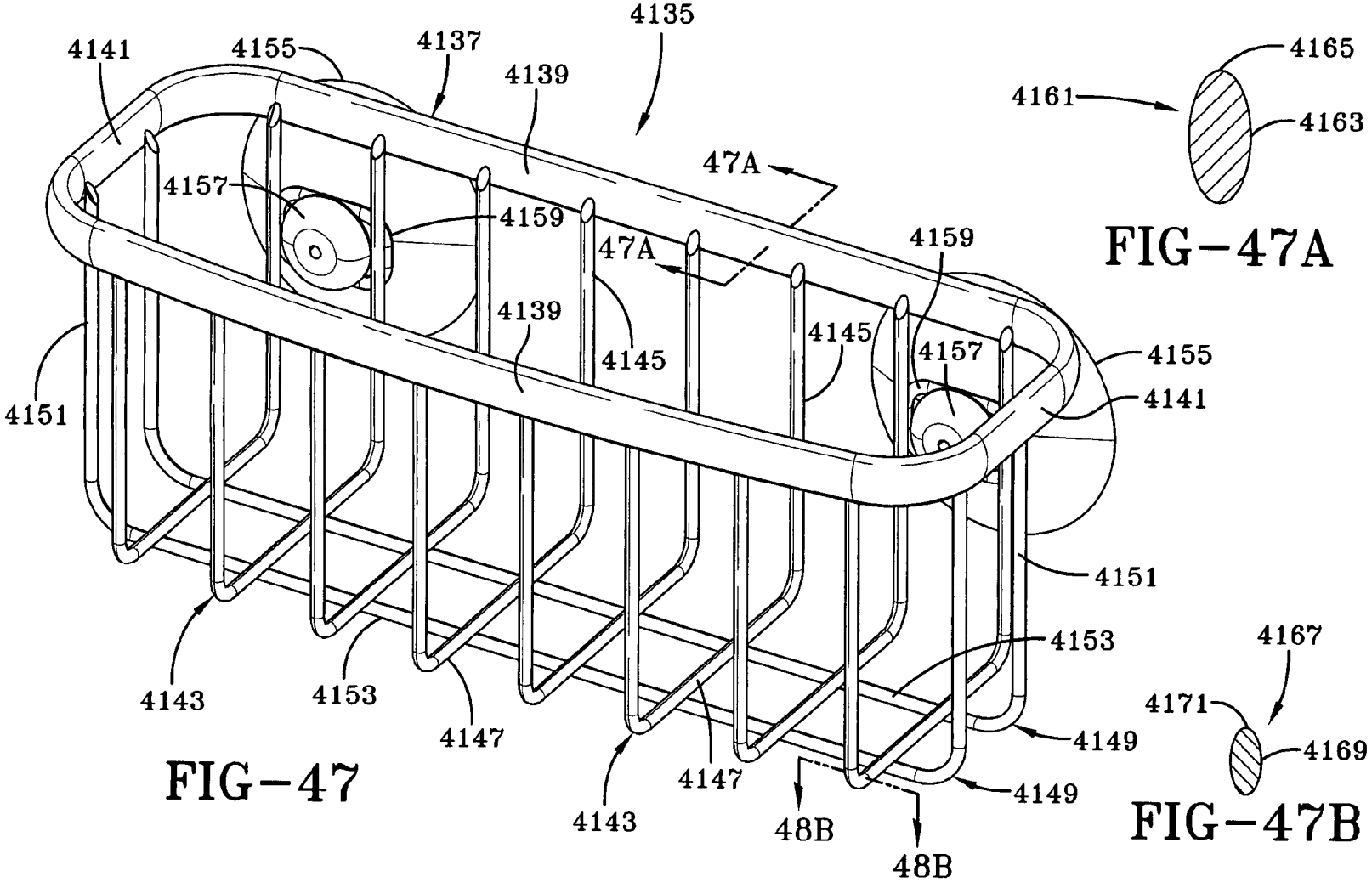
FIG. 47 is a perspective view of a suction sponge holder according to the invention.
FIGS. 47A and 47B are taken in the direction 47A-47A and 47B-47B.

A suction sponge holder 4135 according to the invention is shown in FIG. 47. Sponge holder 4135 includes a generally rectangular-shaped rim 4137 having a pair of parallel, opposing arms 4139 which are connected by crosspieces 4141, rim 4137 being bent from a single piece of metal and welded together to form a closed unit. A series of U-shaped wire forms 4143, each having opposing vertical, straight legs 4145 connected at their bases by crosspieces 4147, respectively, are welded to or otherwise attached to parallel arms 4139 of rim 4137. Other U-shaped wire forms 4149, each having parallel opposed vertical legs 4151, connected respectively by crosspieces 4153 to define the bottom of sponge holder 4135, are also connected equidistantly from each other, and generally equidistant from the adjacent leg 4145 of the wire form 4143 closest to the respective wire forms 4149. Wire forms 4143 and 4149, and rim 4137, collectively define the container portion of sponge holder 4135. The foregoing form the utilitarian member. Sponge holder 4135 is advantageously attached to the interior side surface of a sink. The attaching device is a pair of suction cups 4155, each having an attaching protrusion 4157, protrusion 4157 being connected by a neck the rest of the respective suction cup 4155.

A receiving member 4159, comprising a metal strip having a neck-receiving orifice therein, is welded to each of a pair of legs 4145, and forms the stabilizing member. Protrusion 4157 of each of a pair of suction cups 4155 is inserted through the respective orifices to attach suction cups 4155 to the remainder of suction cup holder 4135.

In use, one simply pushes the lips of the cup portion of suction cups 4155 against the interior of the sink to secure sponge holder 4135 to the wall of the sink.

With reference to FIG. 47A, rim 4137 of sponge holder 4135 has an oval cross section 4161, having wide surfaces 4163 and narrow surfaces 4165. U-shaped members 4143 and 4149 have identical cross section 4167, having wide surfaces 4169 and narrow surfaces 4171, as illustrated in FIG. 47B. It can be seen that the cross section of rim 4137 is larger than cross section 4167 of wire forms 4143 and 4149.

Wide surfaces 4163 face inwardly towards each other of rim 4137, to enable a firm attachment of wire forms 4143 and 4149 to the rim by welding or some other appropriate means. Narrow surfaces 4171 of forms 4143 and 4149 face inwardly to enable dripping of water from the sponges or other item placed in holder 4135, without being accumulated on the wire forms. Sponge holder 4135 is effective in use and very attractive in appearance with its sleek and modern look.

Figure 48A:
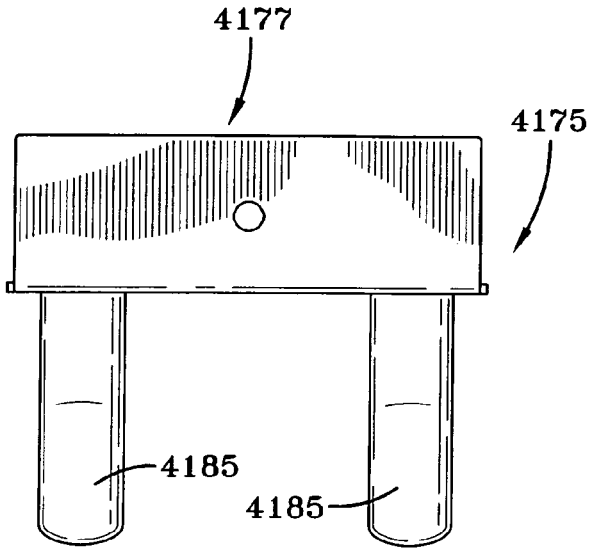
FIGS. 48A, 48B and 48C are top, front and side areas of an over-the-counter hook device according to the invention.
Figure 48D:
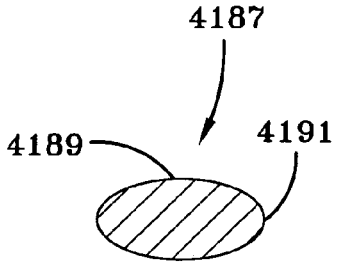
FIG. 48D is taken in the direction 48D-48D.
Figure 48B:
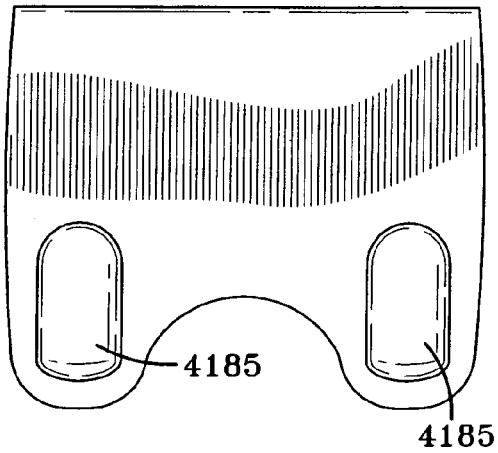
Figure 48C:
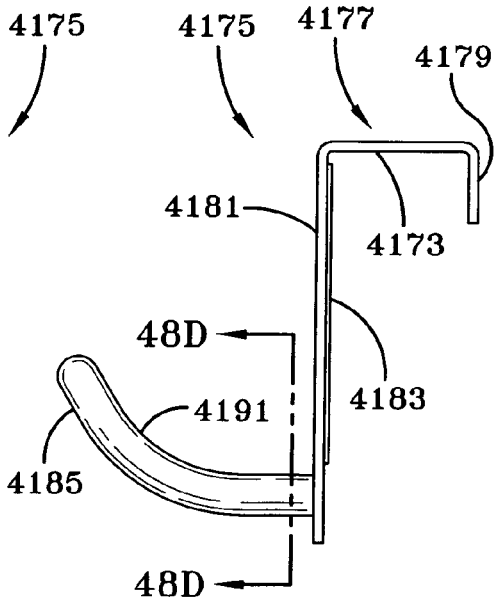

An over-the-cabinet hook assembly 4175 is shown in FIGS. 48A-48C. Hook assembly 4175 includes an over-the-cabinet bracket 4177 (the stabilizing member) composed of a back leg 4179 which is relatively short in length, a parallel front panel 4181 which is longer in length, the two being connected by a crosspiece 4173 having a dimension separating leg 4179 and panel 4181 sufficient to clear the thickness of a cabinet door, but not so wide as to cause hook assembly 4175 to wobble on the door. Front panel 4181 has a relatively soft pad 4183 for preventing the marring of the cabinet door by panel 4181.

A pair of upwardly curved cantilever hooks 4185 having upwardly bent free ends extend from the front portion of panel 4181, and are separated by an upward curve in panel 4181. Hooks 4185 form the utilitarian member. Each hook 4185 is oval in cross section as shown by the numeral 4187 in FIG. 48D. Cross section 4187 has wide surfaces 4189 and narrow surfaces 4191. Wide surfaces 4191 face upwardly to increase the area of contact with items held on the respective hooks. If hook assembly 4175 were used in a kitchen, hooks 4185 could accommodate dish towels, dish rags or the like. Hook assembly 4175 is very effective in use and pleasing to view because of its sleek and modern appearance.

Figure 49D:
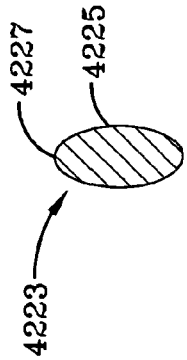
FIG. 49D is a view taken in the direction 49D-49D.
Figure 49C:
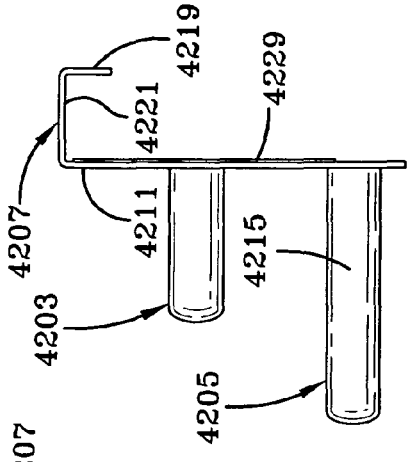
FIGS. 49A, 49B and 49C are top, front and side areas of double bar towel unit according to the invention.
Figure 49A:
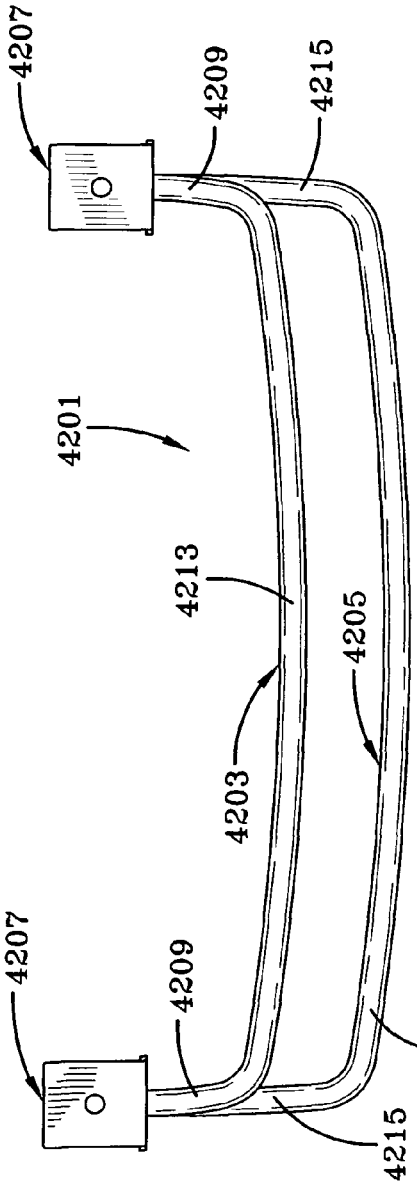
Figure 49B:
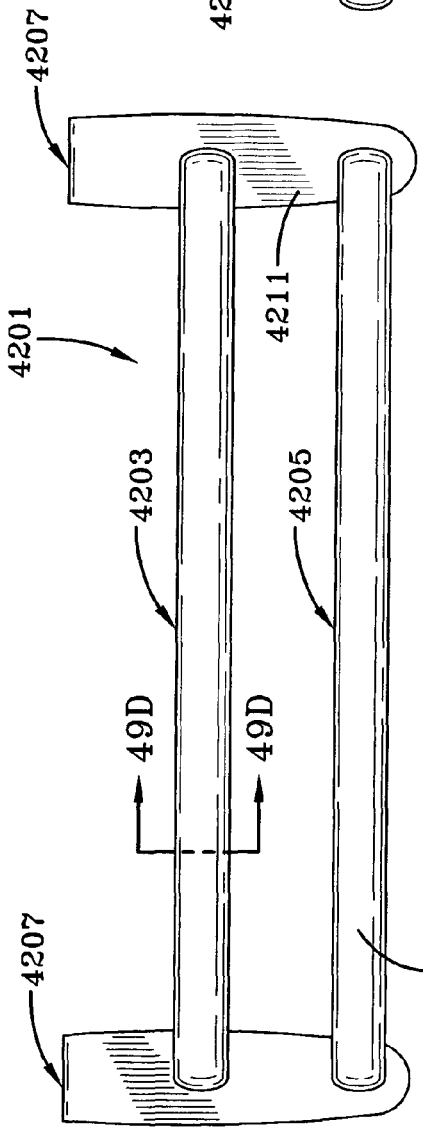

Referring to FIGS. 49A-49C, a double bar towel rack 4201 is depicted. Double bar towel rack 4201 comprises an upper towel bar 4203, a lower towel bar 4205 and opposing over-the-cabinet brackets 4207 (the latter being the stabilizing members). Towel bar 4203 is composed of two slightly, inwardly curved arms 4209 extending generally perpendicularly to a leg 4211 discussed below. An outwardly curved horizontal towel hanging portion 4213 interconnects arms 4209, and provides a rack on which towels or wash cloths could be hung.

Lower towel bar 4205 has similar opposed arms 4215 which are longer than arms 4208 and preferably not curved or not curved as much as arms 4209. Arms 4215 are connected by a towel hanging portion 4217 which interconnects arms 4215, and is parallel to upper towel hanging portion 4203 but spaced outwardly therefrom as shown most clearly in FIG. 49A. Having lower towel bar 4205 extend further out from brackets 4207 than towel bar 4203 makes the towels and washcloths hung on either towel bar easily accessible, and further facilitates the hanging of towels and washcloths on the respective bars 4203 and 4205.

Over-the-cabinet bracket 4207 is composed of relatively long leg 4211, a relatively short leg 4219 and a crosspiece 4221. As in the other over-the-cabinet embodiments of the invention, crosspiece 4221 should be of sufficient length to separate legs 4211 and 4219 sufficiently to enable them to extend across a cabinet door, but not be so extensive as to cause towel rack 4201 to wobble. All of these parts, except for brackets 4207, form the utilitarian member.

Towel bars 4203 and 4205 are made of rods having an oval cross section 4223, with wide surfaces 4225 and narrow surfaces 4227, as indicated in FIG. 49D. Towel bars 4203 and 4205 are oriented so that narrow surfaces 4227 face upwardly and downwardly. This tightens the fold between the towels and washcloths that are hung on the respective towel bars, giving the towels and washcloths on the respective bars more clearance, to make them more accessible and to make adding items to bars 4203 and 4205 easier. A cushioning device such as foam pad 4229 on the rear side of leg 4211 prevents any scratching or other damage to the cabinet door on which double bar towel rack 4201 has been hung. Double bar towel rack 4201 is efficient to use and has a sleek and modern appearance.

Figure 50A:
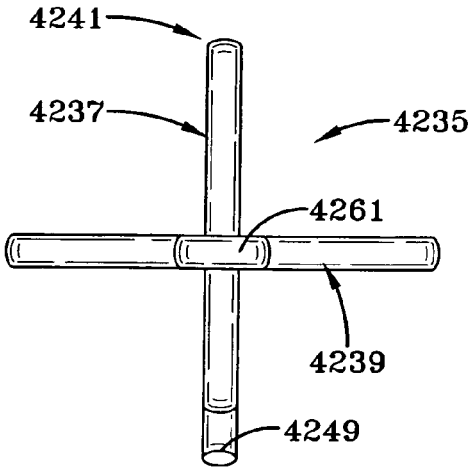
FIGS. 50A, 50B and 50C are top, front and side areas of a paper towel holder stand according to the invention.
Figure 50D:
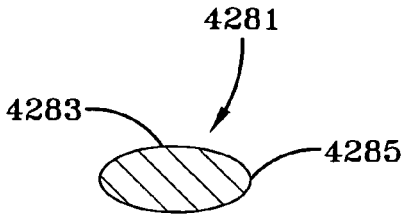
FIG. 50D is taken in the direction 50D-50D.
Figure 50B:
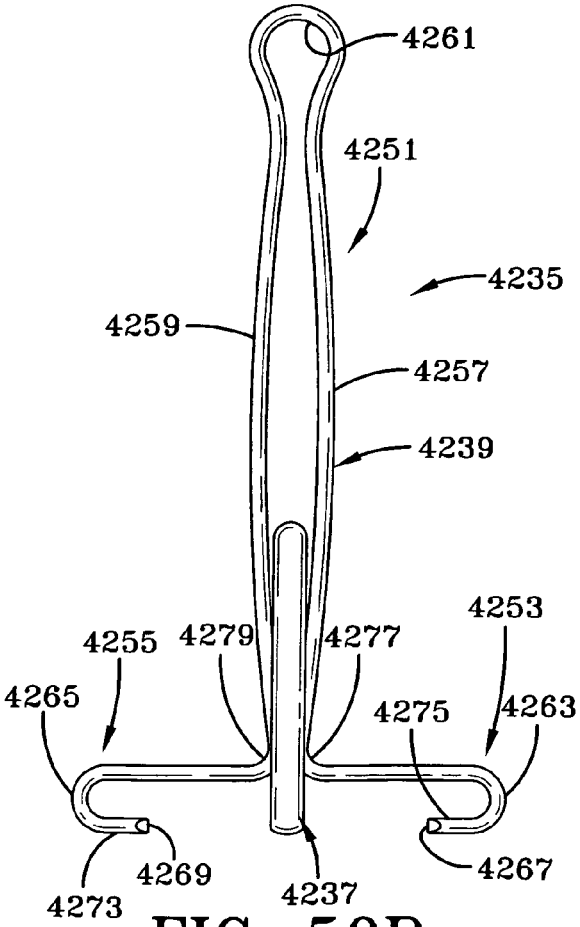
Figure 50C:
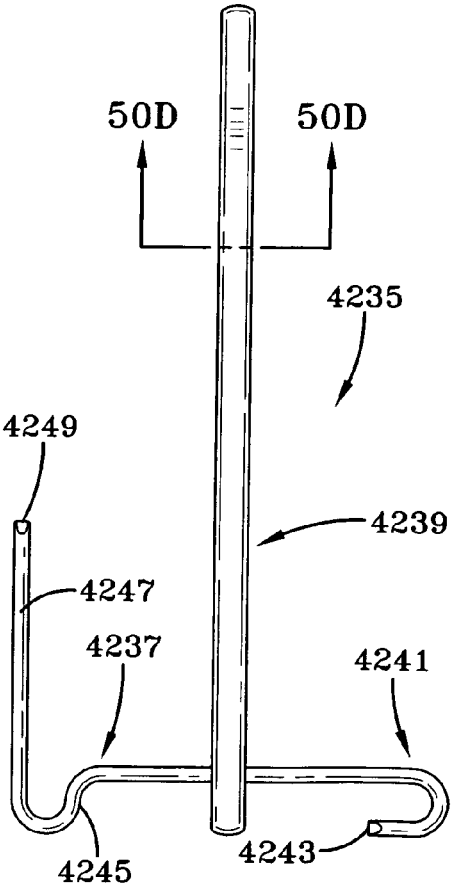

FIGS. 50A-50C illustrate a paper towel holder 4235 according to the invention. Paper towel holder 4235 is composed of two portions, a towel retaining and base portion 4237 and a towel holding and base portion 4239. Towel holding base portion 4237 includes at one end a foot portion 4241 having a downwardly bent portion to form a first foot portion 4243 and another foot portion 4245 at the opposite end having a second foot. Foot portion 4245 has a downward bent second foot form which extends an upstanding leg 4247 ending in a free end 4249. Upstanding leg 4247 is provided for preventing the unwinding of paper towels held on said paper towel holder. Towel retainer foot portion 4239 is another bent metal rod having a towel retainer 4251, and opposing foot portions 4253 and 4255. Towel retainer portion 4239 includes a pair of upstanding slightly outwardly curved legs 4257 and 4259 which curl in towards each other near the upper portion thereof and then diverge to define a keyhole shape opening within a loop portion 4261 which interconnects legs 4257 and 4259 and forms a handle for the unit. Foot portions 4253 and 4255 have curls 4263 and 4265 defining coaxial feet 4273 and 4275 having opposing free ends 4267 and 4269. The underside of foot portions 4241 and 4245, and feet 4273 and 4275, constitute the stabilizing members, and are coplanar and stable, so that when these portions are engaging a ground surface, upstanding leg 4247 and towel retainer 4251 are perpendicular to the ground surface. The remaining components constitute the utilitarian member.

Towel holding base portion 4237 is attached to the inside surfaces of the bottom portions 4277 and 4279 of legs 4257 and 4359 by welding or the like, so that towel holder 4235 is an integral unit.

Towel holding base portion 4237 and towel retaining base portion 4239 are made from bent rods having oval cross sections 4281, the latter having wide surfaces 4283 and narrow surfaces 4285. This is shown in FIG. 50D. Wide surfaces 4283 of element 4247 face the opening between legs 4257 and 4259, and wide surfaces 4283 of legs 4257 and 4259 face each other. Paper towel holder 4235 is sturdy, effective and attractive, with its 3091.

Figure 51A:
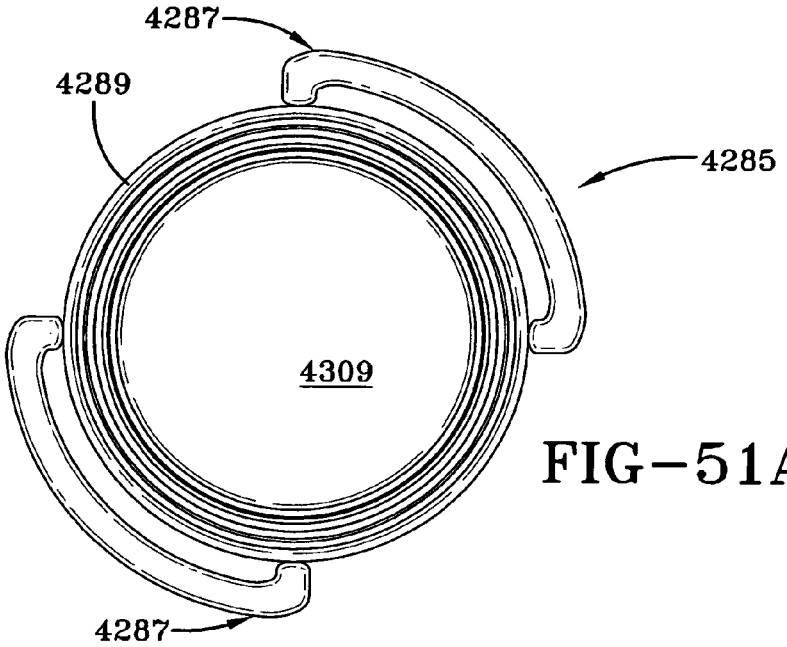
FIGS. 51A and 51B are top and front views of a utensil holder according to the invention.
Figure 51B:
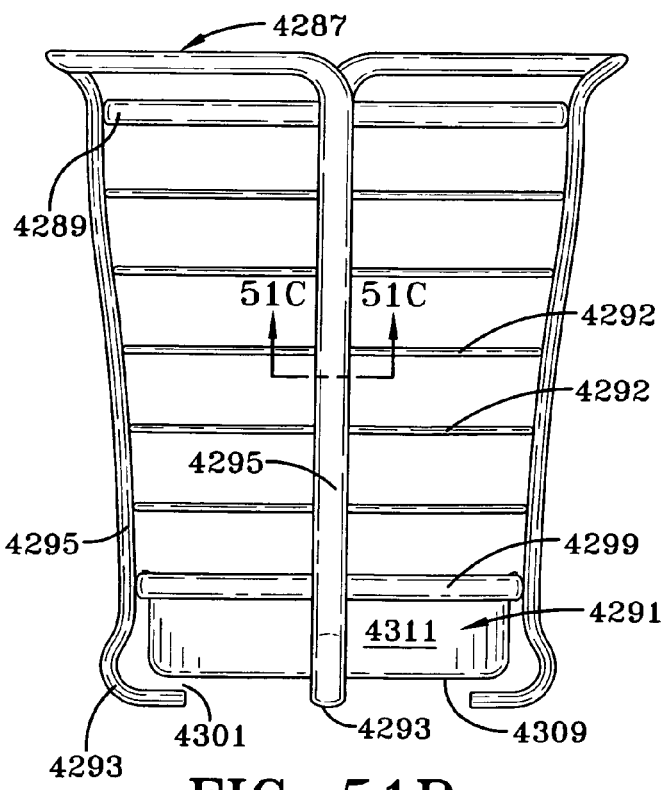

Shown in FIGS. 51A-51B is a utensil holder 4285. Utensil holder 4285 is composed of a pair of handle and foot portions 4287, an upper rim 4289, a bottom retainer 4291 and a set of rings 4292. Handle and foot portions 4287 each include a pair of feet 4293 (forming the stabilizing members) which are curled inwardly towards the longitudinal axis of utensil holder 4285 from a generally upstanding, parallel, opposed pair of legs 4295 which are respectively connected by handle portion 4297 which serves as a crosspiece between legs 4295 of each handle assembly 4287. Upper rim 4289 is welded or otherwise attached to the inner portions of legs 4295 in a horizontal position, leaving enough room beneath handles 4297 to enable them to be manually gripped. Bottom retainer 4291 has a lower rim 4299 which is welded or otherwise attached to the lower portions of legs 4295, lower rim 4299 being parallel with upper rim 4289. The set of rings 4292 are welded or otherwise attached to the inner faces of legs 4295, rings 4292 being concentric with rims 4289 and 4299 and equally spaced from each other and from the respective rims 4289 and 4299. Rim 4299 is welded high enough above feet 4293 to leave a small gap 4301 between feet 4293 and the bottom of retainer 4291. All parts but feet 4293 constitute the utilitarian member.

Figure 51C:
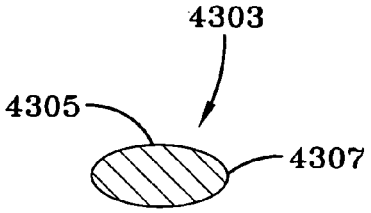
FIG. 51C is taken in the direction 51C-51C.

Handle and foot portions 4287 are each made from a bent rod having an oval cross section 4303, as shown in FIG. 51C. Cross section 4303 has wide surfaces 4305 and narrow surfaces 4307. Wide surfaces 4305 face inwardly for feet portions 4295, upwardly for rings 4293 and transversely for handles 4287. This provides ample area for welding to the respective surfaces, provides support for the feet on the ground surface and provides ergonomic handles for easy handling of the unit. Bottom container 4291 is really a small bowl with a bottom 4309 and sides 4311. In use, one puts utensils such as wooden spoons, wooden forks and other wooden utensils, and the like through the opening defined by upper rim 4289 and rests them on bottom 4309 of container 4291. Utensil holder 4285 is effective in use and attractive, having a sleek and modern appearance.

Figure 52A:
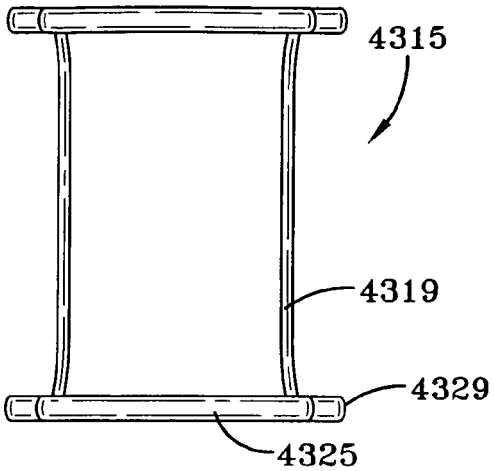
FIGS. 52A, 52B and 52C are top, front and side views of a wine rack according to the invention.
Figure 52D:
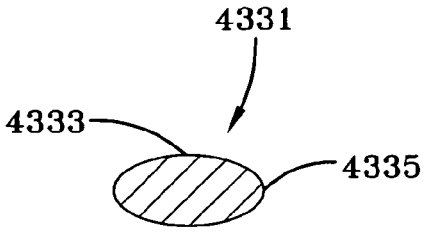
FIGS. 52D and 52E are taken in the direction 52D-52D and 52E-52E.
Figure 52E:
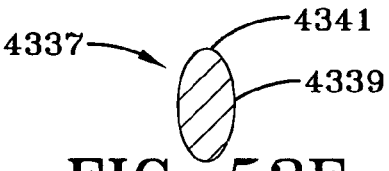
Figure 52B:
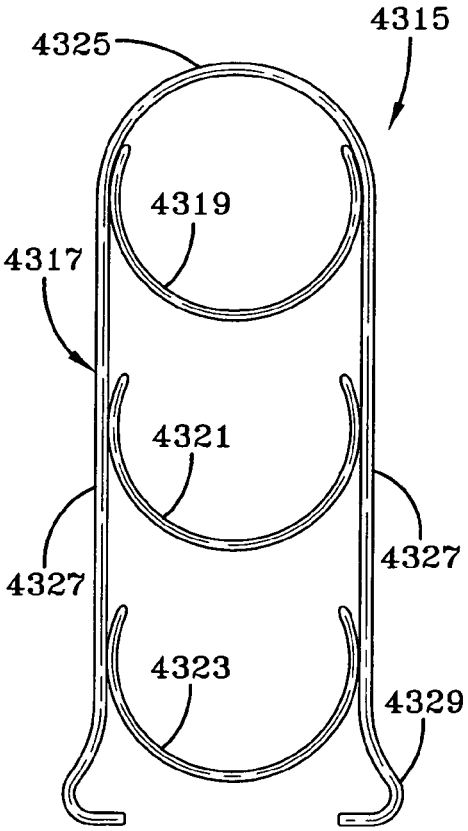
Figure 52C:
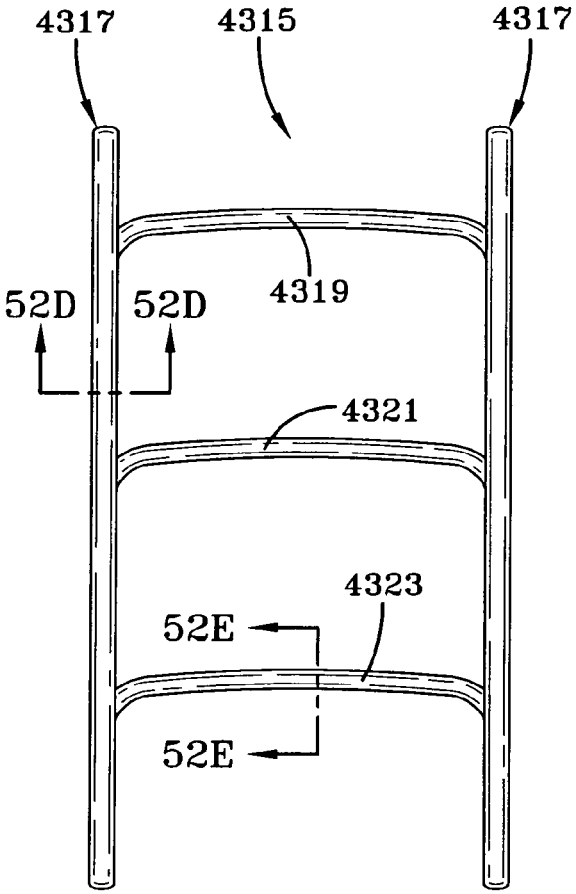

A wine rack or bottle holder 4315 according to the invention is shown in FIGS. 52A-52C. Wine rack 4315 includes a pair of outer support members 4317 and an upper bottle holder 4319, a middle bottle holder 4321 and a bottom bottle holder 4323. Each outer support member 4317 includes a top portion 4325, a pair of opposing side portions 4327 and bent foot portions 4329. The latter constitute the stabilizing members; the remaining parts constitute the utilitarian member. Bottle holders 4319, 4321 and 4323 are welded or otherwise attached to the inside surfaces of side portions 4327 of outer support members 4317. Bottle holders 4319, 4321 and 4323 have a radius which is larger than the typical wine bottle to be held by wine rack 4315 to enable bottles to be easily inserted and withdrawn from the respective bottle holders. Each of outer support members 4317 and bottle holders 4319, 4321 and 4323 are made from bent rods having an oval cross section. Outer support members 4317 have a cross section 4331 shown in FIG. 52D. Cross section 4331 has wide surfaces 4333 and narrow surfaces 4335. The oval shaped rods of which bottle holders 4319, 4321 and 4323 are constructed have a cross-sectional configuration 4337 shown in FIG. 52E, having wide surfaces 4339 and narrow surfaces 4341. Cross-sectional surface area 4331 is larger than the area of cross-sectional surface 4337. Wide surfaces 4333 of outer support members 4317 face wide surfaces 4339 of bottle holders 4319, 4321 and 4323, providing relatively large areas for the welding to take place. Furthermore, since wide surfaces 4333 would be engaged by bottles inserted in the respective bottle holders 4319, 4321 and 4323, the distribution of force on each bottle is spread out over what would have been applied if narrow surfaces 4341 engaged the bottle, decreasing the risk of any breakage.

Bottle holder 4315 is a very sturdy and stable unit. It has an attractive appearance, and could be displayed in one's home because of its aesthetic, sleek and modern appearance.

Figure 53A:
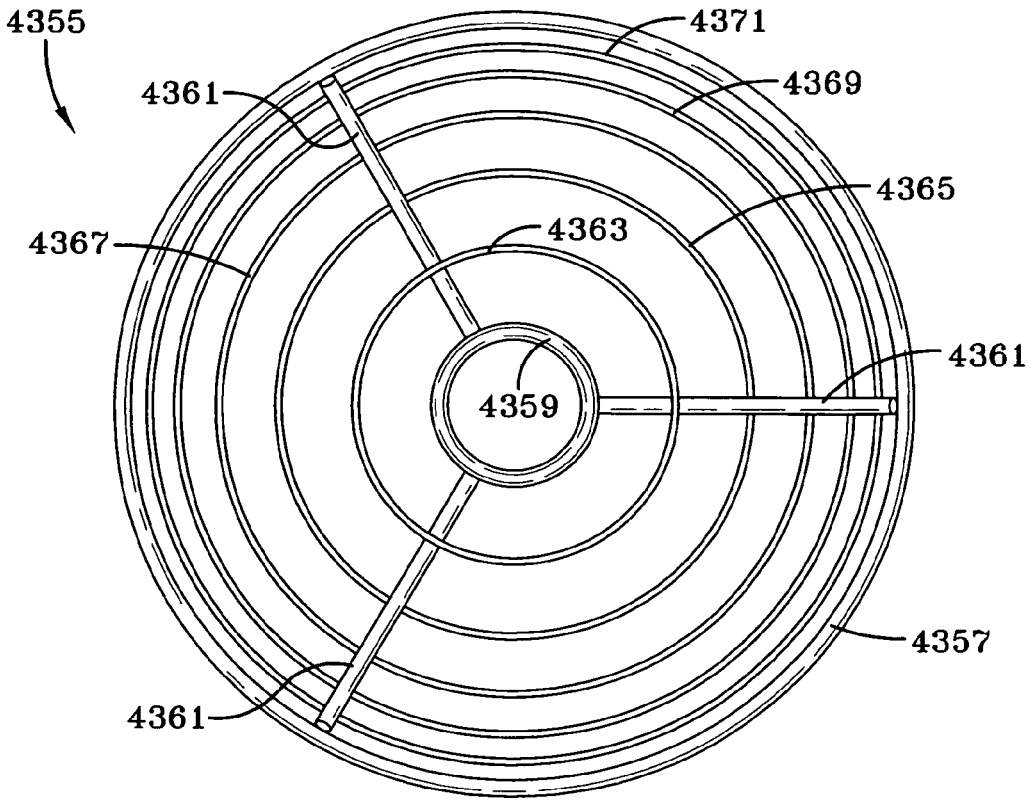
FIGS. 53A and 53B are top and front views of a fruit bowl according to the invention.
Figure 53B:
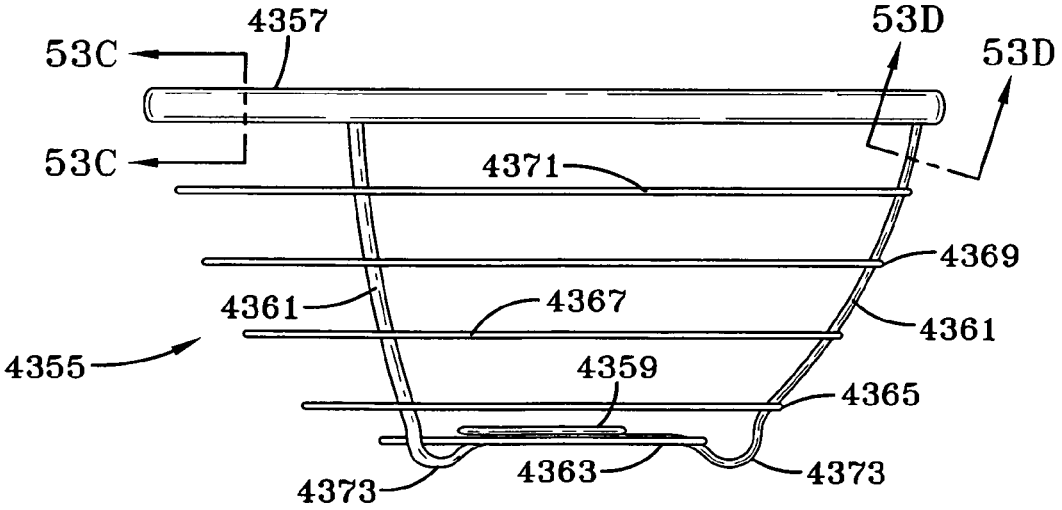

A bowl 4355, which could be a fruit bowl, is shown in FIGS. 53A and 53B. Bowl 4355 includes an upper circular rim 4357, a bottom circular rim 4359, three curved foot and side pieces 4361 which are welded or otherwise attached to lower rim 4359 and to upper rim 4357. Pieces 4361 are equiangularly spaced around lower rim 4359, and their respective curves—which are identical—define the inside shape of bowl 4355. A set of concentric rings, including in order of size from the smallest to the biggest 4363, 4365, 4367, 4369 and 4371. Rings 4363, 4365, 4367, 4369 and 4371 are welded to the outside of respective side pieces 4361 in a concentric, equally-spaced relationship to provide a bowl which is symmetric in shape. Pieces 4361 are bent at their lower portions to define feet 4373 for engaging a ground surface, and form the stabilizing member (the other parts form the utilitarian member). In the embodiment shown, three side pieces 4361 with their respective feet 4373 is shown which provides stability to bowl 4355.

Figure 53C:
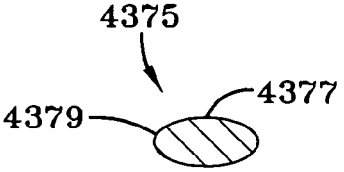
FIGS. 53C and 53D are taken in the direction 53C-53C and 53D-53D.
Figure 53D:
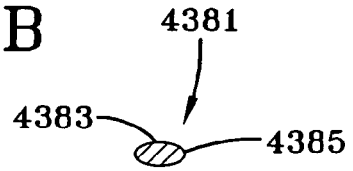

Rim 4357 has a oval cross section 4375 with wide surfaces 4377 and narrow surfaces 4379. See FIG. 53C. Wide surfaces 4377 face inwardly towards the bowl, with narrow surfaces 4379 facing vertically upwardly and vertically downwardly. Foot and side pieces 4361 have an oval cross section 4381 with wide surfaces 4383 and narrow surfaces 4385. This is shown in FIG. 53D. Cross section 4375 is larger than cross section 4381. Wide surfaces 4383 face the inside as do wide surfaces 4377, providing a relatively wide surface area for welding and to present wide surfaces for engagement by any fruit or other items placed in bowl 4355. Lower rim 4359 has the same cross section as members 4361, and wide surfaces 4383 for each of members 4361 and 4359 face each other to provide a relatively wide surface for welding.

Bowl 4355 is a sturdy bowl attractive in appearance, because it is sleek and modem. It could be used as a fruit bowl or the like, to hold any items that would fall through the concentric rings or through the bottom of bowl 4355.

Figure 54D:
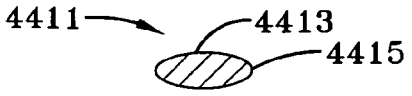
FIGS. 54D and 54E are taken in the direction 54D-54D and 54E-54E.
Figure 54E:
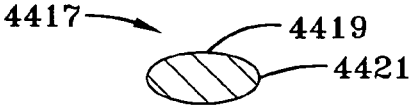
Figure 54A:
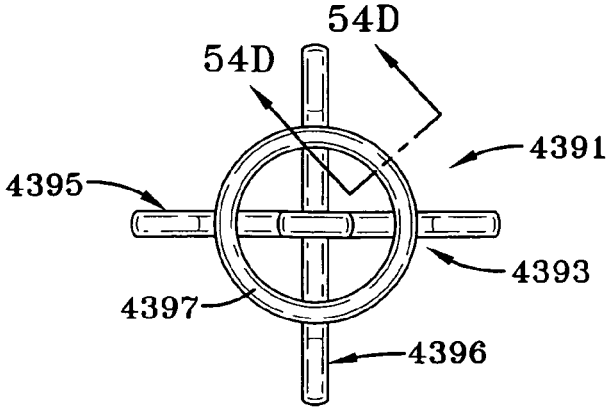
FIGS. 54A, 54B and 54C are top, front and side views of a paper towel holder stand according to the invention.
Figure 54C:
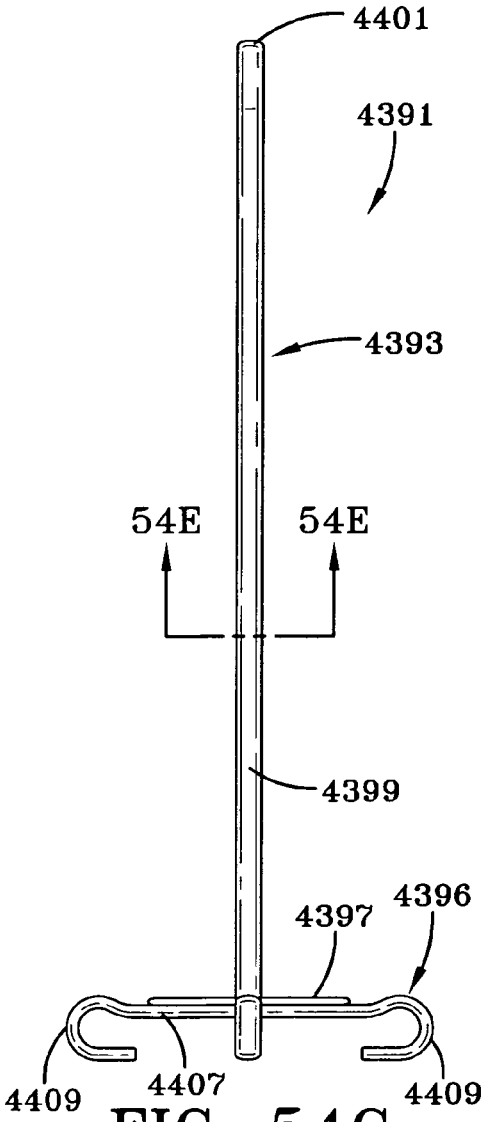
Figure 54B:
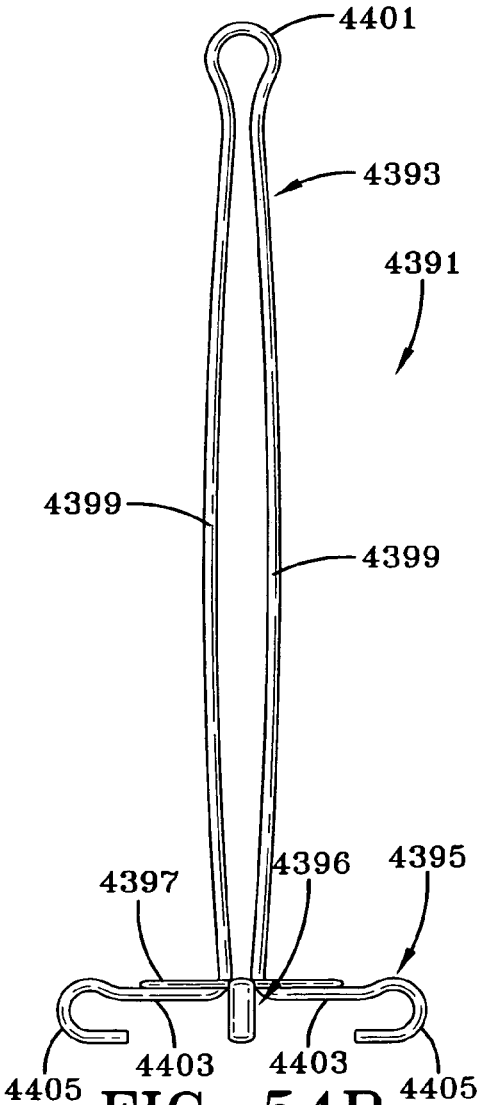

FIG. 54A-54C depict a toilet tissue roll stand 4391. Stand 4391 includes a roll holder and foot unit 4393, a foot member 4395 and a roll support member 4397. Roll holder and foot unit 4393 includes a pair of vertically disposed, opposing leg members 4399 which are joined together at their upper end by an upper portion 4401. Legs 4399 at their respective bases are bent in oppositely directed horizontal directions to form arms 4403, which extend outwardly and are curled under themselves to form feet 4405. A foot member 4396 has a straight portion 4407 which is bent under itself to form opposing feet 4409. The bottoms of feet 4409 are coplanar with the bottoms of feet 4405 so that legs 4399 will be perpendicular to the flat ground surface upon which roll stand 4391 is disposed. These feet 4405, 4409 form the stabilizing members; the remaining parts form the utilitarian member. Straight portion 4407 is welded to the bottom portions of legs 4399 where they nearly converge at their bottom portion. Roll support member 4397 has a generally circular configuration as shown in FIG. 54A, and it is welded to the upper surface of straight portions 4403 and 4407. The rod of which roll support member 4397 is composed has an oval cross section 4411, shown in FIG. 54D, with wide surfaces 4413 and narrow surfaces 4415. The other parts of roll support member 4397 have an oval cross section 4417 as shown in FIG. 54E, with wide surfaces 4419 and narrow surfaces 4421. Wide surfaces 4413 engage wide surfaces 4419 at the resting place for roll support member 4397, providing a broad area for the weld to take place, or for any other attachment means.

In use, one slides one or more toilet paper rolls down roll holder and foot member 4393 with wide surfaces 4419 of legs 4399 engaging the respective rolls. One removes the rolls by simply reversing this process. Roll holder 4391 is efficient and effective in operation, and attractive to view because it looks sleek and modem.

Figure 55D:
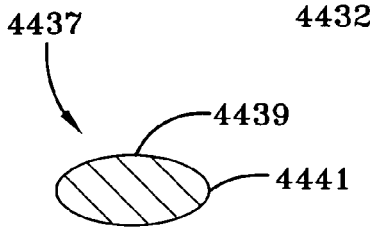
FIG. 55D is taken in the direction 55D-55D.
Figure 55A:
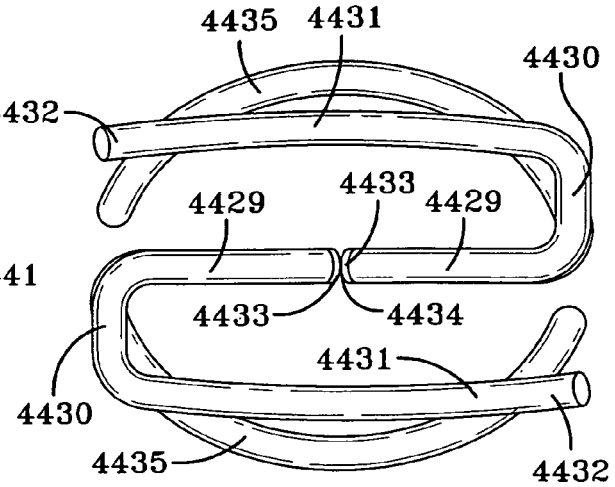
FIGS. 55A, 55B and SSC are top, front and side views of a finger tip towel holder according to the invention.
Figure 55C:
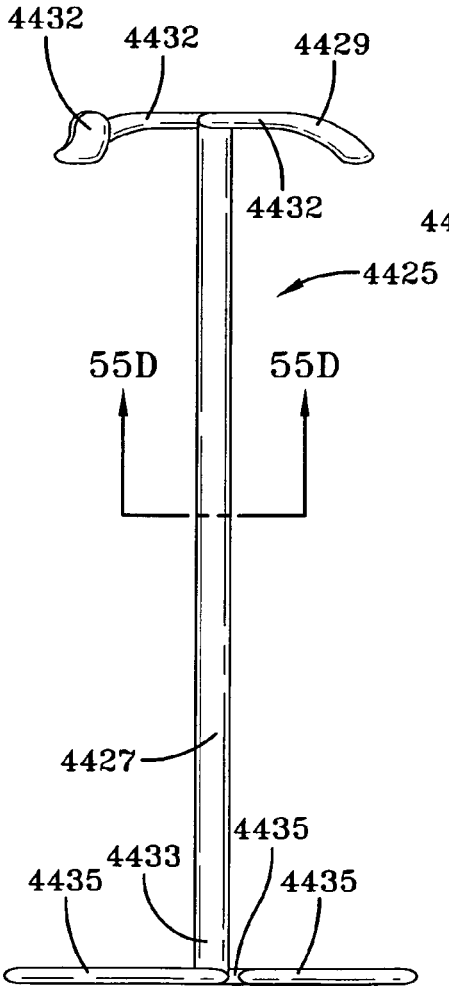
Figure 55B:
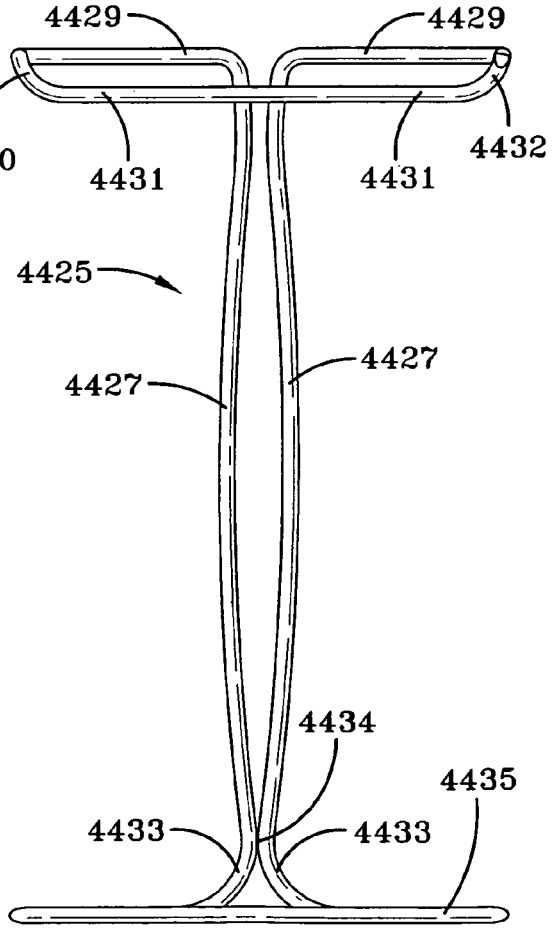

A sleek and modern fingertip towel holder 4425 is shown in FIGS. 55A-55C. Towel holder 4425 has a pair of generally vertical legs 4427 which are welded together at their base, are curved slightly outwardly at their intermediary portion and are close to each other at their top. The upper end of each of legs 4427 are bent slightly outwardly at their respective tops, and then are bent a second time at about right angles to form a pair of arms 4429, which extend in opposite directions. Arms 4429 are bent respectively about 90° towards downwardly inclined crosspieces 4430, and crosspieces 4430 are bent by about 90° to form towel holders 4431, one towel holder 4431 being on one side of legs 4427 and the other being on the other side of legs 4427 as shown in FIG. 55A. Each towel holder 4431 terminates in an upwardly turned retainer 4432. Legs 4427 meet at their adjacent lower parts 4433, where they are attached by a weld 4434, and then extend outwardly to form one of a pair of feet extending in opposite directions immediately beneath arms 4429 shown in FIG. 56A, which are bent into one of a pair of curved foot members 4435. The stabilizing member is constituted by the foregoing pair of feet and the curved foot members 4435 (the remaining parts form the utilitarian member). Towel holder 4425 is formed from a metal rod having an oval cross section 4437 shown in FIG. 55D, with wide surfaces 4439 and narrow surfaces 4441. Wide surfaces 4439 of towel arms 4429 and towel holders 4431 face upwardly and towels can be placed on either of towel holders 4431 for storage, and easy access or removal. The feet and each foot 4435 bent therefrom are very stable so that towel holder 4425 is very functional and not likely to tip over. Towel holder 4425 is a very attractive device, sleek and modern in appearance.

Figure 56A:
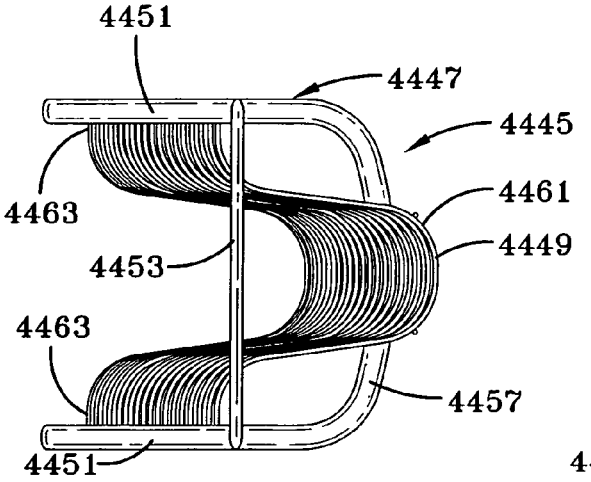
FIGS. 56A, 56B and 56C are top, front and side views of a CD holder according to the invention.
Figure 56D:
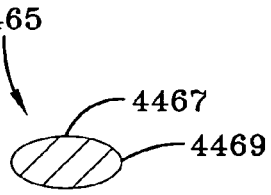
FIG. 56D is taken in the direction 56D-56D.
Figure 56B:
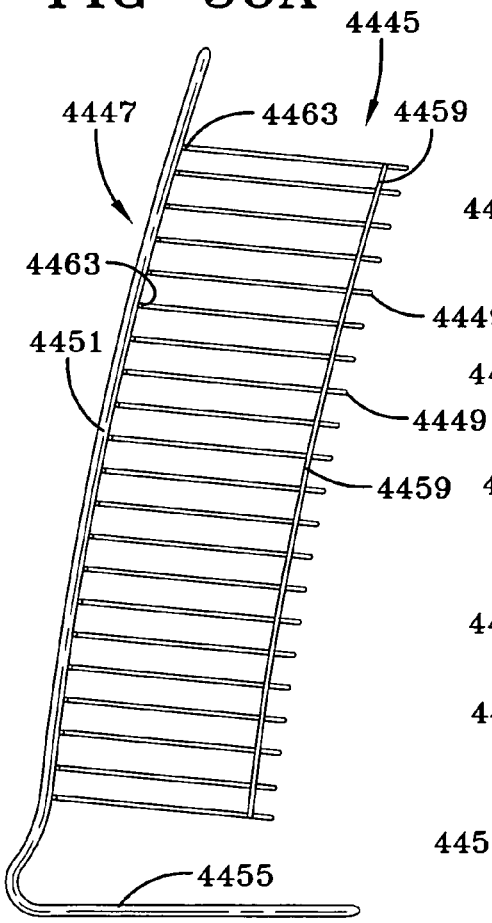
Figure 56C:
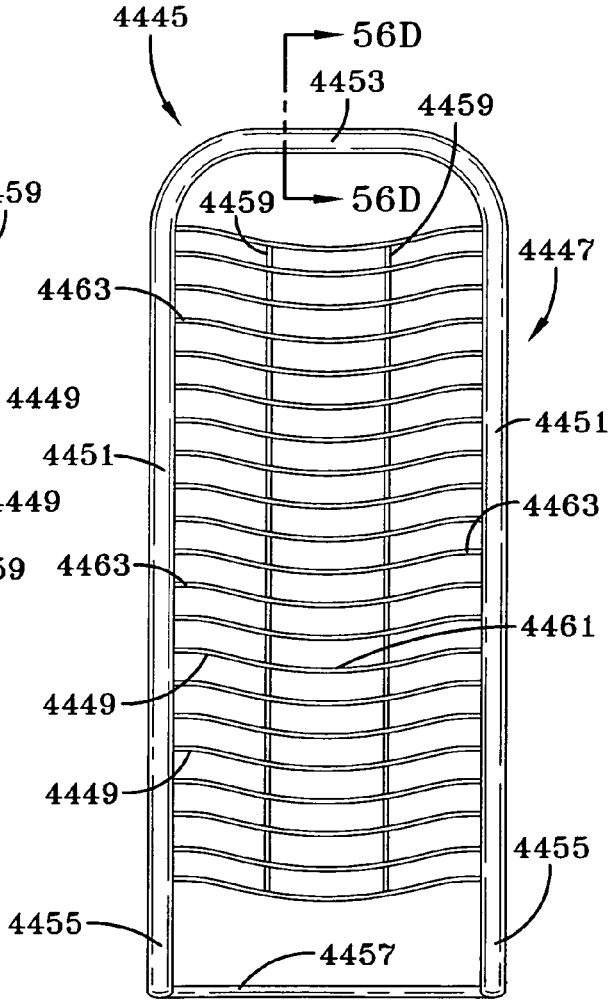

Referring next to FIGS. 56A-56C, a CD holder 4445 is shown. CD holder 4445 includes a frame and foot member 4447, and a set of wire forms 4449 in the shape of a sine wave. Frame and foot member 4447 is composed of a pair of parallel, opposing sides 4451 which are joined together at their upper ends by an integral crosspiece 4453. Legs 4451 are curled at each of their lower ends and bent rearwardly to form a set of parallel feet 4455, which are in turn joined by a crosspiece 4457 which also forms part of a foot assembly, the latter being a stabilizing member. Crosspiece 4457 is curved backwardly as shown in FIG. 56A to add to the stability of CD holder 4445. A pair of parallel, straight rods 4459 are provided on opposite sides of the set of upstanding wave portions 4461 of wire forms 4449. Wire forms 4449 have opposite ends 4463 which are preferably welded or otherwise attached to legs 4451 equidistantly along the length of the respective legs 4451. Legs 4451 are tilted somewhat backwardly; that is they make an angle with a vertical plane running through the lower end of arms 4451 to retain CDs between adjacent wire forms. Wire forms 4449 are cylindrical in cross section. Frame and foot member 4447 has an oval cross section 4465 with wide surfaces 4467 and narrow surfaces 4469. This is illustrated in FIG. 56D. Wide surfaces 4467 face downwardly in feet 4455 and crosspiece 4457 to increase the surface area of contact of feet 4455 against a ground surface, to help stabilize CD holder 4445. Longitudinal members 4459 preferably are oval in cross section, although the area of the cross section of longitudinal members 4459 is preferably less than the area of cross section 4467. Since an oval cross section for rods 4459 presents a wide surface to which wire forms 4449 can abut, it can be more easily welded to rods 4459 than would a cylindrical surface. Additionally, CD covers engage the wide surface of members 4459, providing a more stable engagement than would narrow surfaces.

All of the foregoing components, other than the foot assembly, constitute a utilitarian member. CD holder 4445 is attractive to look at and easy to use, and provides a stable storing place for CDs. It offers a pleasing, sleek and modern appearance.

Figure 57D:
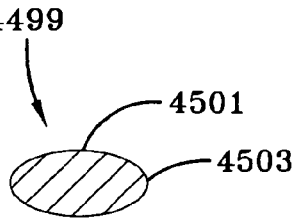
FIG. 57D is taken in the direction 57D-57D.
Figure 57A:
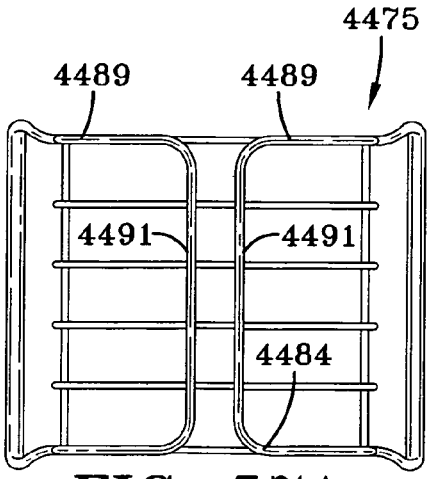
FIGS. 57A, 57B and 57C are top, front and side views of a CD/DVD holder according to the invention.
Figure 57C:
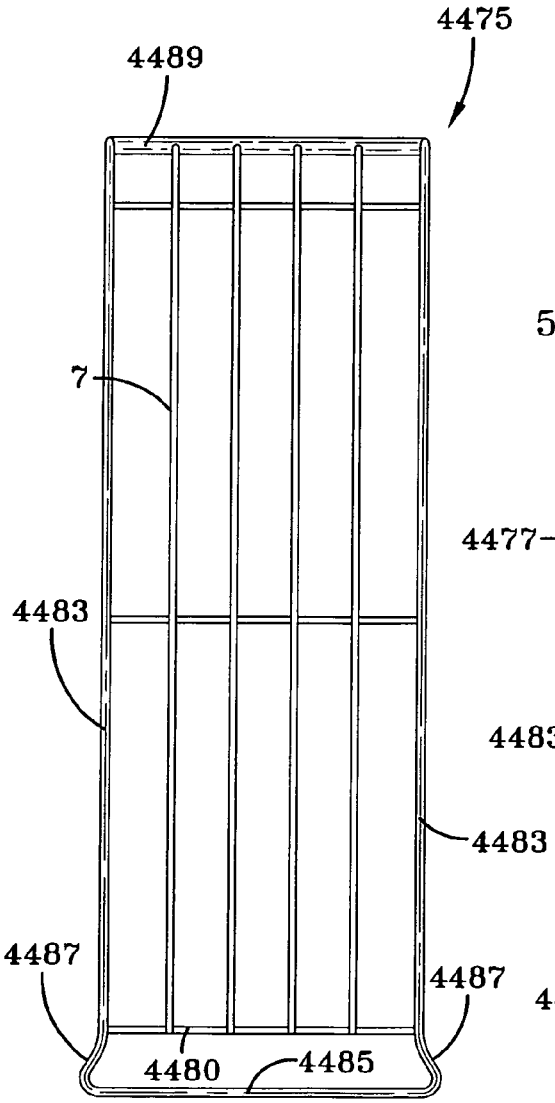
Figure 57B:
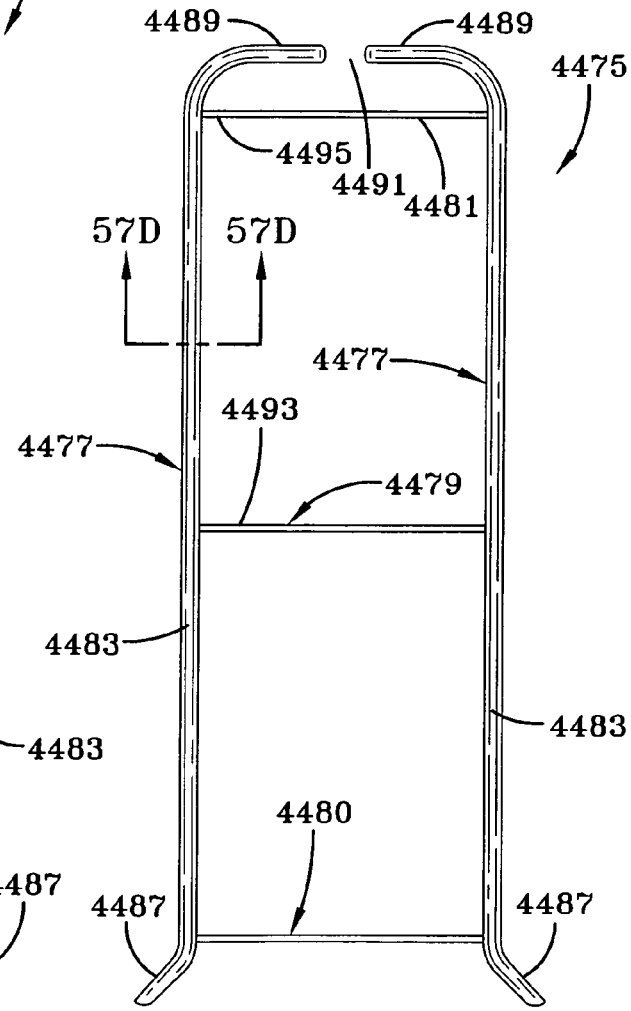

A CD/DVD holder 4475 is depicted in FIG. 57A-57C. CD/DVD holder 4475 is composed of a pair of frames 4477, a pair of shelves 4479, 4480, and a ceiling 4481. Each frame 4477 includes two pairs of corner legs 4483 which are connected together on each side at their bottom portions by a crosspiece 4485 bent from a pair of opposed, outward bottom bends 4487, forming stabilizing units. The upper portion of each of four corner legs 4483 are bent inwardly partially over the top of CD/DVD holder 4475 by side-roof portions 4489 which are then bent to form a roof crosspiece 4491 as shown in FIG. 57A.

Each shelf 4479, 4480 is composed of cylindrical rods or wires 4493, as is ceiling 4481, to a set of cylindrical rods or wires 4495, also circular in cross section, forming the ends of shelves 4479, 4480. Frames 4447 extend vertically between each of corner legs 4483, and are connected at their lower ends to lower cabinet 4480 and each of roof crosspieces 4491 to form a pair of opposing side walls and part of side roof portions 4489.

CDs or DVDs are stored on each of shelves 4479 and 4480. The CDs or DVDs can be stacked horizontally on the respective shelves, or placed vertically, as in a book shelf. Corner legs 4483 and frames 4447, along with shelves 4479 and 4480 should be dimensioned so that at least the CDs could be stacked horizontally on the respective shelves, and DVDs could be placed vertically on the respective shelves as books would be on a book shelf.

Frames 4447 prevent CDs or DVDs from falling from or being knocked off from, respective shelves 4479 and 4480. The utilitarian member is composed of the foregoing components other than bottom bends 4487.

The rod forming frame 4477 has an oval cross section 4499 as shown in FIG. 57D, with wide surfaces 4501 and narrow surfaces 4503. It is preferred that frame 4477 be configured so that narrow surfaces 4503 are arranged so that narrow surfaces 4503 face the respective shelves 4479 and 4480. CD/DVD holder 4475 is effective in use and aesthetic due to its sleek and modern appearance.

Figure 58D:
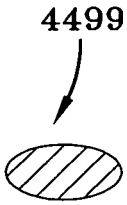
FIG. 58D is taken in the direction 58D-58D.
Figure 58A:
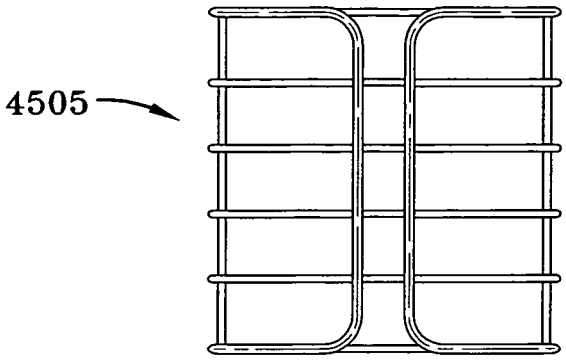
FIGS. 58A, 58B and 58C are top, front and side views of a CD/DVD holder according to the invention.
Figure 58C:
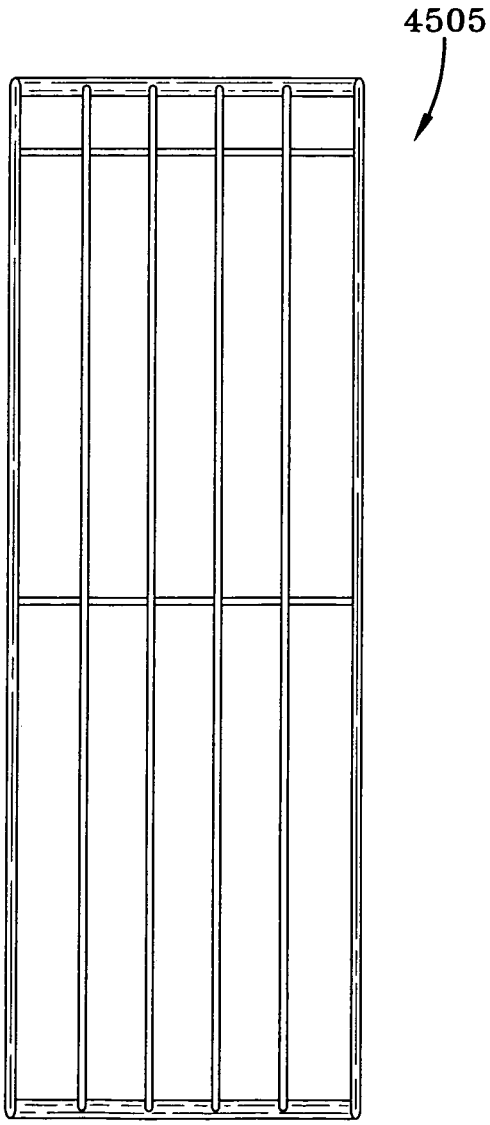
Figure 58B:
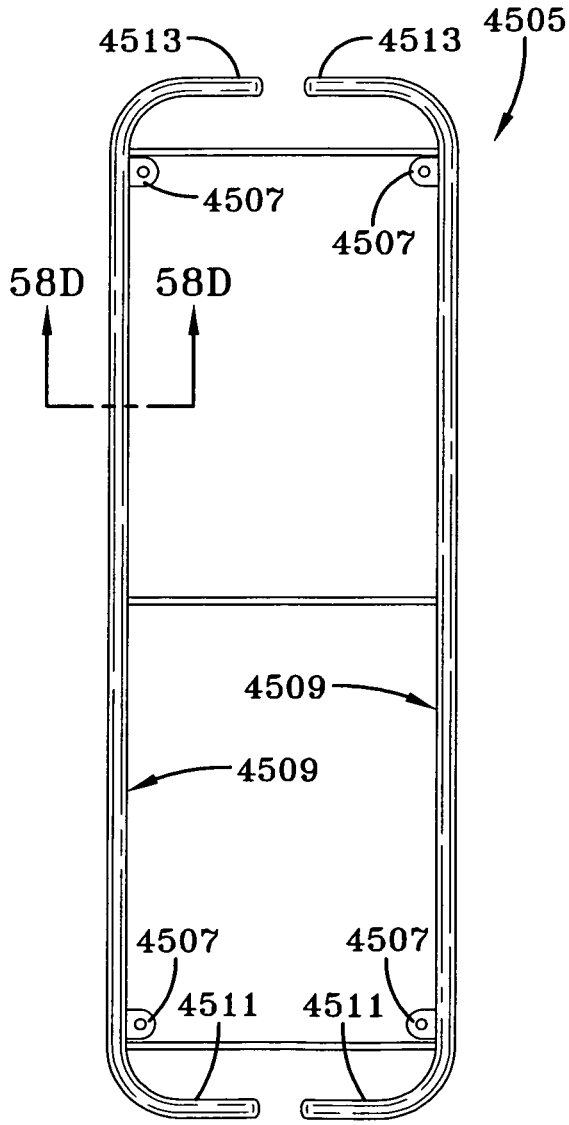

A sleek and modem CD/DVD holder 4505 is shown in FIGS. 58A-58C. CD/DVD holder 4505 is adapted to be mounted to a wall, and is provided with fastener brackets 4507 (the stabilizing members) at the rear of CD/DVD holder 4505 as shown in FIG. 58B, for receiving screws, nails or the like to attach holder 4505 to a wall or other vertical support. Since holder 4505 is mounted to a wall, it does not need supporting feet. Holder 4505 has two pair of corner legs 4509 which are bent to form base portions 4511 to match roof portions 4513 which are identical to roof portions 4489 shown and described with respect to FIGS. 57A-57C. All but brackets 4507 constitute the utilitarian member. The remainder of CD/DVD holder 4505 is virtually identical with CD/DVD holder 4475, and references made to FIGS. 57A-57D for a description of holder 4505 and its respective components.

Figure 59:
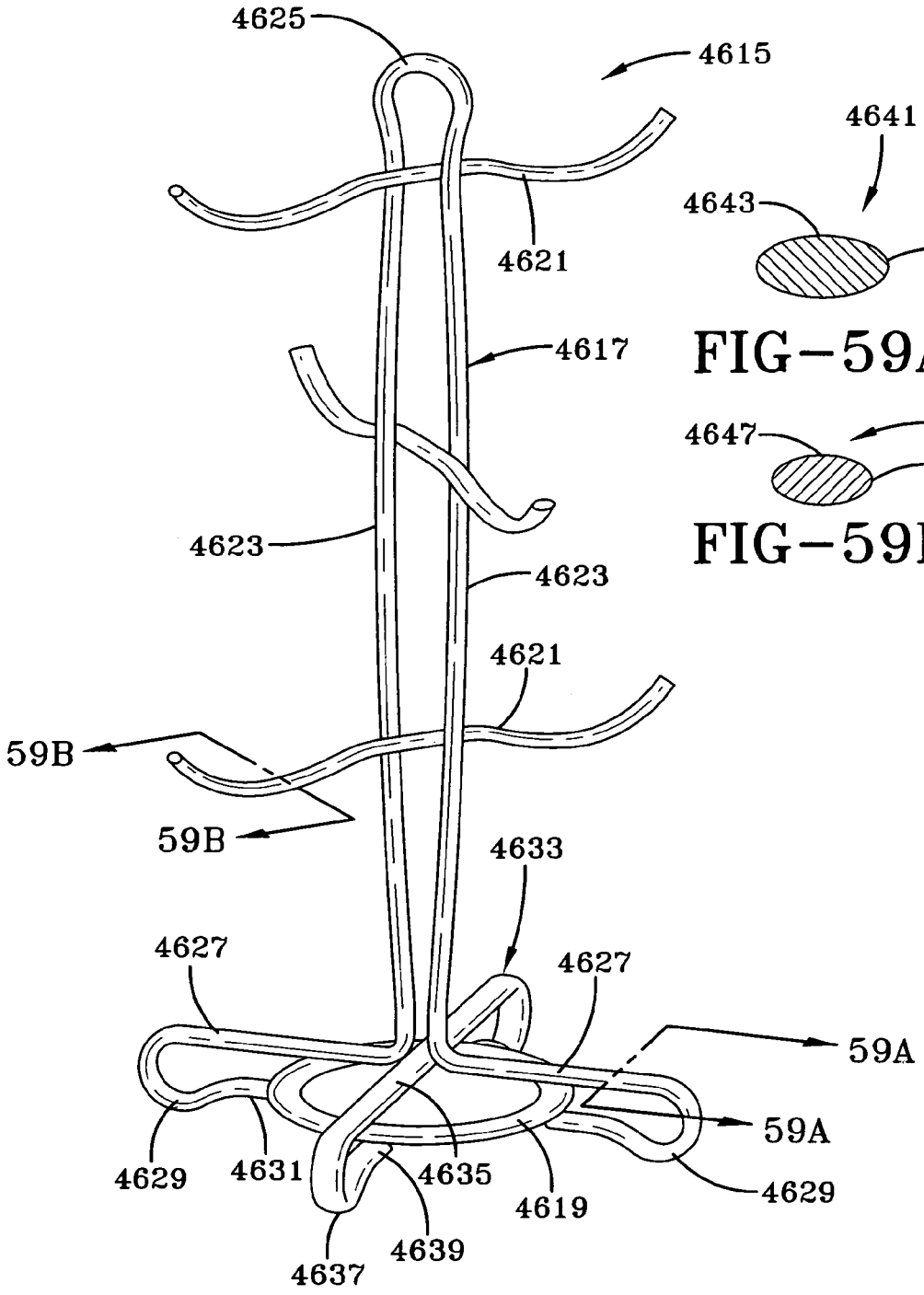
FIG. 59 is a perspective view of a mug holder according to the invention.

A mug holder according to the invention is shown in FIG. 59. Mug holder 4615 includes a foot and vertical support member 4617, a connecting annulus 4619 and a set of mug supports 4621. Foot and support member 4617 includes a pair of upstanding, spaced apart and opposing legs 4623 which are joined together at their upper ends by a rounded crosspiece 4625. Legs 4623 are spaced fairly close at their upper parts, spaces apart in their intermediate portions, and are close together at their base. The lower portion of legs 4623 are bent out at nearly right angles to form arm portions 4627. Arm portions 4627 bend over to form feet 4629, and then are bent back upwardly to form connecting arms 4631. A foot member 4633 includes a connecting member 4635. The ends of connecting member 4635 are bent over to form a second pair of feet 4637, which are bent up to form another pair of connecting arms 4639. Feet 4639 and 4637 form the stabilizing members. Connecting arms 4631 and 4639 are attached by welding or the like to the underside of connecting member 4619. Mug supports 4621 are slid between respective legs 4623 and attached to the respective legs by welding or another attaching means. All parts but feet 4629, 4637 constitute the utilitarian member. To use mug holder 4615, one simply slides the handle of a mug or other coffee cup or the like, onto the free end of one of support members 4621.

Figure 59A:
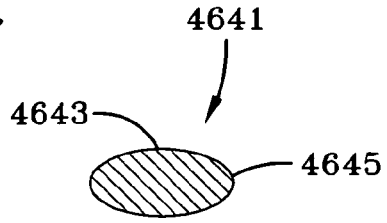
FIGS. 59A and 59B are taken in the respective directions 59A-59A and 59B-59B.
Figure 59B:
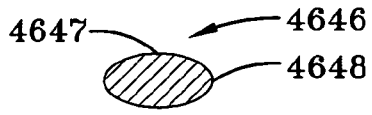

Foot and support member 4617 and connecting member 4619 have an oval cross section 4641 having wide surfaces 4643 and narrow surfaces 4645, as revealed in FIG. 59A. The rod from which member 4617 is formed has wide surfaces 4643 facing upwardly and downwardly when the lower portion of member 4617 is considered, which provides a broad base for each of feet 4629 and 4637 to rest upon a ground surface, for increasing the contact area and decreasing the likelihood mug holder 4615 damaging the ground surface. Furthermore, this provides broad surfaces for the welding between connecting members 4631 and 4639 to connecting member 4619, the latter also having cross section 4641. Mug supports 4621 have a cross section 4645, with wide surfaces 4647 and narrow surfaces 4648. See FIG. 59 B. Cross-sectional area 4645 is smaller than cross-sectional area 4641. Wide surfaces 4647 face upwardly for each of support arms 4621 to increase the area of contact with the handles of a mug or the like held on mug supports 4621.

Mug holder 4615 is of sturdy construction, stable and sleek and modern—and therefore attractive. Its length could increase or decrease, particularly if further or few mug supports 4621 would be incorporated in the unit.

Figure 60:
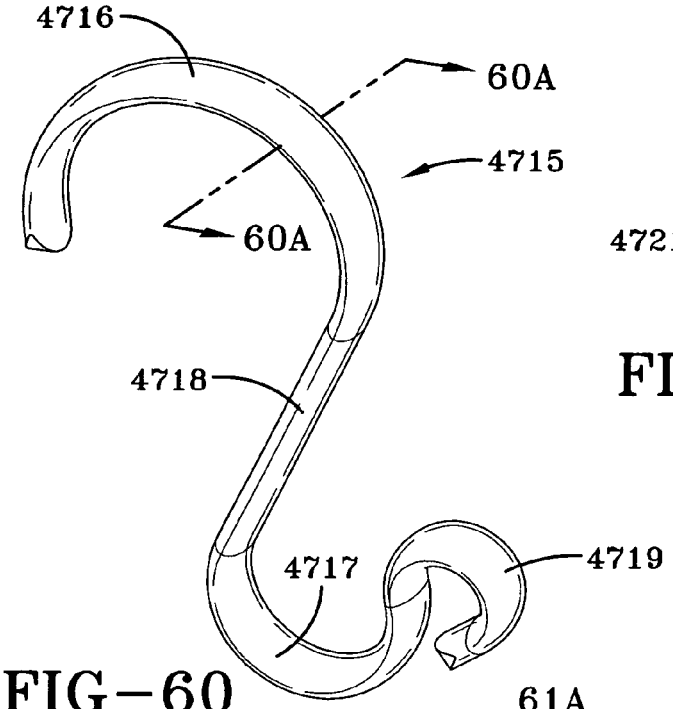
FIG. 60 is a perspective view of a shower hook according to the invention.
Figure 60A:
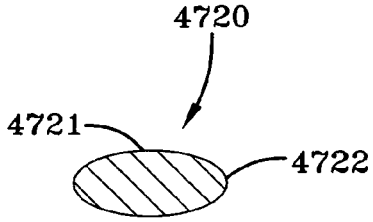
FIG. 60A is a view taken in the direction 60A-60A.

A shower curtain loop hook 4715 is shown in FIG. 60. Shower curtain loop hook 4715 includes a large looped portion 4716 (the stabilizing member), open downwardly as shown, for going over a shower curtain holding bar, looped portion 4716 being open on its downward side, a smaller loop 4719 for receiving a shower curtain by virtue of it being received by a hole in the curtain, a straight interconnecting portion 4718, an interconnecting loop 4717, opens upwardly, for receiving and holding a shower curtain (with the assistance of other curtain look hooks), with loop 4719 impeding the withdrawal of a shower curtain from loop 4417. The foregoing loops are the utilitarian member. Shower curtain loop hook 4715 has an oval cross section 4720 shown in FIG. 60A, having wide surfaces 4721 and narrow surfaces 4722. Wide surfaces 4721 are horizontal and run generally concentrically along the longitudinal axis of the shower curtain bar on which the shower curtain is to be used. Thus, wide surfaces 4721 engage the shower curtain bar for spreading out the force exerted by the bar on interconnecting loop 4717, to render loop 4717 stable when, in connection with other loop hooks, it holds a shower curtain suspended thereon. Shower curtain loop hook is efficient and effective in use, and attractive because of its sleekness and modern appearance.

Figure 61A:
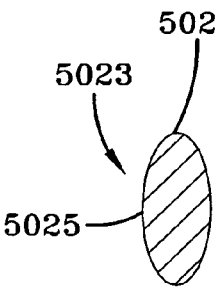
FIG. 61A is taken in the direction 61A-61A.
Figure 61:
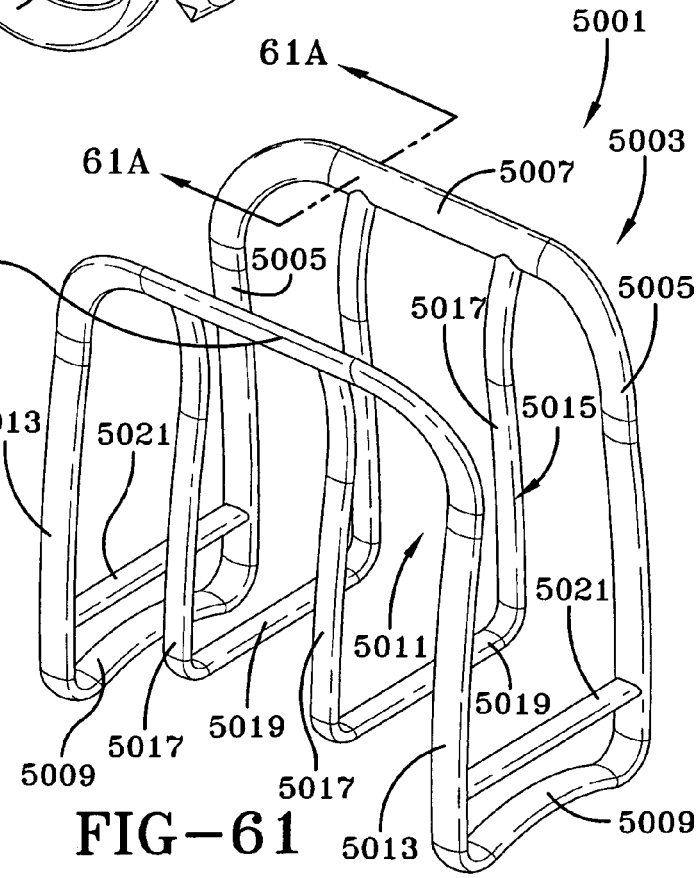
FIG. 61 is a perspective of a napkin holder according to the invention.

A napkin holder 5001 according to another embodiment of the invention, in shown in FIG. 61. Napkin holder 5001 is made of a bent rod comprising a three-sided portion 5003 with a pair of upstanding legs 5005 which are connected together by an integral interconnecting piece 5007. Legs 5005 are generally perpendicular to interconnecting piece 5007. A pair of feet 5009 are provided at the base of legs 5005, feet 5009 being bowed at an intermediary portion, but having ground engaging portions (forming the stabilizing members) at the opposite ends of each foot 5009. A second three-sided portion 5011, opposite to end portion 5003, extends upwardly from each of feet 5009. Three-sided portion 5011 has a pair of upstanding legs 5013 which are parallel and opposed to each other, and are further generally parallel with and opposed to, legs 5005. Legs 5013 are connected at their upper ends by a generally perpendicular integral interconnecting piece 5014. Legs 5013 are somewhat shorter than legs 5005, and three-side portion 5011 is tipped slightly towards three-sided portion 5003 to help compress napkins held by napkin holder 5001 to prevent their inadvertent removal. Three sided portions 5003 and 5011, and feet 5009, are an integral unit.

Napkin holder 5001 further includes a pair of U-shaped sections 5015, each having a pair of generally vertical legs 5017 which are connected at their upper ends to interconnecting pieces 5007 and connected to each other at their lower ends by integral crosspieces 5019. Legs 5017 are shorter than upstanding legs 5005 and 5013 so that crosspieces 5019 are above the lowermost surfaces of a feet 5009. Another crosspiece 5021 extends between upstanding legs 5005 and 5013 so as to be generally coplanar with crosspieces 5019. Thus, crosspieces 5019 and 5021 generally define a horizontal plane. Crosspieces 5021 are welded to opposing upstanding legs 5005 and 5013. All but the ground engaging portions establish the utilitarian member. Every component of napkin holder 5001 has an oval cross section 5023 with wide surfaces 5025 and narrow surfaces 5027, as shown in FIG. 61A.

Napkins are placed with their edges facing crosspieces 5019 and 5021, and are held on their edges between three-sided pieces 5003 and 5011. Napkins can be added to or removed from napkin holder 5001 by simply inserting them between three-sided pieces 5003 and 5011.

Napkin holder 5001 is sturdy, effective in use and has a sleek, modem look.

Figures 62, 62A:
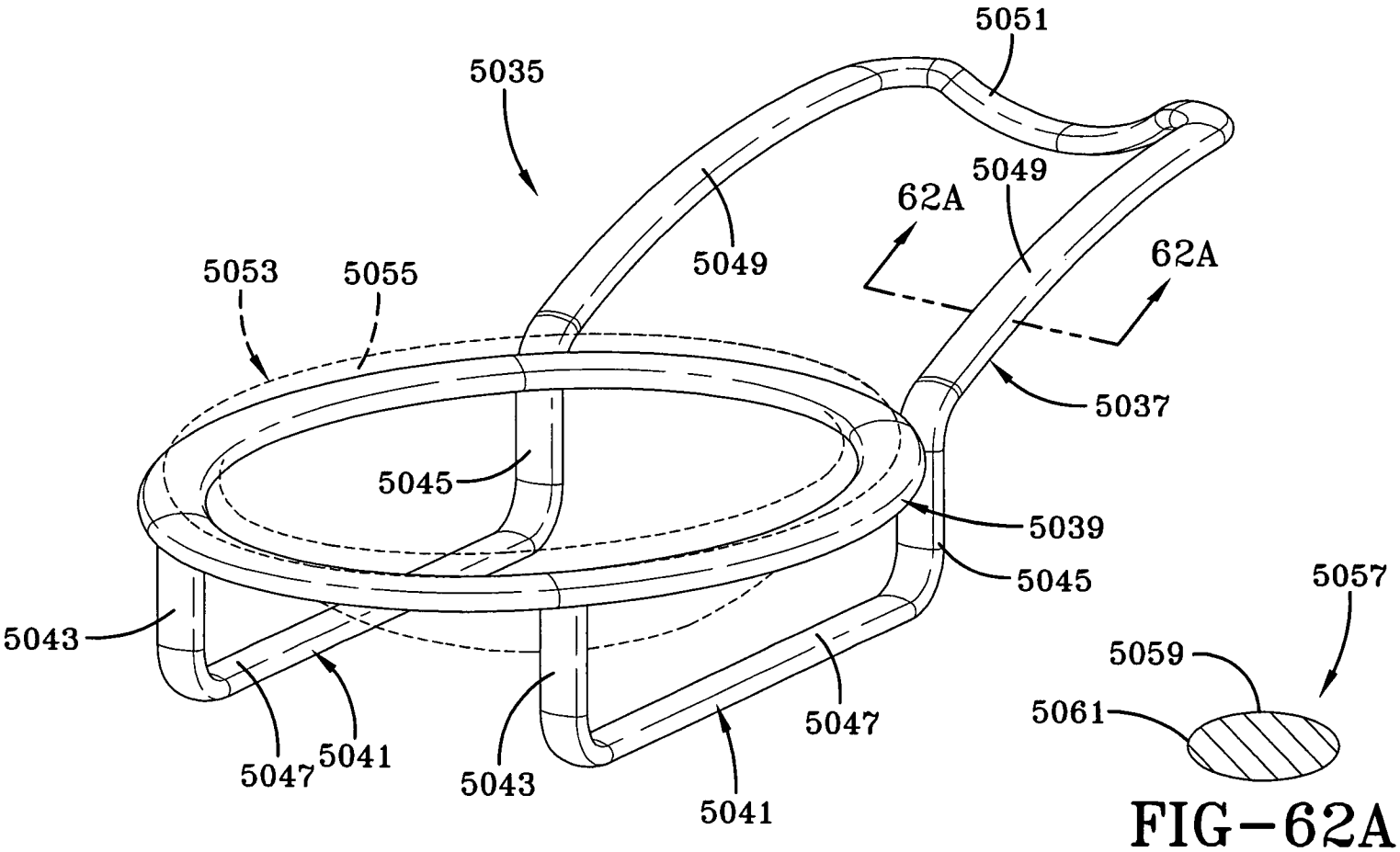
FIG. 62 is a perspective view of a spoon rest assembly according to the invention.
FIG. 62A is taken in the direction 62A-62A.

A spoon rest 5035 is shown in FIG. 62. Spoon rest 5035 includes a lounge-like portion 5037 and a bowl holding portion 5039. Lounge-like portion 5037 includes a pair of opposing U-shaped portions 5041. Portions 5041 each have parallel, opposing legs 5043 and 5045 which are disposed at the opposite ends of an integral connecting piece 5047, the latter being the stabilizing members. A pair of upwardly inclined arms 5049 are integral with, and extend from, legs 5045. Arms 5049 are parallel with, and opposed to, the other inclined arm 5049. A downwardly bowed crosspiece 5051 interconnects inclined arms 5049, and the bow is a resting place for a handle of a spoon.

Figure 62B:
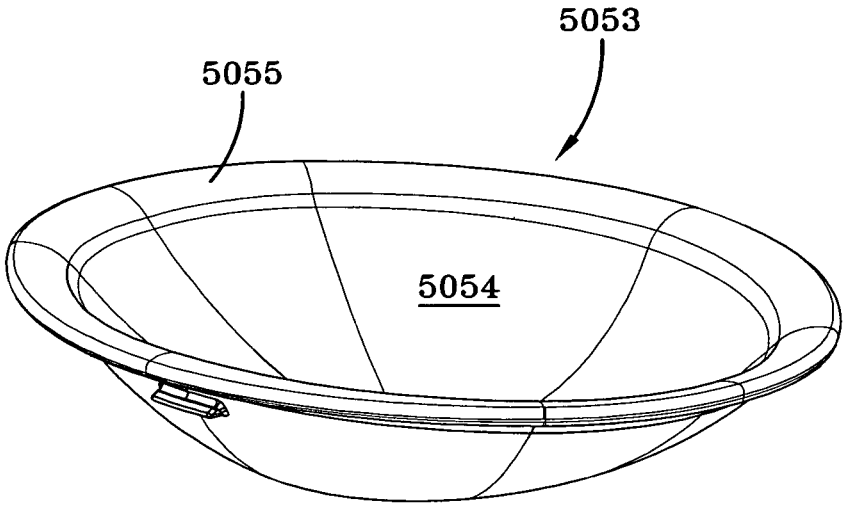
FIG. 62B is a perspective view of a bowl portion of the assembly shown in FIG. 62.

Bowl holding portion 5039 is circular in shape, and is welded to the upper ends of each of legs 5043 and 5045, and welded to the surface of the upper end of legs 5045, for rendering bowl holding portion 5039 in a horizontal position when feet 5047 are resting on a horizontal ground surface. A bowl 5053, shown in dotted lines, rests on the upper surface of bowl holding portion 5039. Bowl 5053 is shown in solid lines in FIG. 62B. Bowl 5053 is curved in cross section, and has a dish portion 5054 and a rim 5055 for resting on bowl holder portion 5039. Bowl 5053 could be fixed in bowl retaining portion 5039, or be removable therefrom. All of the foregoing components, other than connecting pieces 5047, are part of the utilitarian member. Each of lounge-like portions 5037 and bowl holding portion 5039 have an oval cross section 5057 shown in FIG. 62A, with wide surfaces 5059 and narrow surfaces 5061. Wide surfaces 5059 faces upwardly to provide a wide surface for a spoon handle to lean against and for the base of a spoon to sit on bowl holding portion 5039. Wide surfaces 5059 are used to weld bowl holding portion 5039 to lounge-like portion 5037.

Spoon rest 5035 is sturdy and effective in use, and has the same sleek, modem appearance as the other embodiments of the present invention. Spoon rest 5035 could either have a muted surface, such as by having a dull, bronze-like surface or be highly reflective. It looks sleek and modern.

Figure 63A:
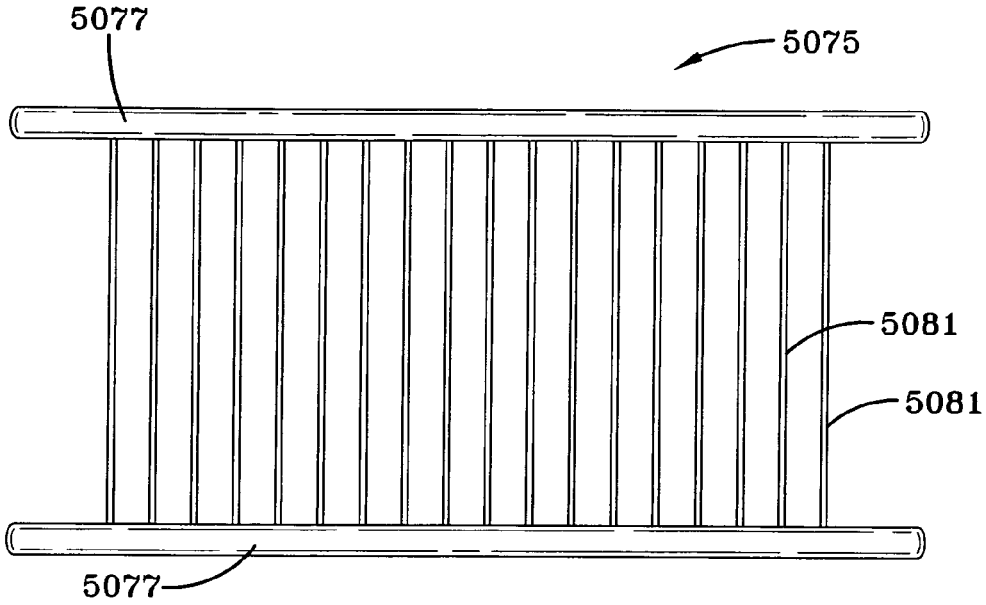
FIGS. 63A and 63B are top and side views of a table top CD holder according to the invention.
Figure 63B:
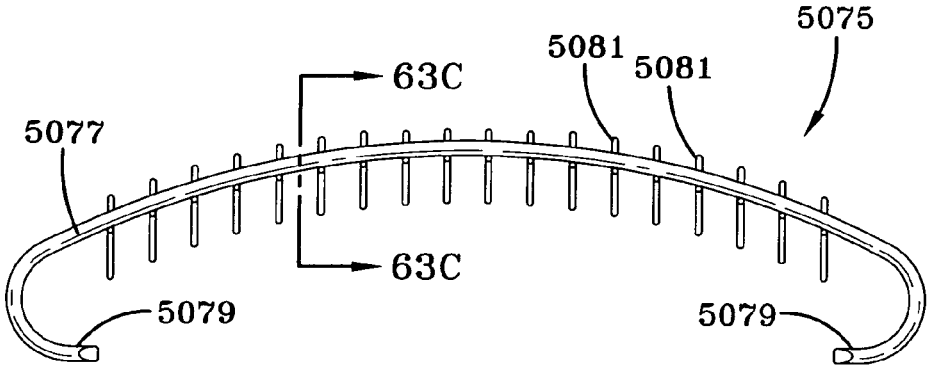

A CD holder 5075 according to the invention is shown in FIGS. 63A and 63B. CD holder 5075 is composed of a pair of arch-like members 5077, each being curled under at its opposite ends to form opposing coplanar feet 5079, forming the stabilizing member. A set of wire forms 5081 are welded to the underside of each of arch-like portions 5077. Wire forms 5081 are spaced apart sufficiently to enable CD holders (jewel cases) to fit between the respective wire forms 5081 and rest on the ground surface beneath the wire forms. Wire forms 5081 are depressed in their center portions as shown in FIG. 63D at 5083, to increase the area of contact between the respective wire forms 5081 and the CD cases. Parts 5077 and 5081 form the utilitarian member.

Figure 63C:
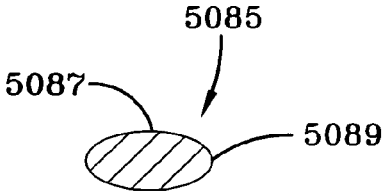
FIG. 63C is a cross-sectional view of an arch-like member forming part of the CD holder.
Figure 63D:
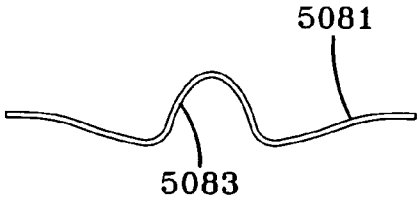
FIG. 63D is a side view of a wire form constituting part of the CD holder.

Referring to FIG. 63C, each of arch portions 5077 has a cross section 5085 with wide surfaces 5087 and narrow surfaces 5089. Wide surfaces 5087 face upwardly and downwardly both to improve the area that wire forms 5081 can be welded to the respective arch portions, and to give CD holder 5075 a sleek, modem and attractive appearance.

Figure 64A:
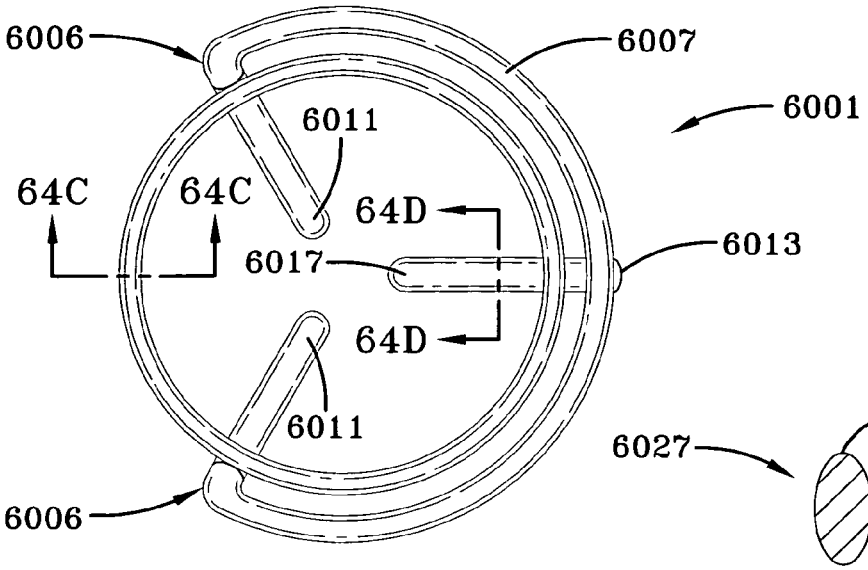
FIGS. 64A and 64B are top and side views of a stand up spoon rest according to the invention.
Figure 64C:
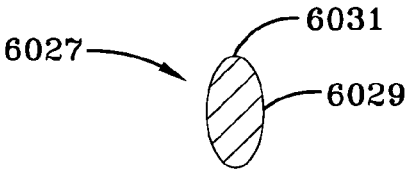
FIGS. 64C and 64D are taken in the directions 64C-64C and 64D-64D.
Figure 64D:
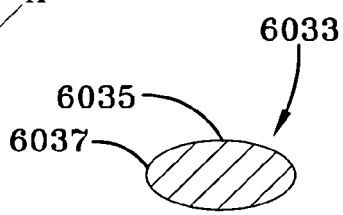
Figure 64B:
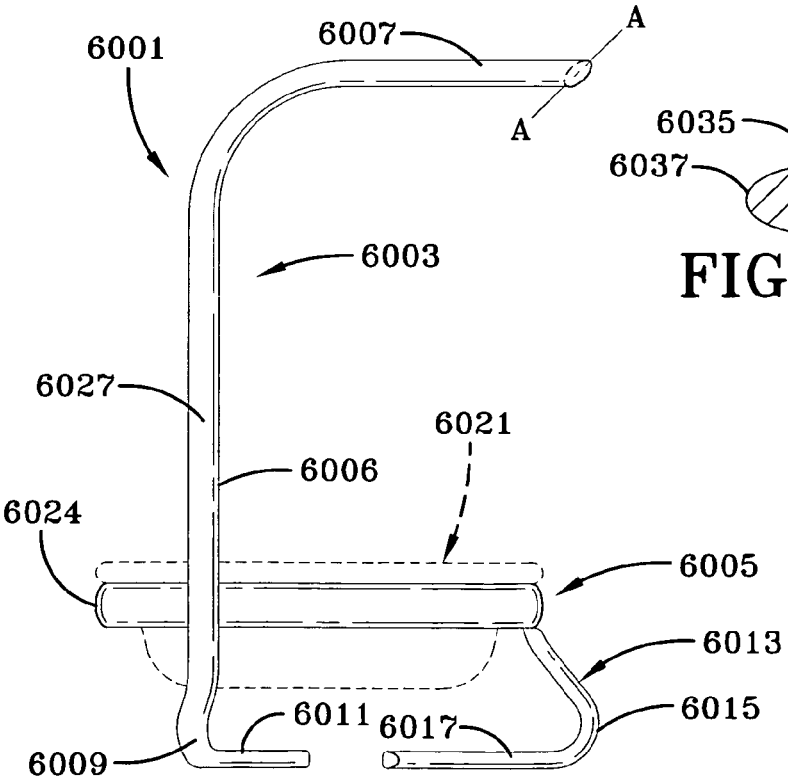
Figure 64E:
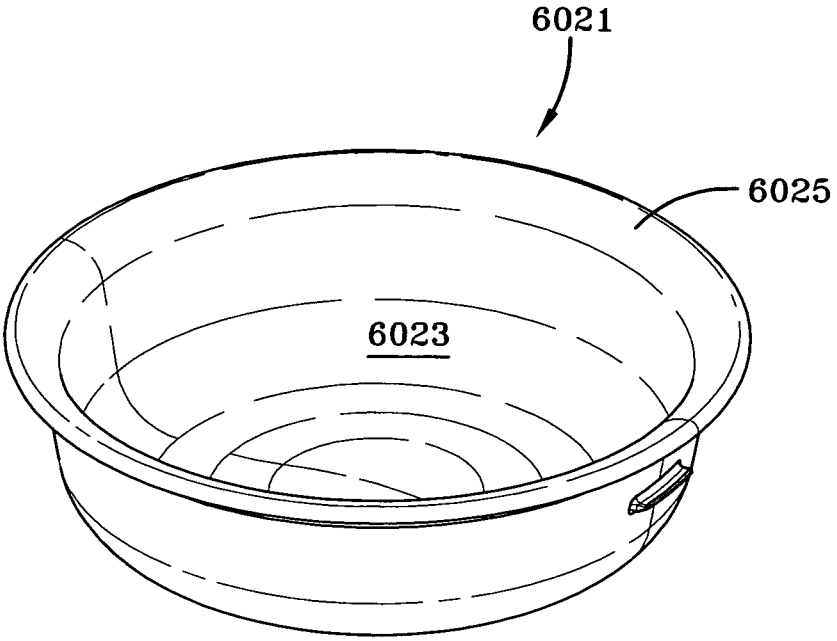

A standing spoon rest 6001 is shown in FIGS. 64A and 64B. Standing spoon rest 6001 is composed of a spoon rest and foot structure 6003 and a bowl holding portion or support 6024. Spoon rest and foot structure 6003 is comprised of a pair of upstanding legs 6005 which are connected at their upper ends by an integral arc portion 6007, which spaces legs 6005 about 120° from each other. Upstanding legs 6005 have at each of their lower portions an elbow 6009 from which extend feet 6011. Another foot portion 6013 is welded to the base of bowl support portion 6005 and foot portion 6013 includes an elbow 6015 from which a foot 6017 extends. Feet 6011 and 6017 (forming the stabilizing member) lie along part of radii extending from the central axis of bowl support 6024, but feet 6011 and 6017 extend inwardly along the radii but do not extend to the central axis of bowl support 6024. A bowl 6021 is shown in dotted lines in FIGS. 64A and 64B, and is also shown in FIG. 64E in solid lines. Bowl 6021 has a dish portion 6023 from which extends a rim 6025, rim 6025 resting on the upper portion of bowl support 6024. Rim 6025 can simply lie loosely on rim 6025, or be attached thereto permanently by an appropriate means. In the preferred embodiment, bowl 6021 is made of an appropriate rigid plastic, such as polypropylene. All of the foregoing components other than the feet 6011 and 6017 form the utilitarian member.

The metal components of standing spoon rest 6001 have a oval cross sections. FIG. 64C shows a cross section 6027 having wide surfaces 6029 and narrow surfaces 6031. This is a cross section for both spoon rest and foot structure 6003 and foot portion 6013. Considering first spoon rest and foot structure 6003, the wide surfaces of each of legs 6005 face inwardly so as to oppose each other, and are visible in FIG. 64B. Arc 6007 is twisted from legs 6005, so that the wide surfaces are inclined as shown by the axis AA which is perpendicular to the thickest part of the wide surfaces. The wide surfaces of feet 6011 and 6017 are flat against the ground, to make standing spoon rest 6001 more stable.

An oval cross section 6033 for bowl support 6024 is shown in FIG. 64D. Cross section 6033 has wide surfaces 6035 and narrow surfaces 6037. Narrow surfaces 6037 extend upwardly and downwardly to provide a sharp surface for bowl 6021 to rest upon. This provides a more stable rest for bowl 6021.

Standing spoon rest 6001 both appears to be stable and effective in use, and standing spoon rest 6001 is in fact sturdy, stable and effective in use. Its appearance is attractive, because of its sleek and modern look.

Figure 65A:
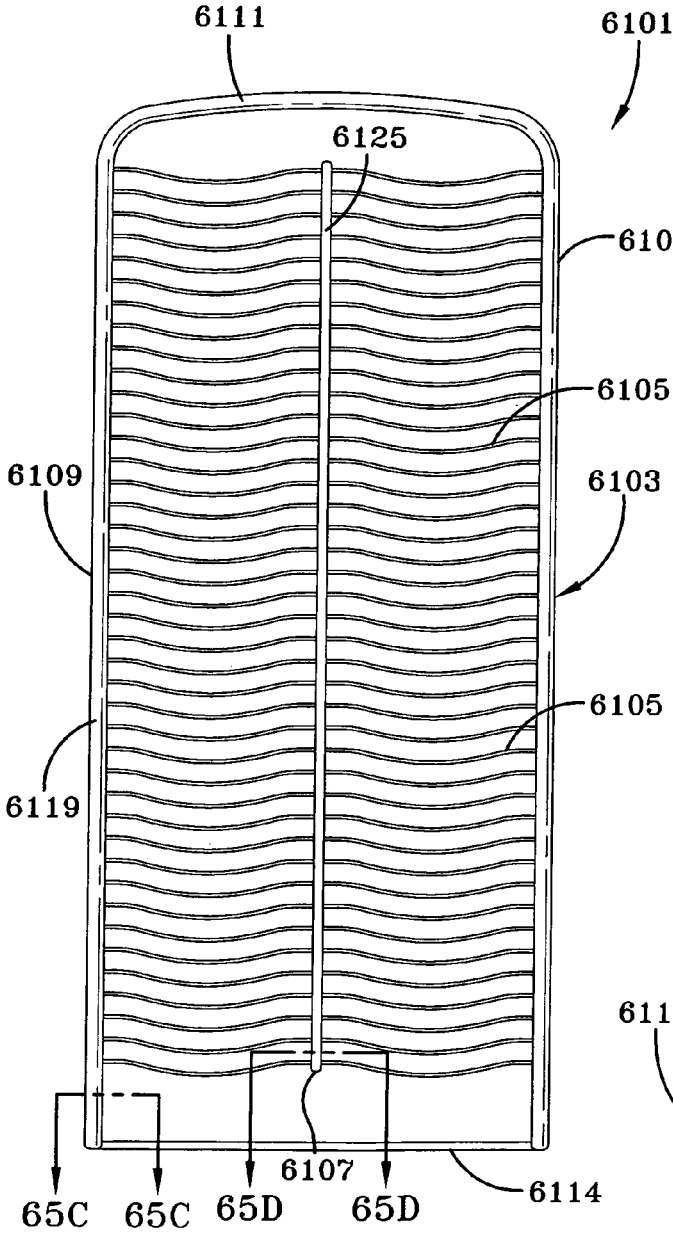
FIGS. 65A and 65B are front and side views of a CD holder according to the invention.
Figure 65B:
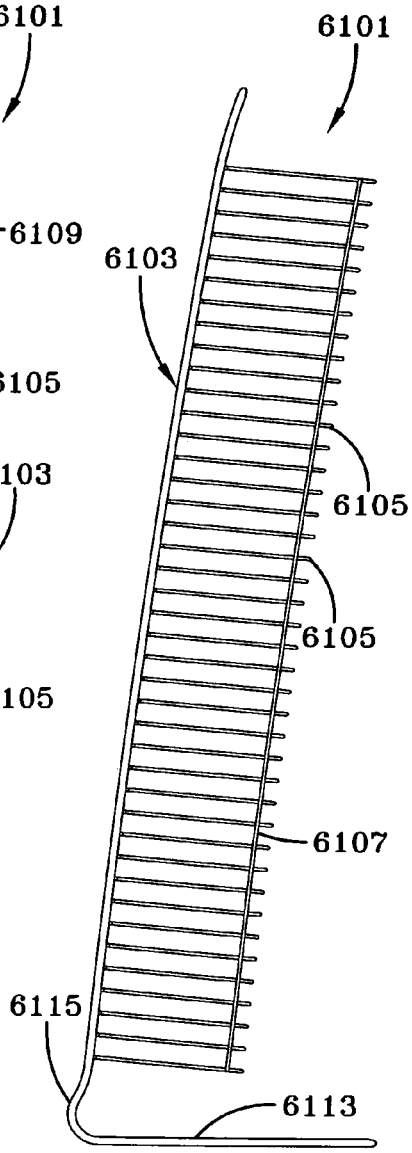

A CD holder 6101 is shown in FIGS. 65A-65B. CD holder 6101 is constructed to hold a single stack of CDs. CD holder 6101 includes an outer frame 6103, a set of wire forms 6105 and a center support structure 6107. Frame 6103 includes a pair of opposing, upstanding, parallel legs 6109 which are connected at their upper end by a slightly curved crosspiece 6111, and which terminate at the lower end at an extending foot 6113 from an elbow 6115 at the base of legs 6109. Feet 6113 are joined by a crosspiece 6114, and together make the stabilizing member. Legs 6109 are inclined partly over feet 6113 by an angle sufficient to hold the CD covers in place. In the preferred embodiment, the incline is about 5° from the vertical. Wire forms 6105 are spaced equidistantly between legs 6109, and they are welded to the back of legs 6109 so that the weld cannot be seen when viewed from the front as shown in FIG. 65A. Wire forms 6105 have a downward center trough, so that the rear corners of CD cases extended through both sides of the rear part of the trough, which would be near but behind each of legs 6109. The front of the covers of inserted CD cases would extend outwardly from the front of CD holder 6101. All of the above parts other than feet 6113 and crosspiece 6114 form the utilitarian member.

Figure 65C:
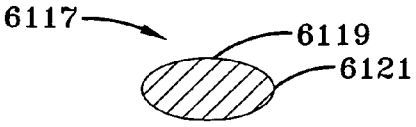
FIGS. 65C and 65D are taken in the direction of the arrows 65C-65C and 65D-65D.

Frame 6103 has a cross section 6117 shown in FIG. 65C, having wide surfaces 6119 and narrow surfaces 6121. The wide surfaces are viewable from the front of the unit as shown in FIG. 65A. This presents a broad surface to which wire form 6105 can be welded, yielding a wide weld area for an improved weld.

Figure 65D:
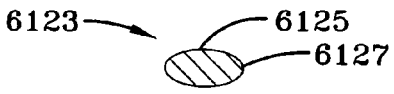

Central support 6107 has a cross section 6123. Cross section 6123 has wide surfaces 6125 and narrow surfaces 6127. These are shown in FIG. 65D. Central support 6107 is oriented so that wide surfaces 6125 are visible from the front of the unit as shown in FIG. 65A.

CD holder 6101 is a very stable, strong unit. CDs installed between wire forms 6105 remain in place, and can easily be inserted into the space between the respective wire forms 6105 and withdrawn therefrom. Withdrawal is easy since the CD covers extend outwardly from between legs 6109 and can easily be grasped and withdrawn or inserted between the respective wire forms. CD holder 6101 has a very clean appearance with a sleek and modern look, and can easily be used and displayed in a person's home.

Figures 66, 66A:
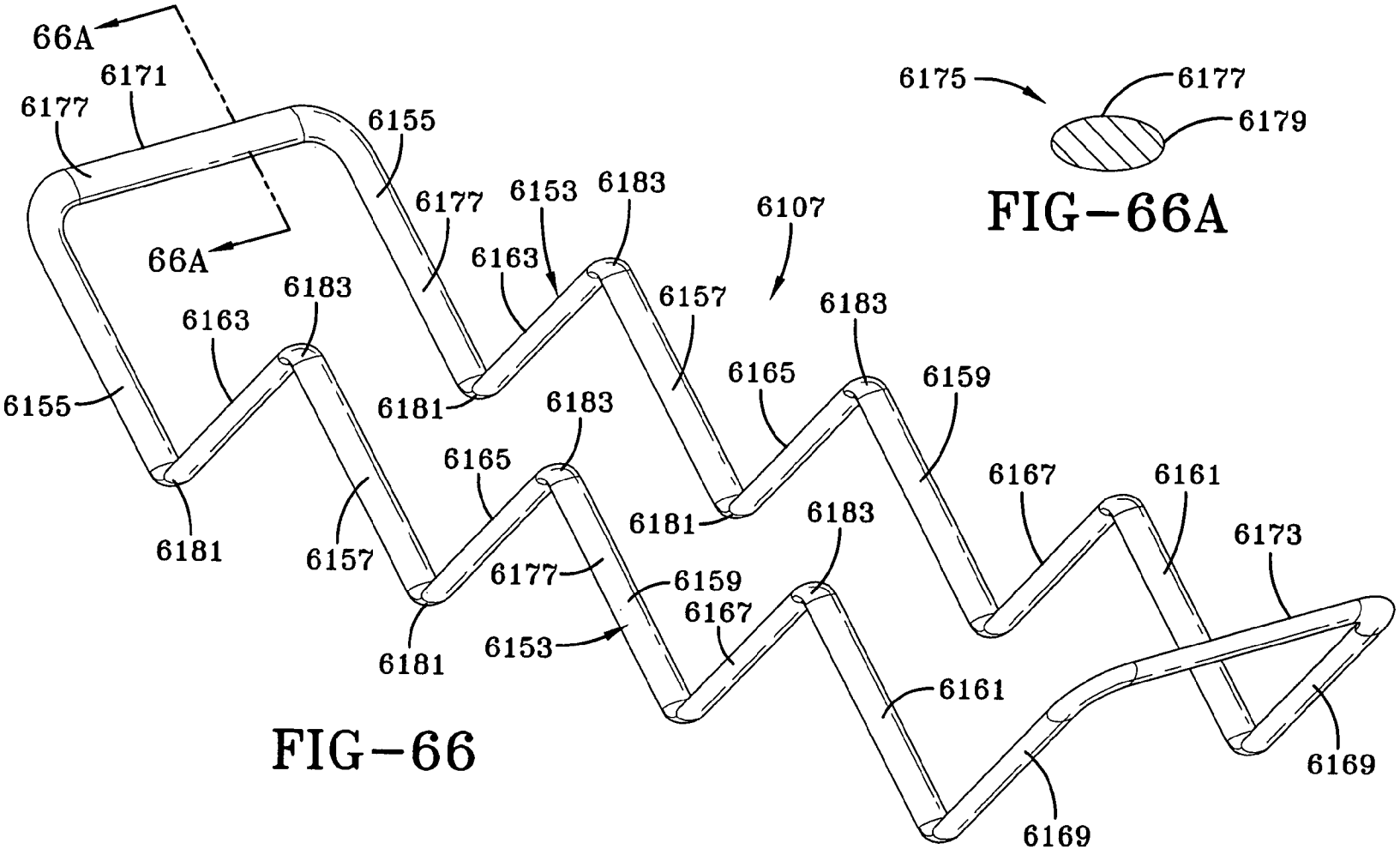
FIG. 66 is a perspective view of a table top CD/DVD holder according to the invention.
FIG. 66A is taken in the direction of arrows 66A-66A.

Turning next to FIG. 66, a CD or DVD holder 6151 is shown. CD holder 6151 is comprised of a pair of opposing legs 6153, each having been bent in several corresponding locations by 90° to define resting places for CDs or DVDs. Each resting place has a pair of opposing, coplanar legs 6155, 6157, 6159 and 6161 (the number of resting places is unlimited; here, four resting places are shown). Facing in one direction, and another set of opposing coplanar legs 6163, 6165, 6167 and 6169. Leg assemblies 6153 are joined at their opposite ends by crosspieces 6171 and 6173. CD or DVD holder 6151 has a cross section 6175 with wide surfaces 6177 and narrow surfaces 6179. Cross section 6175 is shown in FIG. 66A. CD or DVD holder 6151 includes a set of corners 6181 which are coplanar and another set of corners 6183 which are also coplanar. Holder 6151 can be set on either set of corners 6181 or 6183 (one of which is the stabilizing member), each yielding the same functional product. CD holders or DVD holders can be set against any of opposing, parallel legs 6155, 6163, 6157, 6165, 6159, 6167, 6161 or 6169 for easy storage. If holder 6151 were turned over to rest on corners 6183, the legs on the opposite sides of legs 6155, 6163, 6157, 6165, 6159, 6167, 6161 and 6169 would serve the same purpose as the other side of the respective parts would form when corners 6181 are the resting points. The legs and crosspieces constitute the utilitarian member.

Wide surfaces 6177 face generally upwardly to be engaged by CD holders or DVD holders, providing a relatively broad resting surface as compared to narrow surfaces 6179 or units made from cylindrical wires. CD or DVD holder 6151 is very effective in use, could be of almost any length, and is sleek and modern in appearance.

The invention has many advantages over the prior art as explained above. The welding process is improved due to the wide areas which are most often used as the welding site. The wide surfaces hide the weld connections better than do cylindrical surfaces, thus yielding a cleaner appearing product. Another main advantage is the ease of handling the respective products due to the wide surfaces of the oval cross section; i.e. the inventive products are more ergonomic than those made with rods having non-oval shaped cross sections. The oval cross section yields better sliding surfaces than do products made with rods having cylindrical cross sections. Additionally, the oval cross section provides greater flexibility in the types of products being designed and made. The flexibility relates to the option of using either the wide surface or the narrow surface of the oval cross section. For example, in shelving type products, the wide surfaces enable ease of sliding, since it minimizes the gaps between the rods when compared with cylindrical rods, and avoids the creases or undesired depressions or "lines" which occur in clothing when cylindrical rods are used. Narrow surfaces are advantageous where minimum surface contact is desired, as in dish drainers. And as explained at various places above, rods with the oval cross section yield products having a sleek and modern appearance.

The invention has been described in detail with particular emphasis on the preferred embodiments thereof, but variations and modifications to those skilled in the art to which the invention pertains.

What is claimed is:

1. A one-piece utility device in the form of a tie, scarf and belt holder comprising a stabilizing member, a stem and a utilitarian member, each of said stabilizing member, said stem and said utilitarian member respectively being made from respective metal rods having respective oval cross sections, said stabilizing member, said stem and said utilitarian member being fixed and stationary with respect to each other, said stabilizing member, said stem and said utilitarian member each having a uniform cross section:

said stabilizing member comprising a stabilizing hook having an interior wide surface for engaging a horizontal support and an opposing exterior wide surface, said stabilizing hook having a free end and an opposite stem merging portion;

said stem being merged with said stabilizing hook at said stem merging portion and having opposing wide surfaces as a continuation of said interior wide surface and said opposing exterior wide surface of said stabilizing member;

said utilitarian member being provided for use with ties, scarves and belts, said utilitarian member comprising:

a transverse member, oval in cross section, having opposing transverse wide surfaces respectively facing upwardly and downwardly when said tie, scarf and belt holder is in use, said transverse member having opposing transverse member narrow surfaces convexly curved with respect to each other and interconnecting said transverse wide surfaces, and long transverse member axes extending between said transverse member narrow surfaces, said long transverse member axes lying in a first plane, said transverse member being operatively connected to said stem; and at least one tie, scarf and belt holder element, oval in cross section having opposing wide surfaces and opposing narrow surfaces interconnecting said last mentioned opposing wide surfaces, each of said at least one tie, scarf and belt holder elements being located in respective parallel second planes in the event there are more than one tie, scarf and belt holder elements, said second planes being transverse to said first plane, said at least one tie, scarf and belt holder element having a bent inclined tie and scarf support at one end, a bent belt holding hook at the other end, and a connecting portion connecting said bent tie and scarf support and said bent belt holder hook, said opposing wide surfaces of said at least one tie scarf and belt holder element facing generally upwardly and downwardly when said element is in use.

2. A hanging device for engaging a horizontal support and for holding items on said hanging device, said hanging device comprising:

a metal rod with a uniform oval cross section, said rod comprising:

opposing rod wide surfaces convexly curved with respect to each other;

opposing rod narrow surfaces convexly curved with respect to each other and interconnecting said rod wide surfaces;

respective short rod axes extending between said rod wide surfaces;

respective long rod axes transverse to said respective short rod axes and extending between said narrow rod surfaces, said long rod axes being parallel and said short central rod axes being parallel when said rod is straight;

at least one of said opposing rod wide surfaces increasing the surface area of contact for an item engaged by said at least one of said opposing rod wide surfaces relative to the surface of contact of said opposing rod narrow surfaces;

a bent supporting section in the form of a hook disposed in a vertical position when engaging a horizontal support with said respective long rod axes remaining parallel to each other and said short rod axes lying in a common plane; and a hanging section in the form of a stem integral with and extending from said hook, said stem having a connecting end distal from said hook, said connecting end having said uniform oval cross section with said short rod axes and said rod long axes; and a transverse member made from a metal rod with a uniform oval cross section to form a supporting rod, said supporting rod being straight and comprising:

opposing transverse member wide surfaces convexly curved with respect to each other;

opposing transverse member narrow surfaces conversely curved with respect to each other and interconnecting said transverse member wide surfaces;

respective short transverse member axes extending between said transverse member wide surfaces;

respective long transverse member axes transverse to said respective short transverse member axes and extending between said transverse member narrow surfaces, said short transverse member axes lying in a first common plane and said long transverse member axes lying in a second common plane transverse to the first common plane; and an intermediate attachment place on one of said transverse member wide surfaces;

said connecting end of said stem engaging one of said wide surfaces of said transverse member at said intermediate attachment place, said long axes of said stem being parallel to said second common plane and said short axes of said stem lying in said first common plane;

at least one holding arm extending transversely from one of said transverse member wide surfaces, said respective holding arm comprising:

opposing holding arm wide surfaces convexly curved with respect to each other;

and opposing holding arm narrow surfaces convexly curved with respect to each other and interconnecting said holding arm wide surfaces;

one of said holding arm wide surfaces facing upwardly when said hook is in the vertical position, for engagement with ties, belts and/or scarves able to be hung thereon.

3. A hanging device for being hung on a horizontal support extending in a horizontal direction for holding ties, scarves and belts, said hanging device comprising:

a stabilizing member made of an integral first metal rod having a uniform stabilizing member oval cross section with stabilizing member long axes being parallel to each other and extending in the horizontal direction when said hanging device is hung on a horizontal support, said stabilizing member including:

a hook for engaging a horizontal support, said hook having a free end and opposite hook end portion; and a stem extending vertically downwardly from said hook end portion when said hanging device is hung on a horizontal support, said stem having a connection end distal said hook;

a transverse member made from a straight metal rod having a uniform transverse member oval cross section with transverse member long axes parallel with each other and extending in the horizontal direction when said hanging device is hung on a horizontal support, said transverse member being connected to said connection end of said stem and being perpendicular to said stem; and a set of combination tie holders and belt and scarf holders, each of said combination tie holders and belt and scarf holders being made from a metal rod having a uniform combination-tie-holder-and-belt-and-scarf-holder oval cross section with combination-tie-holder-and-belt-and-scarf-holder long axes being parallel to each other and perpendicular to said stabilizing member long axes, each of said combination tie holder and belt and scarf holder comprising:

a connecting portion attached to and perpendicular with said transverse member having a tie-holder connecting portion and a belt-and-scarf-holder connecting portion at opposite ends of said connecting portion;

a tie holder extending from one end of said connecting portion; and a belt and scarf holder extending from the other end of said connecting portion, said tie holder and said belt and scarf holder being located on opposite sides of said transverse member;

each of said combination tie holders and belt and scarf holders being spaced along said transverse member, being parallel to each other, and having a downwardly extending portion extending in a downward direction from said transverse member when said hanging device is hung on a horizontal support, and an upwardly bent portion distal said connecting portion when said hanging device is hung on a horizontal support.

4. A hanging device according to claim 3 wherein said combination tie holders and belt and scarf holder are equidistantly spaced along said transverse member.

5. A hanging device according to claim 3 wherein said stabilizing member is attached to an upwardly-facing side of said transverse member and said set of combination tie holders and belt and scarf holders are attached to a downwardly facing side of said transverse member, when said hanging device is hung from a horizontal support.

6. A hanging device according to claim 3 wherein said uniform combination-tie-holder-and-belt-and-scarf-holder oval cross section has a relatively small geometric area, said uniform stabilizing-member oval cross section is relatively larger than said uniform combination tie-holder-and-belt-and-scarf-holder oval cross section, and said uniform transverse-member oval cross section is relatively larger than the uniform stabilizing member and cross section.

* * * * *